US011389694B1

(12) United States Patent
Walker

(10) Patent No.: US 11,389,694 B1
(45) Date of Patent: Jul. 19, 2022

(54) ROTATIONAL AND LINEAR RESISTANCE FORCE EXERCISE APPARATUS

(71) Applicant: Aaron Joseph Walker, Albuquerque, NM (US)

(72) Inventor: Aaron Joseph Walker, Albuquerque, NM (US)

( * ) Notice: Subject to any disclaimer, the term of this patent is extended or adjusted under 35 U.S.C. 154(b) by 93 days.

(21) Appl. No.: 16/723,821

(22) Filed: Dec. 20, 2019

Related U.S. Application Data

(60) Continuation-in-part of application No. 15/721,479, filed on Sep. 29, 2017, now Pat. No. 10,549,152, (Continued)

(51) Int. Cl.
*A63B 23/12* (2006.01)
*A63B 21/00* (2006.01)
(Continued)

(52) U.S. Cl.
CPC .... *A63B 23/1209* (2013.01); *A63B 21/00069* (2013.01); *A63B 21/0628* (2015.10); (Continued)

(58) Field of Classification Search
CPC ..... A63B 21/00058; A63B 21/00065; A63B 21/00069; A63B 21/00072; A63B 21/00076; A63B 21/00181; A63B 21/00192; A63B 21/005; A63B 21/0051; A63B 21/008; A63B 21/0083; A63B 21/0085; A63B 21/0087; A63B 21/012; A63B 21/0125; A63B 21/015; A63B 21/018; A63B 21/02; A63B 21/023; A63B 21/04; A63B 21/0407; A63B 21/0414; A63B 21/0421; A63B 21/0428; A63B 21/0435; A63B 21/0442; A63B 21/055; A63B 21/0552; A63B 21/0555; A63B 21/0557; A63B 21/06; A63B 21/0608; (Continued)

(56) References Cited

U.S. PATENT DOCUMENTS 4,296,924 A 10/1981 Anzaldua et al.
4,313,603 A 2/1982 Simjian
(Continued)

FOREIGN PATENT DOCUMENTS

WO 2005016464 A1 2/2005
WO 2007139907 A2 12/2007
(Continued)

OTHER PUBLICATIONS

"Leeway Standing Tummy Twister Heavy Duty with Handle", https://www.amazon.in/Standing-Twister-Exercise-Machine-Fitness/dp/B071S15BDN, 2010.

*Primary Examiner* — Gary D Urbiel Goldner
(74) *Attorney, Agent, or Firm* — Peacock Law P.C.; Philip D. Askenazy

(57) ABSTRACT

An exercise apparatus with an adjustable rotating element around which a force transferring material wraps either clockwise or counterclockwise to provide bidirectional rotational resistance for exercising. The force transferring material is preferably guided to remain in close proximity to the rotating element while wrapping around the rotating element. Multiple attachments provide great flexibility in performing exercise or physical therapy.

27 Claims, 66 Drawing Sheets

Related U.S. Application Data which is a continuation-in-part of application No. 15/674,403, filed on Aug. 10, 2017, now Pat. No. 10,737,139, which is a division of application No. 14/672,030, filed on Mar. 27, 2015, now abandoned.

(51) Int. Cl.

| | |
|---|---|
| ***A63B 21/062*** | (2006.01) |
| ***A63B 23/14*** | (2006.01) |
| ***A63B 23/00*** | (2006.01) |
| ***A63B 23/04*** | (2006.01) |
| ***A63B 23/035*** | (2006.01) |
| ***A63B 23/02*** | (2006.01) |
| ***A63B 21/055*** | (2006.01) |
| ***A63B 21/02*** | (2006.01) |
| ***A63B 21/012*** | (2006.01) |
| ***A63B 21/008*** | (2006.01) |
| ***A63B 21/005*** | (2006.01) |

(52) U.S. Cl.

CPC ..... *A63B 21/4033* (2015.10); *A63B 21/4034* (2015.10); *A63B 21/4035* (2015.10); *A63B 21/4047* (2015.10); *A63B 21/4049* (2015.10); *A63B 23/14* (2013.01); *A63B 21/005* (2013.01); *A63B 21/008* (2013.01); *A63B 21/0051* (2013.01); *A63B 21/0085* (2013.01); *A63B 21/00181* (2013.01); *A63B 21/00192* (2013.01); *A63B 21/012* (2013.01); *A63B 21/023* (2013.01); *A63B 21/0552* (2013.01); *A63B 21/155* (2013.01); *A63B 21/156* (2013.01); *A63B 23/0238* (2013.01); *A63B 23/03525* (2013.01); *A63B 23/0405* (2013.01); *A63B 23/0482* (2013.01); *A63B 2023/003* (2013.01); *A63B 2208/0204* (2013.01); *A63B 2208/0233* (2013.01); *A63B 2225/093* (2013.01)

(58) Field of Classification Search

CPC ..... A63B 21/0618; A63B 21/062; A63B 21/0622; A63B 21/0624; A63B 21/0626; A63B 21/0628; A63B 21/063; A63B 21/0632; A63B 21/08; A63B 21/15; A63B 21/151; A63B 21/152; A63B 21/153; A63B 21/154; A63B 21/155; A63B 21/156; A63B 21/159; A63B 21/16; A63B 21/22; A63B 21/222; A63B 21/225; A63B 21/227; A63B 21/4011; A63B 21/4027; A63B 21/4033; A63B 21/4034; A63B 21/4035; A63B 21/4039; A63B 21/4045; A63B 21/4047; A63B 21/4049; A63B 2023/003; A63B 23/035; A63B 23/03508; A63B 23/04; A63B 23/0405; A63B 23/0482; A63B 23/0494; A63B 2208/0214; A63B 2225/09; A63B 2225/093

See application file for complete search history.

(56) References Cited

U.S. PATENT DOCUMENTS

| | | | | | |
|---|---|---|---|---|---|
| 4,373,717 | A | | 2/1983 | Lambert, Jr. | |
| 4,390,180 | A | | 6/1983 | Simjian | |
| 4,391,441 | A | | 7/1983 | Simjian | |
| 4,478,413 | A | | 10/1984 | Siwula | |
| 4,515,363 | A | | 5/1985 | Schleffendorf | |
| 4,601,468 | A | * | 7/1986 | Bond | G16H 20/30 482/7 |
| 4,602,618 | A | | 7/1986 | Berze' | |
| 4,673,180 | A | | 6/1987 | Rice | |
| 4,691,694 | A | * | 9/1987 | Boyd | A63B 21/0058 482/5 |
| 4,772,015 | A | * | 9/1988 | Carlson | A63B 23/12 482/902 |
| 4,776,587 | A | * | 10/1988 | Carlson | A63B 23/0494 482/134 |
| 4,878,663 | A | | 11/1989 | Luquette | |
| 4,893,808 | A | | 1/1990 | McIntyre et al. | |
| 4,934,694 | A | * | 6/1990 | McIntosh | A63B 24/00 482/137 |
| 4,988,098 | A | | 1/1991 | Miller | |
| 5,067,708 | A | | 11/1991 | Oschansky et al. | |
| 5,118,098 | A | | 6/1992 | Jones | |
| 5,152,733 | A | | 10/1992 | Farenholtz et al. | |
| 5,284,464 | A | | 2/1994 | Lee, III et al. | |
| 5,336,138 | A | | 8/1994 | Arjawat | |
| 5,344,374 | A | | 9/1994 | Telle | |
| 5,399,140 | A | | 3/1995 | Klippel | |
| 5,403,251 | A | * | 4/1995 | Belsito | G16H 20/30 482/4 |
| 5,599,262 | A | | 2/1997 | Shih | |
| 5,709,637 | A | | 1/1998 | Gow et al. | |
| 5,718,654 | A | | 2/1998 | Kennedy | |
| 5,722,937 | A | * | 3/1998 | Smith | A63B 21/0058 601/23 |
| 5,776,039 | A | | 7/1998 | Perez, Jr. | |
| 5,788,607 | A | | 8/1998 | Baker | |
| 5,888,182 | A | | 3/1999 | Shih | |
| 6,007,500 | A | * | 12/1999 | Quintinskie, Jr. | A61H 1/0281 601/33 |
| 6,036,624 | A | * | 3/2000 | Cascini | A63B 21/154 482/130 |
| 6,106,437 | A | | 8/2000 | Brooks | |
| 6,261,212 | B1 | | 7/2001 | Vallone et al. | |
| 6,283,899 | B1 | | 9/2001 | Charnitski | |
| 6,875,159 | B2 | | 4/2005 | Chuang | |
| 7,081,074 | B1 | | 7/2006 | Rubin | |
| 7,137,928 | B1 | | 11/2006 | Chen | |
| 7,150,682 | B2 | | 12/2006 | Varner | |
| 7,604,576 | B2 | | 10/2009 | Drechsler | |
| 7,621,861 | B1 | | 11/2009 | Kalember et al. | |
| 7,625,318 | B1 | | 12/2009 | Heyn | |
| 7,628,736 | B2 | | 12/2009 | Vandyke | |
| 7,909,747 | B1 | | 3/2011 | Lacaze | |
| 7,927,262 | B2 | | 4/2011 | Clark | |
| 7,951,054 | B2 | | 5/2011 | Snow et al. | |
| 8,047,973 | B2 | | 11/2011 | Berenshteyn | |
| 8,834,328 | B1 | | 9/2014 | Batca | |
| 10,549,152 | B2 | * | 2/2020 | Walker | A63B 21/4049 |
| 10,737,139 | B2 | * | 8/2020 | Walker | A63B 21/4049 |
| 2002/0151417 | A1 | | 10/2002 | List | |
| 2004/0033869 | A1 | * | 2/2004 | Carlson | A63B 21/4003 482/121 |
| 2004/0097337 | A1 | | 5/2004 | Chuang | |
| 2005/0043143 | A1 | | 2/2005 | Chuang | |
| 2005/0227827 | A1 | | 10/2005 | Liester | |
| 2005/0239602 | A1 | * | 10/2005 | Cordova | A63B 23/0482 482/1 |
| 2006/0040799 | A1 | | 2/2006 | Pompile | |
| 2006/0252614 | A1 | | 11/2006 | Rotondale et al. | |
| 2007/0161472 | A1 | | 7/2007 | Drechsler | |
| 2008/0004164 | A1 | | 1/2008 | Alsip | |
| 2008/0058182 | A1 | | 3/2008 | Pompile | |
| 2008/0176722 | A1 | | 7/2008 | Steffee | |
| 2009/0163337 | A1 | | 6/2009 | Petrakov | |
| 2010/0317497 | A1 | | 12/2010 | Nadim | |
| 2011/0111925 | A1 | | 5/2011 | Hobson et al. | |
| 2011/0118096 | A1 | | 5/2011 | Nadim | |
| 2011/0237407 | A1 | | 9/2011 | Kaleal et al. | |
| 2011/0287914 | A1 | | 11/2011 | Morris | |
| 2012/0322624 | A1 | | 12/2012 | Wu | |
| 2014/0087923 | A1 | | 3/2014 | Warren | |
| 2014/0094721 | A1 | * | 4/2014 | Diallo | A63B 21/0058 601/5 |
| 2014/0121063 | A1 | | 5/2014 | Wireman | |
| 2014/0194260 | A1 | | 7/2014 | Campanaro et al. | |
| 2014/0336006 | A1 | | 11/2014 | Miller | |

(56) References Cited

U.S. PATENT DOCUMENTS

| | | | |
|---|---|---|---|
| 2015/0297932 | A1 | 10/2015 | Wehrell |
| 2016/0279459 | A1 | 9/2016 | Walker |
| 2017/0340918 | A1 | 11/2017 | Walker |
| 2018/0361200 | A1 | 12/2018 | Walker |

FOREIGN PATENT DOCUMENTS

| | | | |
|---|---|---|---|
| WO | 2011146541 | A2 | 11/2011 |
| WO | 2016160719 | A1 | 10/2016 |

* cited by examiner

ROTATIONAL AND LINEAR RESISTANCE FORCE EXERCISE APPARATUS

CROSS-REFERENCE TO RELATED APPLICATIONS

This application is a continuation-in-part application of U.S. patent application Ser. No. 15/721,479, entitled "Rotational and Linear Resistance Force Exercise Apparatus", filed on Sep. 29, 2017, which application is a Continuation-in-part of U.S. patent application Ser. No. 15/674,403, filed on Aug. 10, 2017, entitled "Rotational and Linear Resistance Force Exercise Apparatus", which is a divisional application of U.S. patent application Ser. No. 14/672,030, filed Mar. 27, 2015, entitled "Rotational and Linear Resistance Force Exercise Apparatus". The specifications and claims of these applications are incorporated herein by reference.

BACKGROUND OF THE INVENTION

Field of the Invention (Technical Field)

The present invention relates generally to exercise devices, and more particularly to body exercise equipment that utilizes a resistance force to provide the user with rotational as well as linear force to exercise.

Description of Related Art

Athletes, as well as physical therapists, have understood the need to strengthen, increase range of motion, and improve proprioception of the various parts of the body. Most commonly, fitness devices provide the user with an opportunity to extend and/or retract their limbs and/or torso, while acting against some kind of resistance force provided by an exercise apparatus. This is referred to as flexion and extension of the muscles. Rotational strengthening of various parts of the body provides a unique method of strengthening the body, as opposed to flexion and extension. Rotational strengthening involves supination and pronation of the limbs, in whole or in part, as well as left and right rotation of the neck, spine, or both. It is currently difficult to exercise the body in a rotational fashion because current inventions provide the user with an opposing linear force, rather than an opposing rotational force against which to interact their muscles. There are several muscles, and groups of muscles which benefit directly from rotational strengthening. While some currently available devices utilize rotational force for exercising, these systems lack in the ability to select the range of motion, and do not allow the user to attach several different unique attachments. There is a current need for a device which allows the user to gain strength by working against a restrictive force, in a rotational fashion, with multiple parts of their body. Furthermore, exercise equipment users are often limited in area to accommodate exercise equipment, therefore exercise apparatuses should ideally take up a small amount of space while providing many functions.

BRIEF SUMMARY OF THE INVENTION

Embodiments of the present invention comprise an exercise apparatus comprising a housing securable to a stationary framework. The housing comprising a rotating element. The rotating element being a feature upon which a person can install an exercise attachment. The rotating element being connected to a force transferring material. The force transferring material being connected to a resistance source. The level of resistance being either adjustable, or non-adjustable.

One embodiment comprises a housing which holds a spring that is attached to a tension adjustment feature at one end and attached to a cable at the other end, the cable being attached to a rotating element, and the rotating element being connectable to a variety of attachments that a person can exert force upon.

Another embodiment comprises a housing which contains a torsion spring. The torsion spring being connected to the housing at one end, and connected to a resistance force output at the other end. The resistance force output being a location at which a user can connect a choice of attachment to perform exercise against the rotational force.

Another embodiment comprises a housing which contains a piece of polymer which is secured at one end to the housing, and the other end is secured to the resistance force output. An attachment is placed onto the resistance force output and rotated by the user. The rotation of the attachment ultimately causes a twisting effect on the polymer which resists being twisted.

Another embodiment of the present invention is a component of a variable resistance exercise apparatus, the component comprising a cradle; a stem attached to an underside of the cradle aligned with an area of the cradle configured to receive a knee of a user of the variable resistance exercise apparatus, the stem configured to align with an axis of rotation of a bidirectionally rotatable element of the variable resistance exercise apparatus; and an opening configured to align with one of a plurality of holes near the circumference of the bidirectionally rotatable element. The component is preferably removably attachable to the variable resistance exercise apparatus, preferably by the user. The component is optionally permanently attachable to the variable resistance exercise apparatus. The component preferably comprises a pin extending through the opening for inserting into one of the holes. The interior of the cradle preferably comprises padding. The cradle preferably comprises sides approximately perpendicular to the area, the sides configured to receive pressure from a lower leg of the user, thereby rotating the bidirectionally rotatable element. The stem is optionally insertable through an opening at the center of the bidirectionally rotatable element, in which case the opening is preferably near an edge of the cradle. Alternatively the component optionally further comprises a platform connectable to the cradle, the platform configured to rest on and connect to the bidirectionally rotatable element, in which case the height of the cradle above the platform is preferably adjustable and the opening is preferably near an edge of the platform. The position of the hole chosen to align with the opening preferably determines a range of motion of the bidirectionally rotatable element. The component is preferably configured such that when the user's knee is on the area and the user's femur is vertical, a direction of the user's femur will be coincidental with an axis of rotation of the bidirectionally rotatable element. The bidirectionally rotatable element preferably exerts a constant torque directly opposing rotation of the user's femur.

Another embodiment of the present invention is a variable resistance exercise apparatus comprising the component described above attached to the bidirectionally rotatable element; and a force-transferring material providing bidirectional variable rotational resistance to the bidirectionally rotatable element and the component. The bidirectionally rotatable element preferably comprises a circular wheel. The force-transferring material is preferably disposed on a periphery of the bidirectionally rotatable element, preferably in a groove on the periphery of the bidirectionally rotatable element. The force-transferring material is preferably selected from the group consisting of a cable, a belt, a chain, a rope, and a rubber band. The force-transferring material is preferably guided with one or more pulleys disposed in proximity to the rotating element. The bidirectionally rotatable element is preferably disposed on a horizontal arm, which is preferably vertically adjustable, or optionally is fixed and not vertically adjustable. The bidirectional variable rotational resistance is preferably provided by a source selected from the group consisting of braking systems, friction, magnetic devices, electric devices, springs, adjustable weights, stretching a flexible material, hydraulics, and pneumatic devices. The component is preferably removable from the bidirectionally rotatable element by the user. The force-transferring material preferably wraps either clockwise or counterclockwise around the bidirectionally rotatable element, thereby providing the bidirectional variable rotational resistance. The bidirectionally rotatable element optionally comprises a plate fixed in a horizontal plane. The bidirectionally rotatable element preferably comprises a plate that is tiltable between 0 and 360 degrees about a horizontal axis.

Further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

Figure 1:
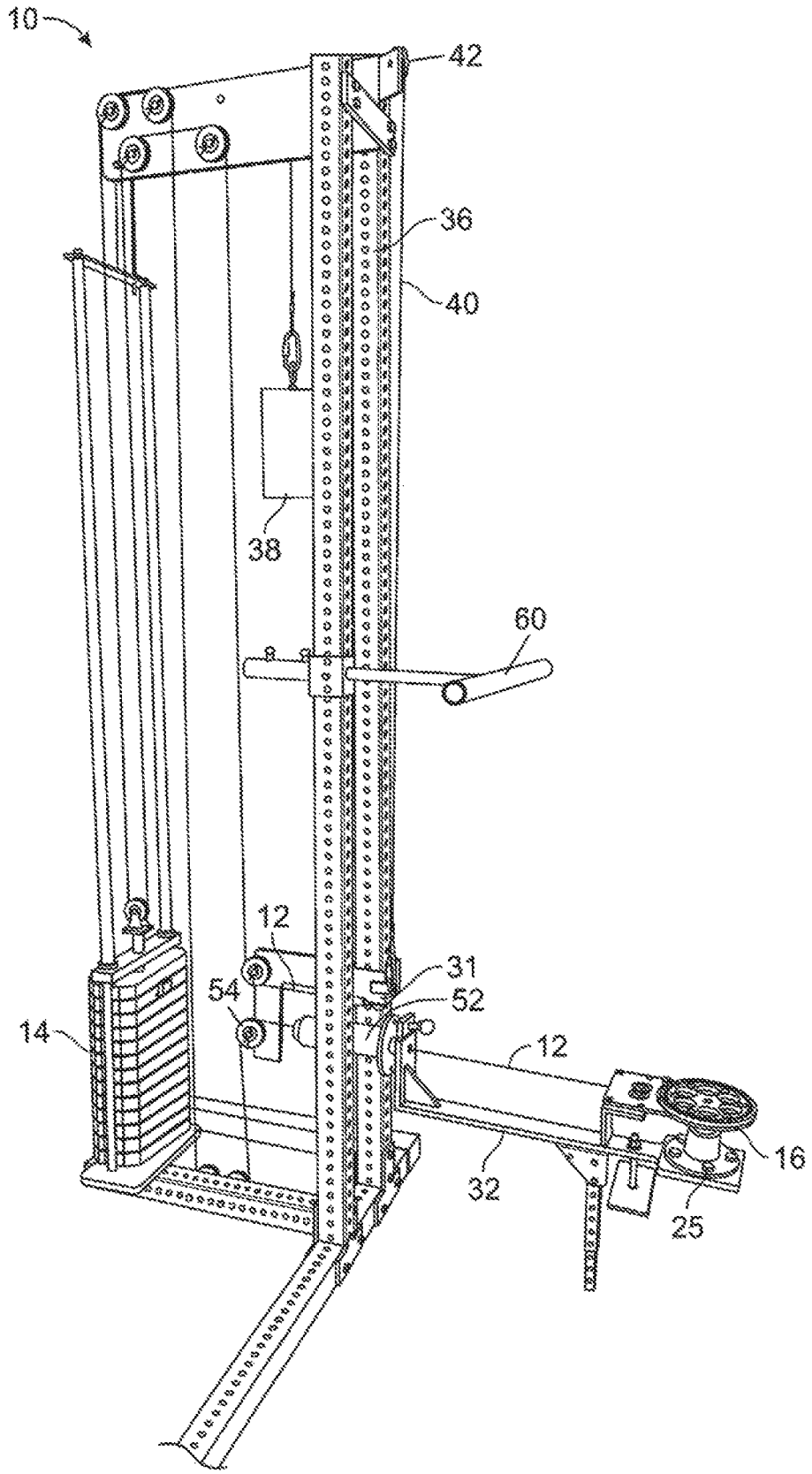
FIG. 1 is a perspective view of an embodiment of the present invention.

Embodiments of the present invention preferably allow the user to adjust the range of rotation that an exercise apparatus will encompass relative to the user. This allows users to strengthen their muscles more completely and increase range of motion. Embodiments of the present invention preferably allow users to adjust the height of an attachment point for various attachments. This allows people of differing heights to utilize the same machine after adjusting it to their height. Embodiments of the present invention allow the user to rotate the attachment point in a plane that is perpendicular to the plane of the force rotation of the attachment point, resulting in a downward, sideward, and upward plane for connecting the various attachments. Embodiments of the present invention allow the users to supinate, pronate, rotate, and/or twist the hand, wrist, forearm, elbow, upper arm, shoulder, neck, spine, lumbar, hip, upper leg, knee, lower leg, ankle, and/or foot, utilizing attachments, or no attachments while working that same motion against resistance force as low as zero pounds of force, in a bidirectional fashion. In addition, embodiments of the present invention provide versatile equipment that uses little space. As used throughout the specification and claims, the term "exercise" means exercise, physical therapy, body building, strengthening, toning, and the like.

Other embodiments of the present invention contain the resistance source, and mechanisms which translate the resistance source to the end user, within a housing. The housing being of a size and weight which can be transported by one person. The housing furthermore having the ability to be secured to a rigid structure commonly found within a home, such as a door frame, or countertop. The housing could optionally be mounted to a framework which holds the housing steady in space as a person exercises against the resistance. With the housing held stationary in space, the resistance force output can be manipulated without the entire housing moving. In one embodiment, a person can install an attachment onto the resistance force output. With the housing secured to a stationary object, and an attachment secured to the resistance force output, a person can then exercise in a rotational fashion against the rotational resistance. This type of relatively small, portable device applies to end users who have very limited space, and a very limited budget for such a device.

In one embodiment, a portable device, which offers rotational resistance to multiple attachments, can be mounted to a framework which can orient such a device in space at a variety of heights, as well as a variety of angles such as pointing the resistance force output towards the ground, or towards the sky, or towards an adjacent wall, or any point in between these points. A rotational exercise apparatus held within a housing, can gain resistance from multiple sources such as, but not limited to, a spring, a torsion spring, a flexible material, an electric motor, friction, pneumatics, or hydraulics. The resistance could be translated from the resistance source to the resistance force output by, for example, but not limited to, a cable, a rope, a flexible material, a direct attachment, or similar means, combinations thereof and the like. Many different attachments can be secured to such a portable device comprising a housing. Potential attachments include, but are not limited to, grips for the hand, platforms for the feet, clamps for the head, or other pads or handles which the user presses parts of their bodies against for exercising against the resistance provided by the apparatus. Certain embodiments of the portable rotational resistance exercise device have the resistance source output translate the linear force of the resistance source by means of a wheel. The wheel can offer rotational resistance in one direction or in two directions. The wheel can be configured in a number of ways. One embodiment of the wheel has a cable attached to the wheel, and when the wheel is turned by the attachment of the user's choice, the cable is wrapped around the wheel. The winding up of the cable causes a pull on the opposite end of the cable, the opposite end of the cable being attached to a resistance source.

A multi-function bidirectional rotational resistance force exercise apparatus can consume a large area while in use, as well as when it is stored while not in use. It is advantageous to have parts which move into a position for a smaller storage area of the unit as a whole. There is a need for a multi-function bidirectional rotational resistance force exercise apparatus which converts to a smaller storage size easily without many conversion steps. Current apparatuses require the user to disengage the locks on the resistance source, or weight stack, before being able to manipulate parts of the machine into storage settings. Embodiments of the present invention do not require the user to disengage the resistance source before folding a bidirectional rotational resistance force exercise apparatus into a storage position, thus saving time and effort. In one embodiment, the main arm of the apparatus can fold up or down to allow for multiple exercise positions, as well as allow for small storage place. Folding the arm without disconnecting the resistance source allows for the apparatus to be used in the folded positions, as well requiring one less step to perform when folding it for storage. Embodiments of the present invention allow for the vertical adjustment of the exercise apparatus to reach the lowest level of the frame, and/or reach the lowest level of floor.

A multi-function bidirectional rotational resistance force exercise apparatus can be oriented in such a way that a user may want to stand on a stationary platform while exercising. In order to keep such a platform from moving while exercising, it is advantageous to have such a stationary platform connectable to the apparatus. Connecting the platform to the apparatus causes it to be rigid and safer for the user. In one embodiment of the present invention, the stationary platform is adjustable in height. In another embodiment of the present invention, the stationary platform has rollers incorporated within it.

A multi-function bidirectional rotational resistance force exercise apparatus can be built to be a very sturdy piece of equipment. With the apparatus being sturdy enough to support the weight of a person, a user could place their body weight upon the apparatus in a number of ways. One of those ways to have the apparatus support the user's weight is to allow them to hang their weight on the apparatus by use of ropes, chains, cables, bands, straps, etc. Providing a location on the apparatus which is to be used for attaching ropes, chains, cables, bands, straps, etc., would be an added benefit for the end user. These training ropes, chains, cables, bands, straps, etc., are typically made of a suitable material such as cloth, metal, or polymer, etc., and require a smooth surface to mount them so as to not cause a tear in the material. In one embodiment, the user can then pull on the straps which are attached to an embodiment of a multi-function bidirectional rotational resistance force exercise apparatus in a way which does not damage the straps, but allows for the user to rely on the apparatus for securing the straps. Not just any location on the machine could be used for such attachment. A designated location and attachment feature are preferably provided to properly secure the items in a way which will not damage them, nor cause the apparatus to lose balance. Arbitrarily securing items to the apparatus for the purpose of suspending your body weight from the items could cause injury by having the apparatus tip over onto the user, or by causing the item to break because the securing point was not designed for such use. Designating a location for such attachment of items from which to hang body weight is a task for a trained professional to determine, design, test, and authorize. In one embodiment, the arm of the bidirectional rotational resistance force exercise apparatus has a feature incorporated upon it which is suitable for securing items from which a person could suspend their body weight. In another embodiment, the frame has a feature incorporated upon it which is suitable for securing items from which a person could suspend their body weight.

A multi-function bidirectional rotational resistance force exercise apparatus can be a stable enough piece of equipment that a user could use it for exercises such as pull-ups, or dips, if the apparatus had features which provided a handling location for such exercises. An articulating safety handle is necessary for this type of operation of such an apparatus. Designing the articulating safety handle in such a way that it provides a stable surface which can support the weight of the user in multiple positions will accomplish the tasks of pull-ups, dips, and standard safety performance. The articulating safety handle could also be used for a location a person could hold onto for stability while exercising. Such a location is preferably adjustable for varying heights of users, as well as being strong enough to support their weight in case they need to rely on the handle to prevent a fall. Embodiments of the articulating safety handle allow for the handle length to be extended or retracted.

A multi-function bidirectional rotational resistance force exercise apparatus may offer only one direction of rotational exercise. In one embodiment, a multi-function bidirectional resistance force exercise apparatus offers resistance in only the clockwise, or only the counterclockwise, direction.

A multi-function bidirectional rotational resistance force exercise apparatus may translate the linear force from the resistance source to the attachment of choice by different means. One embodiment comprises a wheel upon which the user attaches an attachment, and wraps up a cable which is connected to a resistance source. In another embodiment, the wheel, with an attachment attached to it, turns an electric motor which resists the user's exercise force in a rotational fashion. In yet another embodiment, the wheel is attached to a friction material that resists the user's rotational exercise force. In another embodiment, the user exercises against a rotational resistance source that is built in similar fashion to prior art. In another embodiment, a multi-function bidirectional rotational resistance force exercise apparatus changes the linear force of the elongation of a flexible material, into a rotational force by means of wrapping the flexible material around a wheel. In another embodiment, the rotational resistance is supplied by means of a force transferring material passing through a series of wheels and pulleys in order to translate linear force into rotational force.

Persons utilizing exercise equipment have a need for equipment that provides rotational resistance to press against. Some persons need the equipment to be simple for a person to use. Equipment that perform fewer functions is desirable for some facilities because it will be easier for their users to figure out how to operate the piece of equipment. A rotational resistance exercise apparatus can be constructed in a way such that the attachments that the user presses against are not interchangeable. In one embodiment, a rotational resistance source is movable positioned on a vertical frame. In another embodiment, a rotational resistance source is movable located on a frame which is not vertical.

A grip twist rotational resistance exercise apparatus provides a rotational resistance source for a person to strengthen their body against rotational resistance in either a clockwise, or counterclockwise direction, or both. In one embodiment, the axis of rotation of the rotational resistance is directed in a horizontal plane. When a person grips the handle and pronates or supinates their arm, the rotational resistance will resist their effort, and this resistance offers an exercise benefit to the user. In one embodiment, the position of the handle that a user grasps and rotates for exercise is set to a starting position. To choose a starting position, a user disconnects the grip from the resistance source, rotates it to a new position, then reconnects it to the resistance source prior to exercise. The resistance source can be chosen from for example, weight plates, spring, flexible material, electric motor, friction, pneumatic, hydraulic or other resistance source.

In one embodiment, a grip twist rotational resistance exercise apparatus adjusts vertically in height, has a standing platform that adjusts vertically in height, or both, which allows for users of differing height to use the same apparatus. The rotational resistance force output could be designed in a number of ways including, for example, a wheel drawing up a cable, or a wheel wrapping up a flexible material. In one embodiment, a grip a user grasps is directly perpendicular to the axis of rotation of the rotational resistance, or it can be off set. Placing the grip, which a user grasps, on an axis which does not intersect with the axis of rotation of the rotational resistance offers the opportunity to have the rotational resistance directed, for instance, down the center of the user's unbent wrist while they grasp the grip. This direction of orientation is beneficial for superior ergonomics of exercise. In one embodiment, the handle connected to the rotational resistance is a flat surface. In another embodiment, the handle connected to the rotational resistance is in the shape of a sphere.

Exercise equipment users have a need for equipment that offers rotational resistance for the spine, hips, knees, ankles, and feet. Standing on a platform that is attached to a rotational resistance source, while grasping a stationary object with other parts of their body, allows a person to rotate the platform for exercise. In one embodiment, the standing platform attachment is connected to a rotational resistance source. The user engages certain muscles in order to rotate the standing platform they are standing on. The rotational resistance works against the person causing them to gain an exercise benefit. A person can stand on the platform with one foot, while standing on a nearby stationary platform with their other foot. The user would then rotate their one leg against the rotational resistance for exercise, while the leg standing on the stationary platform offers stability. In one embodiment, a stationary handle is nearby for the user to grasp for stationary stability. In one embodiment, the rotational resistance is offered by an electric motor. In another embodiment, the rotational resistance is provided by a curved shaped material which is connected to a resistance source such as a spring with a cable, the cable being wound up by the curved shaped material that is being turned by the standing platform, which is turned by the user's effort. In one embodiment, the standing platform itself has the resistance source connected directly to its periphery. In one embodiment, the standing platform is generally flat. In another embodiment, the standing platform has at least one surface that is free to spin independently from the rotational resistance source.

A person's hip joint can move in many directions. Flexion, extension, abduction, adduction, internal rotation, external rotation, and circumduction. The neck of the femur bone sits at approximately 120-135 degrees inclination relative to the femur bone in a normal adult, and at very different degrees of inclination in abnormal persons. Exercising the hip joint in a flexion or extension pattern is a common activity. Most common positions for such exercises are done with a person standing straight up, while lifting their knee upwards towards the chest, or pressing their knee back down from their chest to a standing position. Lifting the knee proximally and laterally simultaneously, as well as the converse motion, helps keep the femur head within its socket. Keeping the femur head within its socket can be beneficial to the person performing the exercise. An exercise apparatus that offers rotational resistance to a user in a direction that allows their femur head to stay within its socket while performing exercise offers benefit to the user. The exercise apparatus would be more useful to many persons if it can accommodate users of differing height, and/or strength. In one embodiment, the center of rotation of the rotational resistance is at an angle coincident with the user's femur neck. One embodiment provides an adjustable standing platform for a person to stand upon, the platform being adjustable in height. One embodiment provides a platform for a person to lay upon while performing exercise.

A person's leg can move in an internal and external rotation pattern. Moving the leg in an internal or external rotational pattern against resistance can be beneficial to a user. A rotational resistance exercise apparatus that provides resistance for a person to exercise against in the pattern of internal and/or external rotation of the leg is useful in strengthening the user's body. In order to focus the exercise effort more onto the muscles near the hip, as opposed to muscles near the ankle, in the motion of internal and external rotation of the leg, a person's leg could be in a flexion position while internally or externally rotating their leg. One embodiment of the present invention provides rotational resistance to a person whose leg is in a flexion position while internally or externally rotating. Other embodiments of the present invention have the ability to accommodate persons of differing heights by extending the exercise surface which the person presses upon closer to the person's body, and/or by changing the altitude of the surface upon which they are standing. In one embodiment the user can place the axis of rotation of their femur closely to coincidental to the axis of rotation of the rotational resistance, then rotate their femur around its axis of rotation for exercise against the resistance.

A person's shoulder joint is very complex. Exercising the shoulder joint against resistance can be done in a variety of ways. When a person performs the motion of flexion, extension, abduction, or adduction of the shoulder, a circular motion of the arm, hinging at the shoulder joint is performed. A rotational resistance exercise apparatus that provides the user a surface to press upon with a part of their upper limb will give the user the opportunity to perform resistance exercise in a rotational pattern. The circular motion would be best resisted by an apparatus that provides rotational resistance, as opposed to linear resistance. One embodiment of the present invention preferably allows a user to press their forearm against a pad while performing shoulder flexion, extension, abduction, or adduction motions. Another embodiment of the present invention adjusts to accommodate persons of differing heights. Another embodiment of the present invention directs the axis of rotation of the rotational resistance at an angle that is preferable to exercise muscles against rotational resistance. Another embodiment of the present invention allows the user to grasp a handle with one and/or two hands while exercising against rotational resistance. The handle of one embodiment of the present invention rotates independently of the rotational resistance offered by the apparatus. In one embodiment, the starting and/or stopping position of the rotational resistance can be adjusted.

Performing a motion similar to stirring a pot of substance with a tool, has been a desirable motion to perform for exercise. Performing motions against resistance is beneficial for a person's body. The present invention embodies a rotational resistance exercise apparatus that provides rotational resistance to a person who is moving their body in a motion similar to that of stirring a pot. One embodiment of the present invention has a handle a person grasps with their hand. The handle is then moved in a circular motion by the person's body, while the apparatus provides rotational resistance to the person's effort. In one embodiment, the handle is free to rotate on its own axis, which is independent of the axis of rotation of the rotational resistance of the apparatus. In one embodiment, the apparatus adjusts in order to accommodate users of differing heights. In another embodiment, the handle that the user grasps with their hand is adjustable in position relative to the axis of rotation of the rotational resistance. The handle could be positioned further away from or nearer to the axis of rotation of the rotational resistance. In one embodiment, the handle is oriented perpendicular to the axis of the rotational resistance. In one embodiment, the axis of rotation of the rotational resistance is parallel to the axis of rotation of the grip. In another embodiment, the grip has an axis of rotation that is not parallel nor perpendicular with the axis of rotation of the rotational resistance.

Rotating the body against rotational resistance from a standing position can help a user gain strength. An exercise apparatus that provides rotational resistance which a person can exercise against while rotating their spine to the left and/or to the right would be beneficial to the user. Embodiments of the present invention provide a handle that a user can press against with their body while exercising their spine in a rotational motion. Embodiments of the present invention adjust for users of differing heights. In addition, embodiments of the present invention position the axis of rotation of the rotational resistance in a vertical position. Other embodiments of the present invention have the axis of rotation of the rotational resistance in a non-vertical position. Embodiments of the present invention have the option to position the handle in a variety of distances from the axis of rotation of the rotational resistance. With the axis of rotation of the rotational resistance being in a position that is non-vertical, a person's spine would be allowed to combine rotational motion with a flexion motion resulting in a different exercise benefit.

The shoulder rotator cuff has long been an area of weakness and injury for the human body. Rotational resistance offers a more beneficial resistance source to exercise the rotator cuff against than linear resistance. Having the ability to supinate or pronate your hand independently while performing internal and external rotations of the shoulder provides a more complete exercise. In one embodiment, a grip is free to spin on an axis that is perpendicular from the grip. In another embodiment, the grip is adjustable in distance from the axis of the rotational resistance to accommodate different users' arm lengths. In another embodiment, the height of the rotational resistance is adjustable. In another embodiment, the platform a user stands on is adjustable for people of different heights.

A rotational exercise apparatus has an axis of rotation of the resistance. In order for a user to rotate rotational resistance, they need a surface upon which to press a part of their body. In one embodiment, the surface that receives the pressure from the user is a cylindrical shaped surface that has an axis of rotation. The axis of rotation of the cylindrical shaped surface, and the axis of rotation of the rotational resistance can be parallel. In one embodiment, the axis of rotation of the cylindrical surface a person presses against for exercise, and the axis of the rotational resistance are adjustable in distance from one another.

A rotational resistance exercise apparatus resists the rotation of a person's head. A person's head has an axis of rotation about which the head can turn left and right. In one embodiment of the present invention, a person's rotation of their head is translated to interact against the rotational resistance of the rotational exercise apparatus by means of a head attachment. In one embodiment, the head attachment secures against the exterior of a person's head, while also being secured to the rotational resistance of the rotational exercise apparatus. In one embodiment, the head attachment is adjustable to fit different sizes of heads.

Circumduction of a person's arm is accomplished by moving a straight or bent arm in a circular motion. Resistance to circumduction motion will enhance a person's strength in their body. The present invention of a rotational resistance exercise apparatus for circumduction offers rotational resistance to the circular motion of circumduction. In one embodiment, a flexible rope is attached to a member that is attached to the rotational resistance offered by the apparatus. Moving the rope in a circular pattern causes the member to move against the resistance of the apparatus, thus giving the person exercise. In another embodiment, the distance from the handle a person is holding, which is attached to the member, which is attached to the rotational resistance, is adjustable in distance from the axis of rotation of the rotational resistance. In another embodiment, the elevation of the axis of rotational resistance is adjustable in elevation to accommodate users of different heights. In yet another embodiment, the platform a user stands upon is adjustable in height. In one embodiment, the axis of rotation of the rotational resistance is horizontally oriented.

Resistance training of leg circumduction is best performed against rotational resistance. The circular path a person's leg follows when performing circumduction is best exercised against resistance that follows the same general path. In one embodiment of the current invention, a person places one foot upon a surface, and the surface is connected to a rotational resistance source in such a way that when the surface is moved in a circular path, the rotational resistance source counteracts the user's efforts in a rotational direction. In one embodiment, the rotational resistance apparatus has a platform a user can place their other foot that is not performing the circumduction exercise. In another embodiment, the surface a user places their foot upon is free to spin independent of the rotational resistance.

The swinging of a golf club follows a mostly circular path. Exercising a golf swing against rotational resistance would be beneficial to strengthening the body. In one embodiment of the present invention, a person interacts against the rotational resistance exercise apparatus by moving the rotational resistance around a circular path while holding and moving a handle in the similar motion of swinging a golf club. In one embodiment, the axis of rotation of the rotational resistance is directed in generally the same direction as a person's spine axis of rotation while swinging a golf club. In one embodiment, the handle a person holds is partially cylindrical handle. In another embodiment, the partially cylindrical handle is attached to a rope. In yet another embodiment the rope is attached to an arm that is attached to the rotational resistance. In one embodiment, the distance from the rope attachment point and the axis of rotation of the rotational resistance is adjustable. In one embodiment, the altitude of the axis of rotation of the rotational resistance is adjustable. In another embodiment, the surface upon which a user stands is adjustable in altitude.

A generic handle can be attached to a rotational resistance exercise apparatus for accommodating exercise motions of a person. In one embodiment, a rotational resistance exercise apparatus has an attachment extension extending from the rotational resistance in a direction perpendicular to the axis of rotation. The attachment extension optionally has a bend in it. Upon the attachment extension, a person optionally attaches a generic attaching point attachment. In one embodiment, the attachment of a handle is accomplished by securing a carabiner onto the generic attaching point attachment. A person optionally secures a handle of choice onto the carabiner. When rotating the attachment extension by means of attached handle, a person gains exercise by working against the rotational resistance provided by the apparatus. In yet another embodiment, the arm that is attached to the rotational resistance extends in the direction of the axis of rotation of the rotational resistance. The extension of the arm allows the user more distance from the moving parts of the apparatus. In one embodiment the distance from the end of the arm, and the axis of rotational resistance is adjustable.

A person's foot moves in a circular path when riding a bicycle. Bicycles offer resistance in one direction only. A person does not get the benefit of eccentric loading of their leg muscles when riding a bicycle. A rotational resistance exercise apparatus has the potential to offer eccentric loading of the muscles when a person's leg or arm is performing generally the same motion as that of rotating a common bicycle crank. In one embodiment, a rotational resistance exercise apparatus has one or more arms attached to the rotational resistance in a position perpendicular, or approximately perpendicular to the axis of rotation of the rotational resistance. In one embodiment, a bicycle pedal or a handle is attached upon the arm or arms. A person can press upon the bicycle pedal with their foot or hand in order to rotate their foot or hand against the rotational resistance of the exercise apparatus. In one embodiment, the rotational resistance is provided by a cable attached to the rotational resistance on one end and to linear resistance on the other end, such as a weight stack. In another embodiment, the arm has multiple positions the pedal or handle could be placed. In one embodiment, the axis of rotation of the rotational resistance is horizontal. In another embodiment, the arm has threaded holes.

Multi-function rotational resistance exercise apparatuses, rotational resistance apparatuses within a housing, and rotational resistance exercise apparatuses can have attachments that are attached to them. These attachments are the surface upon which a person presses for exercise of their body. In one embodiment, an attachment is for the exercising of the supination and pronation of the hand. In another embodiment, an attachment provides a location or a series of locations for attaching yet another attachment. Another embodiment of the invention comprises an attachment that is a grip that is optionally able to spin freely upon an axis of rotation that is perpendicular to the axis of rotation of the rotational resistance of the apparatus. Another embodiment is an attachment to a rotational resistance exercise apparatus that is a grip which is optionally free to spin on an axis, which is parallel to the axis of rotation of the rotational resistance. Embodiments of the present invention allow the user to attach a pad to a rotational resistance exercise apparatus that is optionally free to spin on an axis which is parallel to the axis or rotation of the rotational resistance. Embodiments of the present invention allow the user to attach a dome to a rotational resistance exercise apparatus that is optionally free to spin on an axis which is parallel to the axis of rotation of the rotational resistance. Embodiments of the present invention allow the user to attach a shaped surface to a rotational resistance exercise apparatus which is optionally free to spin on an axis that is parallel to the axis of rotation of the rotational resistance. Embodiments of the present invention allow the user to attach a knob to a rotational resistance exercise apparatus that is optionally free to spin on an axis which is parallel to the axis of rotation of the rotational resistance. Embodiments of the present invention comprise a grip, pad, dome, knob, or concave dish attachment which is free to spin on an axis of rotation which is parallel, perpendicular, or any other angle in relation to the axis of rotation of the rotational resistance.

Embodiments of the present invention comprise a rotational resistance assembly which is rotational resistance. Embodiments of the present invention allow the user to attach an articulating joint to a rotational resistance exercise apparatus which is optionally free to spin on an axis which is parallel to the axis of rotation of the rotational resistance. An attachment for a rotational resistance exercise apparatus embodies a device which secures onto a person's head such that when a person rotates their head, the device is rotated, and optionally when the device is rotated and attached to a rotational resistance exercise apparatus, the person can rotate their head against the resistance provided by the apparatus.

Embodiments of the present invention comprise a knee cradle. The knee cradle optionally provides a surface upon which a person can rest their flexed leg. Optionally the knee cradle is attached to the rotational resistance provided by an exercise apparatus. In one embodiment, the axis of rotation of the exercise apparatus is aligned nearly to the axis of rotation of a person's femur. Embodiments of the present invention allow for a general attaching point to have a plurality of constructions including a location to secure a carabiner, a hook, a peg, a ring, etc. Embodiments of the present invention have the general attaching point adjustable in distance from the attachment extension. The way people exercise this same motion but with inferior equipment is typically by attaching one end of a band or cable around their ankle and the other end to a wall or weight stack. Then they will stand on the one leg without the band or cable, and bend the other leg (that is attached to the band or cable) 90 degrees at the knee. They will then pull on the cable or band with their ankle by rotating their femur internally or externally. The cable or band only gives linear resistance in one direction. In addition, when a band or cable is used to exercise in a rotational fashion, the user will experience varying levels of torque from the cable or band; these varying levels of torque will depend on what angle the cable or band is at any given point in the motion in relation to the axis of rotation of their exercise motion. In contrast, the knee cradle attached to a rotational resistance exercise apparatus of the present invention provides resistance in a circular path which is the path a person is moving their femur when internally or externally rotating it. The resistance felt by the person using a knee cradle attachment will be constantly and evenly resisting their internal and external rotation in an opposite direction. The force offered by the rotational resistance exercise apparatus gives a constant torque force that the user can exercise against with the constant torque force of their internal or external rotation of their limb. When using a linear force to exercise a motion that is circular, for instance internal or external rotation of the leg, the moment arm as defined in physics will be changing constantly because force of the linear resistance is not always directed at an angle which is entirely perpendicular to the moment arm. With a rotational resistance exercise apparatus, the moment arm is always perpendicular to the force of the rotational resistance exercise apparatus. Preferably a part of a person's body will be parallel to the moment arm of an attachment, and the person's different body part will be coincidental to the axis of rotation of a rotational resistance exercise apparatus, and a person's joint which connects these two body parts will be positioned at the intersection of the axis of rotation of a rotational resistance exercise apparatus and the body part that is parallel to the moment arm of an attachment.

Embodiments of the present invention provide a user with the ability to perform the motion of pedaling a bicycle with one or two legs or arms against rotational resistance of an exercise apparatus. The rotational resistance of the exercise apparatus counteracts the rotational force generated by a user. Embodiments of the invention provide multiple locations which a person could attach a pedal or grip to a crank or arm that is attached to the rotational resistance. In one embodiment, the rotational resistance is derived from a weight stack, connectable by a cable.

Throwing a ball with a person's arm generally is done by the person moving their arm in a mostly circular path. Exercising a person's body in a similar motion to that of throwing a ball is beneficial to the body. In one embodiment of the invention, a ball has a strap attached to it, and optionally the other end of the strap is attached to an armature that is attached to a rotational resistance exercise apparatus. In another embodiment, the distance from the ball and the axis of rotation of the rotational resistance exercise apparatus is adjustable. In another embodiment, a shaft shaped handle is used in place of the ball. In another embodiment, the axis of rotation of the rotational resistance exercise apparatus is adjustable in direction it is pointed towards.

Embodiments of the present invention allow the user to stand on an attachment which is a surface that is connected to the rotational resistance. When a person rotates their body, the surface they are standing on will resist their body's rotation.

Embodiments of the invention comprise an attachment extension that serves as an intermediary between the rotational resistance, and an attachment of choice. In one embodiment, the attachment extension accommodates an attachment extension counterweight. In another embodiment, a rotation resistance interface is coupled to the rotational resistance and allows for the attaching of other attachments. In one embodiment, the attachment extension and the attachment are permanently mounted. In another embodiment, the attachment extension is permanently mounted to the rotational resistance source.

In one embodiment of the present invention, an attachment to a rotational resistance exercise apparatus is shaped like a wheel. The attachment preferably has an axis of rotation. When the attachment's axis of rotation is placed coincidental with and secured to the axis of rotation of the rotational resistance exercise apparatus, a person can exercise against the resistance of the apparatus by turning the wheel. In one embodiment, the wheel height can be adjusted in altitude. In another embodiment, the axis of rotation of the exercise apparatus can be adjusted.

Embodiments of the present invention provide for the axis of rotation of the rotational resistance to be held at an angle which is vertical, horizontal, or any angle in between vertical and horizontal.

Embodiments of the invention allow for a carriage that has a rotational resistance rotatable mounted upon a carriage, wherein the carriage is movable along the frame, and the frame is set at an angle of choice.

Embodiments of the present invention have a platform which a user stands upon, and the platform is adjustable in height.

Embodiments of the present invention comprise a paddle rotation attachment which a person can press against with their body for exercise.

Embodiments of the present invention comprise an attachment permanently mounted to an attachment extension. Embodiments of the present invention comprise an attachment extension permanently mounted to the rotational resistance.

Therapists, trainers, and end users have a need for an attachment for a rotational resistance device that has a perpendicular free spinning grip, and whose center of rotation is perpendicular to the center of rotation of the rotational resistance. This perpendicular free spinning grip will allow the user's wrist to rotate freely, and independently from the rotational resistance offered by the device. This will allow for greater muscle activation.

A parallel free spin grip attachment is designed for a multi-function rotational resistance exercise apparatus which is free to spin on an axis which is independent from the axis of rotation of the rotational resistance. The attachment preferably has an axle positioned with axis of rotation directed in the same direction, though not coincidental, with the resistance source axis of rotation. In one embodiment, a post is covered in a pad, grip, bearing, or a flat or domed shaped plate. The covering over the post will provide comfort, safety, and a surface upon which the user can exert exercising force against the apparatus. Between the pad, grip, plate, or dome and the post, it would be beneficial to have a type of bearing, or surface which allows the pad, grip, plate or dome to spin freely around the tangent of the post. Such parallel free spinning of the grip, plate, pad, or dome allows the user to have a much more dynamic exercise as compared to a post which does not spin freely.

A resistance output shaft, an attachment extension port, an attachment location, a resistance output, an attachment connecting point, a rotational resistance output, and a protrusion can optionally be used interchangeably.

The different embodiments can optionally be combined in such a way as to work against the resistance offered by the other embodiments of the invention.

A rotational resistance assembly, a rotational resistance with friction, a rotational resistance exercise apparatus, a multi-function rotational resistance exercise apparatus, a system, and an exercise apparatus can optionally be used interchangeably.

An attachment, a connectable handle, and many other types of attachments described herein can optionally be used interchangeably or in combination with one another or in combination with other embodiments to create multiple different embodiments which are useful for exercising.

In the following detailed description, numerous specific details are set forth in order to provide a thorough understanding of the embodiments of the invention. However, upon studying this application, it will be understood by one of ordinary skill in the art that the embodiments may be practiced without these specific details. For instance, well known operation or techniques may not be shown in detail. Technical and scientific terms used in this description have the same meaning as commonly understood to one of ordinary skill in the art to which this subject matter belongs.

As used throughout this specification and claims the term "rotate" means to turn around a center of rotation in a clockwise, or counterclockwise motion. As used throughout this specification and claims the term "rotating element" means a component to which a force transmitting material is connected to, for example, be wrapped around to provide rotational resistance, and comprises, for example, a circular, elliptical, rectangular, triangular, or the like, shape. As used throughout this specification and claims, the term "force transmitting material" means a component by which force is exerted to provide resistance, including, but not limited to, a cable, rope, chain, belt, rubber band, and the like. Similarly, as used throughout this specification and claims the term "rotational" means to rotate as in, for example, moving in a circular manner, etc. As used throughout this specification and claims, the term "pronation" means to rotate towards the center of the front of the body, while the term "supination" means to rotate away from the center of the front of the body.

Working muscles against resistance in a rotational motion improves the stability of the body part being exercised. The improvements in strength are accompanied by a better understanding of the body, and its range of motion. This new understanding of the body, allows the user of embodiments of the present invention to become more stable and stronger overall. Rehabilitation, injury prevention, and overall strength of certain body parts can be accomplished very quickly when rotational resistance such as the one provided by embodiments of the present invention is utilized as part of an exercise routine.

Generally, rotational motions of the body occur when naturally moving the body while, e.g., walking, running, biking, swimming, throwing, jumping, using tools, and many other motions routinely performed by the body. Strengthening the rotational aspects of the body makes a person's body stronger overall and helps to heal or prevent injuries.

Furthermore, most users of exercise equipment have a limit in the amount of space they can allot to be used by one piece of equipment. A piece of exercise equipment that has multiple functions built into one unit saves real estate space to be used for another purpose.

In one embodiment, a bidirectional force is created by changing the direction of an initially linear force. This is accomplished by changing the linear direction of the original force, for example, a force transferred by a cable, into a force acting upon the tangent of a circumference. When the force acts upon the tangent of the circumference, it gives the user a force to counteract in a rotational fashion. There is no need, in the embodiments of the present invention, for the user to support the perpendicular forces of the exercise motion; the user needs only to rotate around the centerline to counteract the bidirectional opposing force.

In a different embodiment, bidirectional rotational resistance is accomplished through, for example, braking systems, friction, magnetic devices, electric devices, springs, stretching a flexible material, hydraulic devices, pneumatic devices, and the like.

The bidirectional opposing force offered by the various embodiments of the present invention allows the user to exercise clockwise and counterclockwise movements as needed for the various attachments. The bidirectional feature of the present invention is beneficial to the user due to the fact that the body parts rotate in both directions, and those rotations are made possible through muscles which will benefit from resistance exercise.

Embodiments of the present invention have attachments permanently secured to attachment extensions.

In different embodiments of the present invention attachment extensions are permanently attached to the rotational resistance assembly.

In other embodiments of the invention, when the rotational resistance assembly is rotated, a force transferring material such as a cable is wrapped around the periphery of the rotational resistance assembly, and the cable is pulled in an opposite direction by a resistance source such as a weight stack.

Another embodiment of a direct carriage assembly optionally embodies a direct carriage with rollers attached to it. Optionally the rollers contain a frame within the direct carriage, the frame being optionally connectable to another frame. The direct carriage assembly preferably able to be rolled along the frame. Optionally direct carriage has a rotational resistance assembly attached to it.

In one embodiment, the direct carriage assembly moves horizontally along a frame. In another embodiment a direct carriage assembly moves vertically along a frame. In yet another embodiment, a direct carriage assembly moves at an angle along the frame other than horizontally or vertically.

Figure 2:
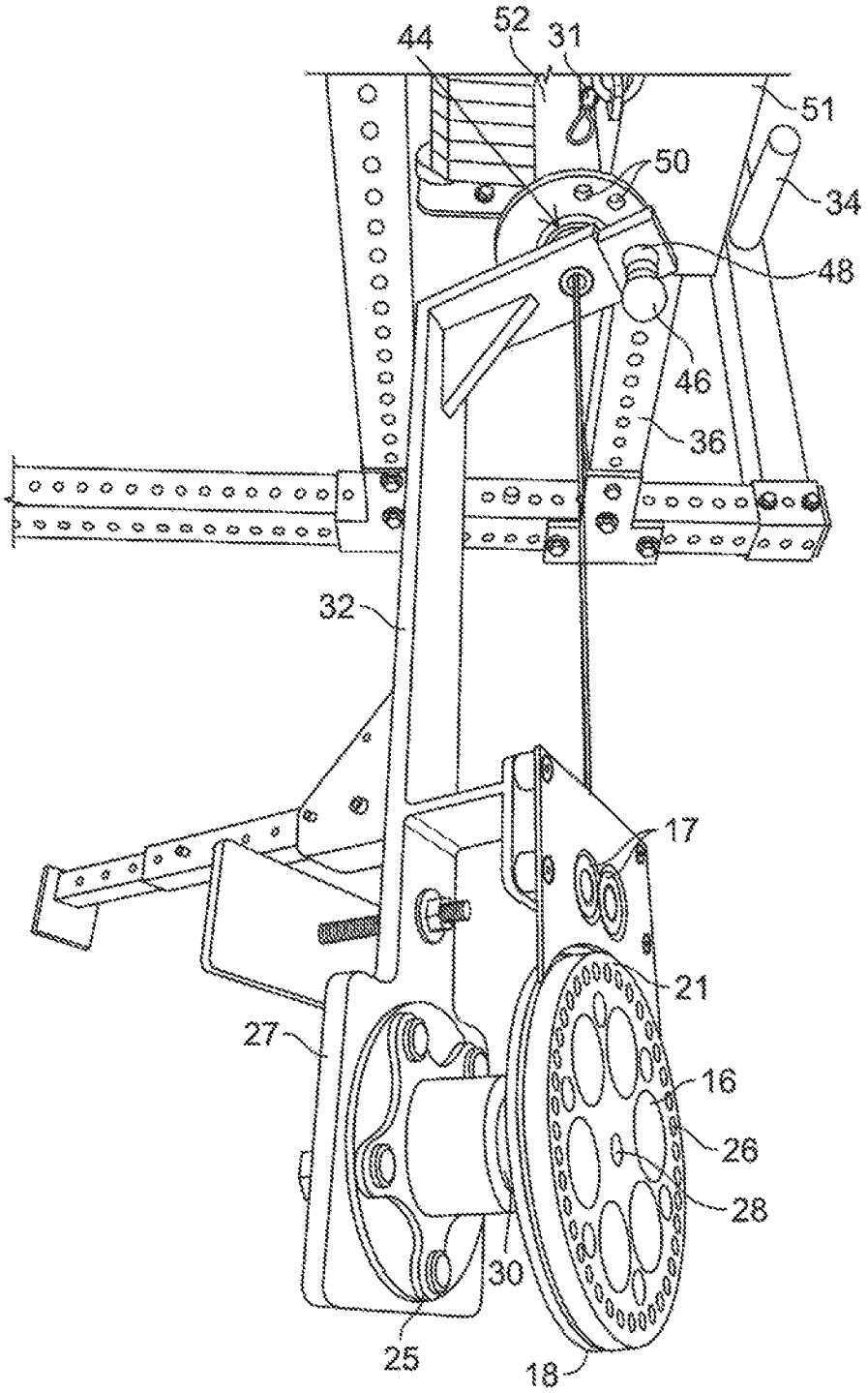
FIG. 2 is a closer view of the adjustable wheel platform arm of the embodiment of FIG. 1.
Figure 3:
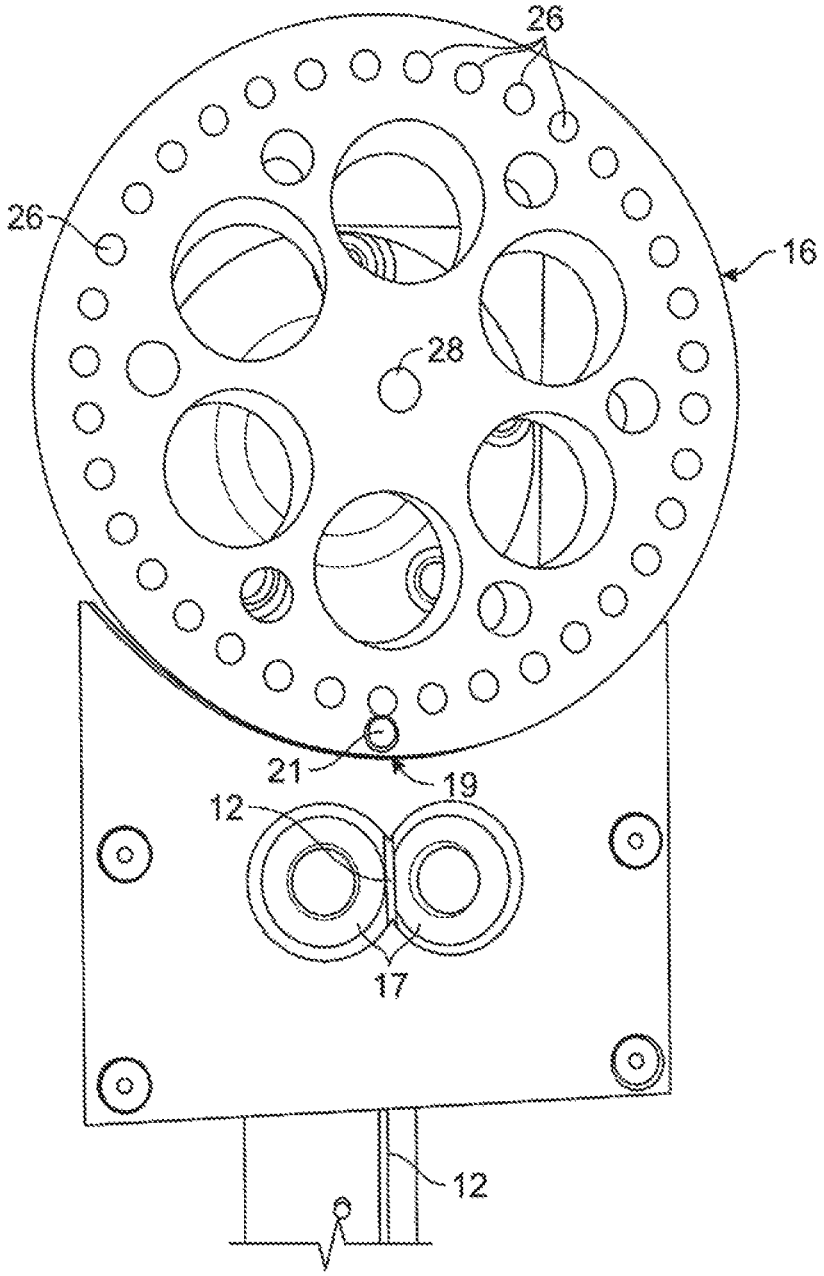
FIG. 3 is a top view of the wheel of the embodiment of FIG. 1.

Referring to FIGS. 1-3, in one embodiment, exercise apparatus 10 comprises original linear force X preferably with a linear direction and preferably being transferred by a force transferring material, such as cable 12. Cable 12 is preferably connected to weights 14 at one end and to wheel 16 at its opposite end. In one embodiment, wheel 16 has a circular shape and comprises groove 18 on its periphery to accommodate cable 12 when turned in either a clockwise or a counterclockwise direction. Optionally, wheel 16 comprises a shape other than circular, for example, elliptical. In one embodiment, a mechanism is provided to guide cable 12 as it wraps around wheel 16, for example, pulleys 17 are preferably disposed on either side of cable 12 relatively near wheel 16 (e.g., most preferably between approximately 0.25 inches and approximately 6 inches), to guide cable 12 into groove 18, thus maximizing transition of force from cable 12 to wheel 16. Preferably, wheel 16 is mounted onto moving axle 20 preferably comprising, for example, bearings (not shown). Preferably wheel 16 is connected to axle 20, e.g., welded, bolted, etc. In one embodiment, axle 20 inserts into hub 25, and nut 27 is then placed on an end opposite to the end where wheel 16 is disposed. Preferably cable 12 is attached to wheel 16 by placing cable ball 21 into cable receiver 19. Bi-directional motions which act upon cable 12 in a motion, which lifts weights 14, are commenced by the user spinning wheel 16, alone, or optionally with an attachment.

In one embodiment, attachments for various exercises are preferably secured onto wheel 16 through, for example, one or more easy insertion/release pins, which optionally pass through center perforation 28, on wheel 16, and/or optionally pass through off-center perforations 26. The face of wheel 16 is preferably a substantially flat plane surface of wheel 16, through which easy insertion/release pins pass in a perpendicular plane of motion. Quick release of the attachments allows the user to quickly change the optional attachments if so desired, thus saving time. In one embodiment, an attachment extension port plug (not shown) could optionally insert into the center perforation 28, which comprises teeth to grasp the attachment extension port plug and translate the rotational force of the attachment extension port plug to wheel 16 and cause it to rotate.

In one embodiment, a free end of the force transferring material is made available to the user, with for example, cable attachment 31, in order to provide an attachment point for several different pre-existing attachments. This provides an optional value-added feature. This attachment point offers the user linear force resistance to use to strengthen the body in a linear fashion.

Embodiments for attachments for wheel 16, for instance, a grip handle, are unique from existing similar inventions in the way that they align the center of rotation of, for example, the user's wrist with the center of rotation of the opposing force. Competing devices force the user to move the centerline of their wrist rotation off of the center line of rotation of the opposing force, thus forcing the user to experience a movement which is not naturally aligning with their body.

In a preferred embodiment, exercise apparatus 10 preferably comprises adjustable wheel platform arm 32. Preferably the position of wheel platform arm 32 can be adjusted vertically to various heights to accommodate different users. For example, a user can release lock 34, which preferably holds wheel platform arm 32 in place on center post 36 and raise or lower wheel platform arm 32 to a desired height position. Optionally, counterweight 38 will assist the user in lifting or lowering wheel platform arm 32 which is preferably connected to counterweight cable 40. Preferably counterweight cable 40 is guided through pulleys 42 in order to change the downward force of the gravitational force acting upon counterweight 38, into an upward force acting upon wheel platform arm 32. Preferably friction reduction materials (not shown), such as rollers, brushing, bearings, and the like, are placed between wheel platform arm 32 and center post 36 in housing 51.

Preferably, a user can adjust wheel platform arm 32 to multiple horizontal positions which allow use of various attachments for different exercise routines. For example, the user can insert easy insertion/release pin 46 through wheel platform arm pin hole 48, and through a degree selection hole 50. Preferably friction reduction materials (not shown), such as bearings, rollers, and the like, are placed between wheel platform arm 32, and center post 36. Easy rotation of wheel platform arm 32 is made possible with friction reduction material 44 placed between wheel platform arm 32 and friction material housing 52. Preferably cable 12 follows the center of rotation of wheel platform arm 32, as wheel platform arm 32 is rotated to user's selection of degree selection holes 50. Preferably the first pulley 54 guides cable 12 in a direct path to cable receiver 19, optionally the path is also the center of rotation of wheel platform arm 32. Preferably support handle 60 is disposed on or near center post 36 or other post of the apparatus, and is adjustable to move in/out and up/down or be folded out of the way while remaining attached to the apparatus. Alternatively, support handle 60 is detachable. When easy insertion/release pin 46 is released, a user can rotate wheel platform arm 32 around the center of rotation, which is coincidental with cable 12. The resulting new position of wheel platform arm 32 will change the orientation of center of rotation of wheel 16, for example the wheel could face upwards towards the sky, or downwards towards the earth, or any position in between. These various orientations of wheel 16 allow a user to change the angle of wheel 16 center of rotation to a position that will help them exercise a particular part of the body more effectively with the use of various attachments.

Figure 4:
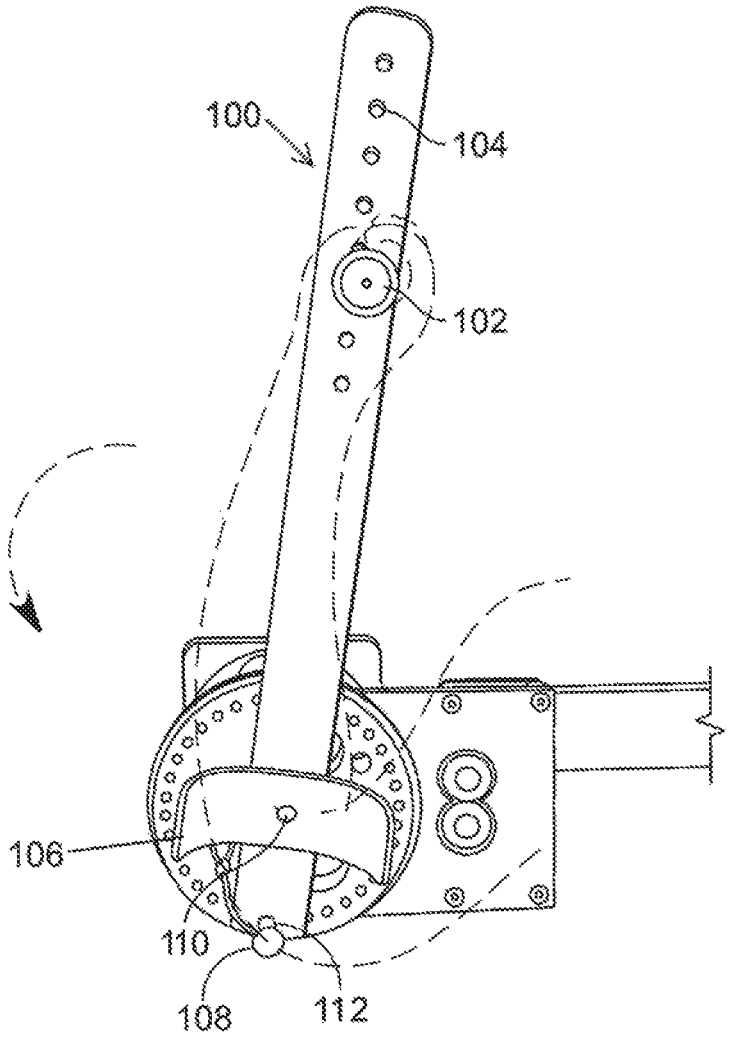
FIG. 4 is a perspective view of an embodiment of an elbow cradle attachment.

Referring to FIG. 4, in one embodiment, shoulder rotation exercises are accomplished by utilizing elbow cradle attachment 100, which is more effective than current exercise equipment when used to strengthen the shoulder joint and muscles in a supination, and/or pronation, and/or rotation, and/or flexion, and/or extension motion. In this embodiment, the counteracting force preferably directly opposes the user's supination and pronation forces without any other forces interfering. The user preferably positions the arm in such a way that the supination and pronation of the shoulder is isolated, and exercised when moving through the selected range of motion. Preferably, elbow cradle attachment 100 comprises elbow cradle handle 102, handle mount selection holes 104, elbow positioning bumpers 106, easy insertion/release pin 108, and range of motion pin position hole 112. In one embodiment, easy insertion/release pin 108 is affixed to elbow cradle attachment 100. In a different embodiment, elbow cradle attachment 100 further comprises easy center pin positioning hole 110 through which another easy insertion/release pin (not shown) passes to be inserted into center perforation 28 (not shown). Preferably the user will change position of elbow cradle handle 102 by, for example, unscrewing it from threaded handle mount selection hole 104 and, for example, screwing it into the desired threaded handle mount selection hole 104. Preferably elbow positioning bumpers 106 keep the user's elbow in the position of directly over the center of rotation of wheel 16. Preferably the user can utilize elbow cradle attachment 100 with wheel 16 oriented in a vertical or horizontal plane relative to the wheel face. With wheel 16 orientated to a preferable height, and center of rotation of wheel 16 set at a preferable angle by rotating wheel platform arm 32, and elbow cradle attachment 100 secured to the wheel 16 in a particular position, a person preferably grasps elbow cradle handle 102 with their hand, then places their elbow over center pin position hole 110, then stands their body in a preferred position relative to the center of rotation of wheel 16, then exercises against the resistance of the apparatus by moving elbow cradle handle 102 around the center of rotation of wheel 16. Depending on the user's choice of position of their own body, and the different adjustable mechanisms of the apparatus 10, a user could exercise in an arm flexion or extension motion, or a shoulder internal or external rotation motion, or other motions.

Figure 5:
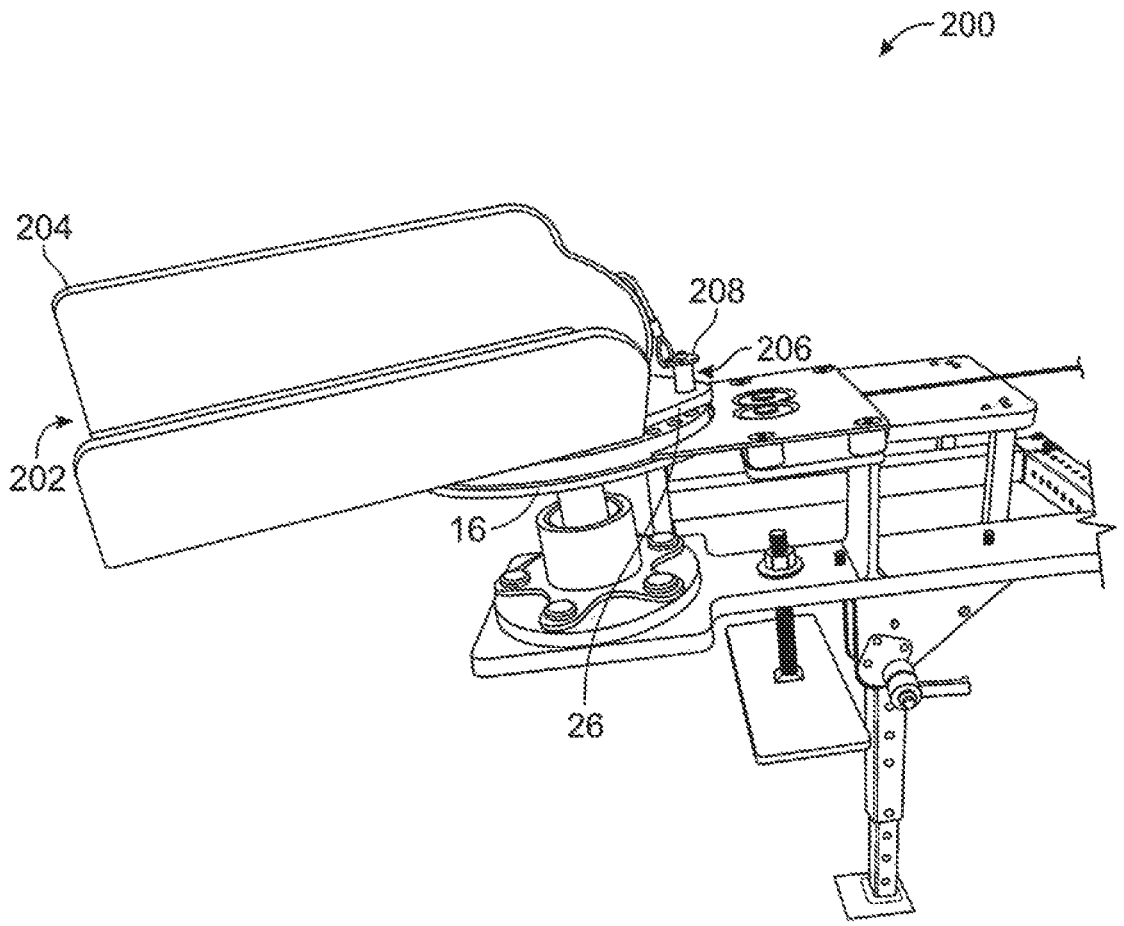
FIG. 5 is a perspective view of an embodiment of a knee cradle attachment.

Referring to FIG. 5, hip rotation exercises are carried out through knee cradle attachment 200 more effectively than that offered by current equipment when used to strengthen the hip joint and related muscles in a supination, and/or pronation motion, and/or rotation motion. The counteracting force from apparatus 10 directly opposes the user's supination, pronation, and/or rotation forces. The user positions their leg in such a way that the supination and pronation and rotation of the hip is isolated and exercised when moving through the selected range of motion. Preferably knee cradle attachment 200 comprises knee placement area 202, padding 204, pin position hole 206, and easy insertion/release pin 208. In one embodiment, an easy insertion/release pin (not shown) is affixed to knee cradle attachment 200. In a different embodiment, knee cradle attachment 200 further comprises easy center pin positioning hole (not shown) through which the easy insertion/release pin passes to be inserted into center perforation 28. The user preferably will select the position they wish to begin the motion by moving knee cradle attachment 200 to a position, then securing easy insertion/release pin 208 through range of motion pin positioning hole 206 and then into any one of off center perforations 26 in wheel 16. Preferably a user's knee will be bent, then placed into the knee cradle attachment 200 with their knee cap over the center of rotation of wheel 16. With their shin resting on the padding 204, the user's femur will be preferably be parallel and coincidental with the axis of rotation of the wheel 16. The user's other leg will be standing foot down on the floor. When a user rotates their leg that is resting in the knee cradle attachment 200 they will be able to exercise against the resistance of apparatus 10. By adjusting the positioning of pin position hole 206, a user can change the range of motion that they will be able to encompass with knee cradle attachment 200. By adjusting the height of wheel platform arm 32, a user can adjust the height of the installed knee cradle attachment 200 to a variety of positions including the height of their knee.

Figure 6:
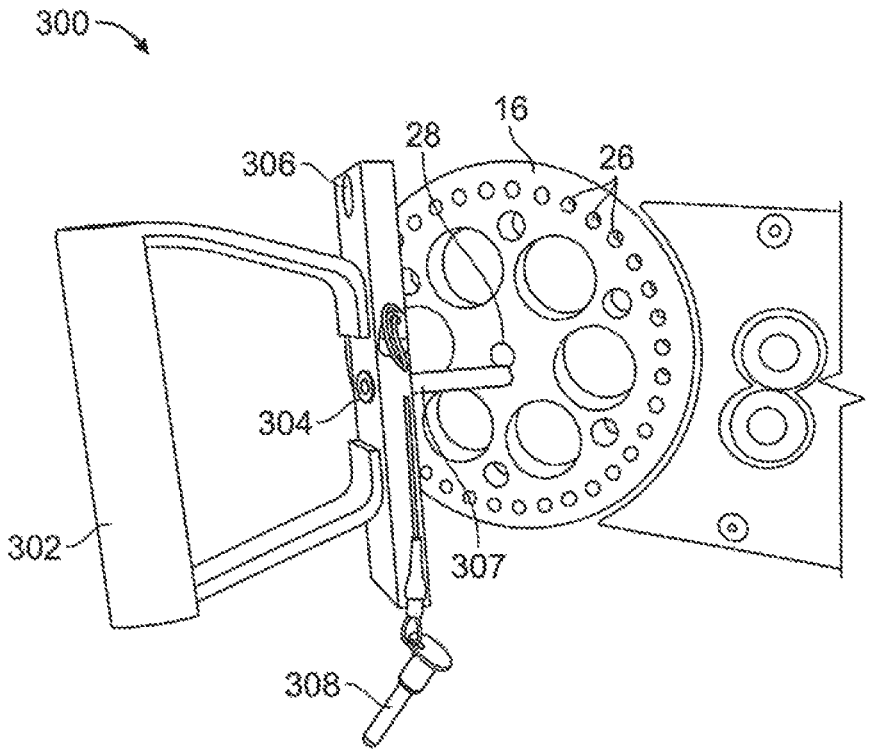
FIG. 6 is a perspective view of an embodiment of a grip handle attachment.

Referring to FIG. 6, arm and/or hand rotation and/or supination, and/or pronation exercise is preferably provided through grip handle attachment 300, which is more effective than current exercise devices when used to strengthen the shoulder joint and related muscles in a supination, and/or pronation and/or rotation motion, and/or the wrist joint and related muscles in a supination, and/or pronation, and/or rotation motion, and/or the elbow joint and related muscles in a supination and/or pronation and/or rotation motion. The counteracting force from embodiments of the present invention directly opposes the user's supination and pronation forces throughout their range of motion. The user positions their arm in such a way that the supination and pronation of the shoulder and/or elbow and/or wrist is isolated and exercised when moving through the selected range of motion. Preferably, grip handle attachment 300 comprises grip surface 302, center pin position hole 304, range of motion pin position hole 306, easy insertion/release pins 307, and easy insertion/release pin 308. In one embodiment, easy insertion/release pin 307 is affixed to grip handle attachment 300. In a different embodiment, grip handle attachment 300 further comprises easy center pin positioning hole (not shown) through which easy insertion/release pin 307 passes to be inserted into center perforation 28, and easy insertion/release pin 308 passes through pin positioning hole 306 to be inserted into off center perforations 26 on wheel 16. A user installs the grip handle attachment to the wheel 16 of exercise apparatus 10, then orients the range of motion pin position hole 306 with their choice of off center perforation 28, then the user inserts the easy insertion/release pin 307 into range of motion pin position hole 306 and off center perforation 26, then a user will adjust the height of adjustable wheel platform arm 32, and adjust the angle of the wheel 16 by rotating wheel platform arm 32, then a user will grasp grip surface 302 with their hand and position their body relative to the center of rotation of wheel 16 such that the axis of the center of rotation of wheel 16 is coincidental with the axis of the center of rotation of the user's forearm, then the user will pronate and supinate their wrist against the resistance of the exercise apparatus 10.

Figure 7:
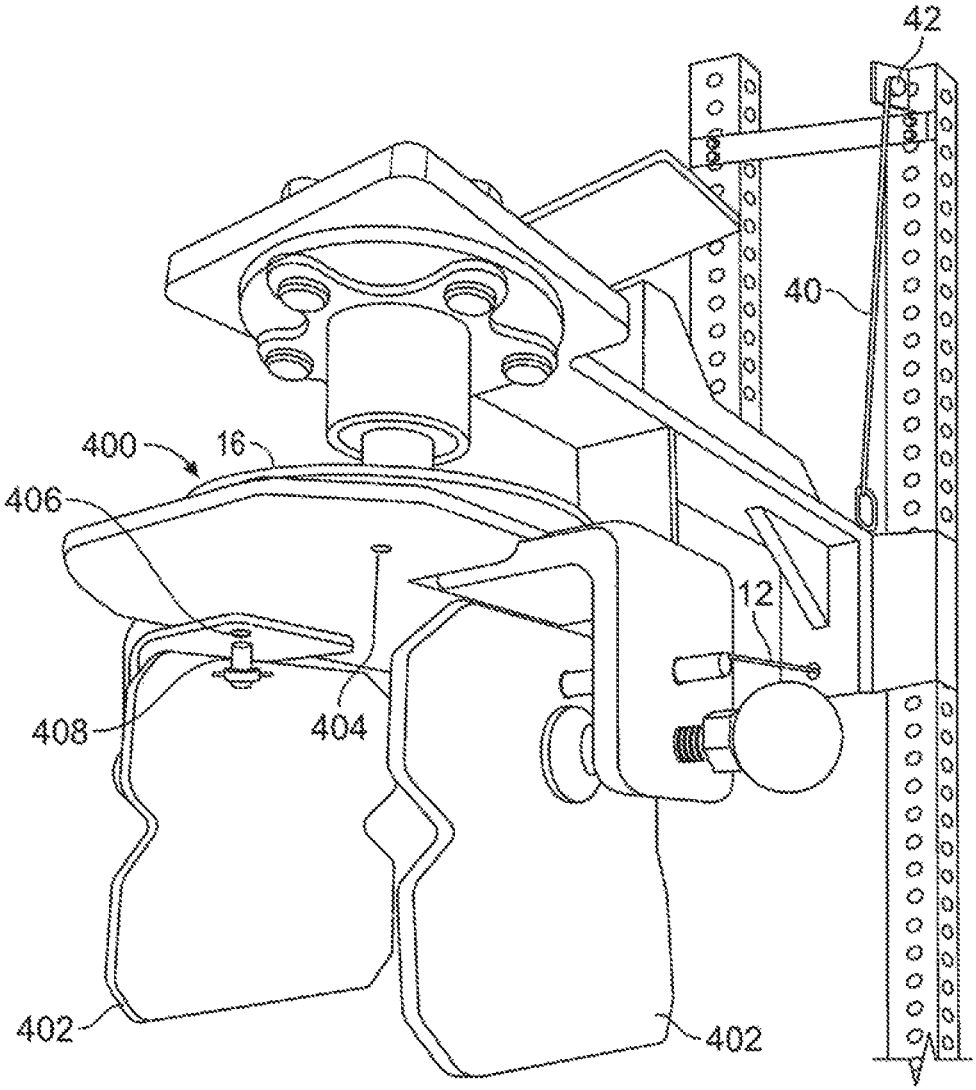
FIG. 7 is a perspective view of an embodiment of a head piece attachment.

Referring to FIG. 7, neck rotation is provided by utilizing head piece attachment 400, which is more effective than the prior art when used to strengthen the neck and/or related muscles in a left and/or right rotating motion. The counteracting force from the machine directly opposes the user's rotating forces without any other forces interfering. The user positions their head in such a way that the left and right rotation of the neck is isolated, and exercised when moving through the selected range of motion. Preferably, head piece attachment 400 comprises head clamps 402, center pin position hole 404, range of motion pin position hole 406, and easy insertion/release pin 408. The user will preferably insert an easy insertion/release pin (not shown) through center pin position hole 404 and into center perforation 28 on wheel 16, and easy insertion/release pin 408 through range of motion pin position hole 406 into off center perforations 26 in wheel 16. In one embodiment, the central easy insertion/release pin is affixed to head piece attachment 400. A user preferably inserts their head into head piece attachment 400 with the crown of their head centered on center pin position hole 404, then by turning a head clamp adjuster connected to each head clamp 402, a user will secure head piece attachment 400 onto their head. With head piece attachment 400 on their head, and head piece attachment also secured to the wheel 16, a person will be able to exercise their neck in a rotational fashion against the resistance of exercise apparatus 10. Preferably wheel 16 will be facing downward towards the ground and the user will be sitting or standing, but optionally a person could orient wheel 16 at a right angle to the ground, and exercise with the head piece attachment 400 and exercise apparatus 10 while laying their body on a table.

Figure 8:
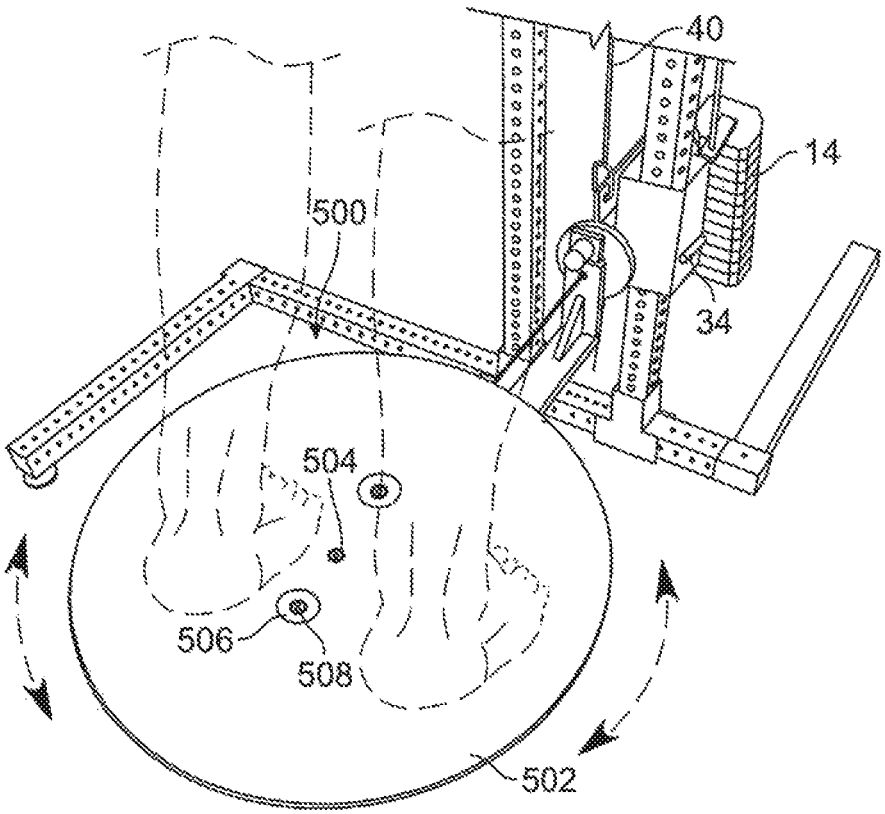
FIG. 8 is a perspective view of an embodiment of a foot plate attachment.

Referring to FIG. 8, hip and/or knee and/or ankle and/or spine rotation and/or pronation and/or supination provided by utilizing the foot plate attachment 500 in the present invention is more effective than the prior art when used to strengthen the hip joint and/or knee joint and/or ankle joint and/or spine and related muscles in a supination, and/or pronation, and/or rotation motion. The counteracting force from the machine directly opposes the user's supination and/or pronation and/or rotation forces without any other forces interfering. The user positions their leg or legs in such a way that the supination and/or pronation and/or rotation of the hip and/or knee and/or ankle and/or foot and/or spine is isolated, and exercised when moving through the selected range of motion. Preferably, foot plate attachment 500 comprises foot placement surface 502, center pin position hole 504, other pin position hole 506, and easy insertion/release pin 508. The user will preferably insert an easy insertion/release pin (not shown) through center pin position hole 504 into center perforation 28 on wheel 16, which is under foot plate attachment 500, and easy insertion/release pin 508 through pin position hole 506 into off center perforations 26 on wheel 16. In one embodiment, the central easy insertion/release pin is affixed to foot plate attachment 500. A user can place one foot or both feet on foot plate attachment 500. If placing one foot on the foot plate attachment 500, a user can place their other foot on a small table (not shown) placed next to the exercise apparatus 10, and optionally connect the small table to the exercise apparatus 10 in such a way that it will not slide on the floor when a person is standing on it. Preferably the small table will have a height similar to the selected height of the foot plate attachment after it is installed onto the exercise apparatus 10.

A person can place one foot on the foot plate attachment 500 in any location, but preferably with their heel or ball of their foot placed over the center perforation 28, then a person could twist, or rotate, or supinate, or pronate their foot, or leg in order to exercise against the resistance provided by the exercise apparatus. When placing both feet on the foot plate attachment, a person can grasp the safety handles (not shown) with their hands, then a user can rotate their spine medially or laterally or internally or externally in such a way as to exercise against the resistance provided by the exercise apparatus 10. By orientating the wheel to different heights, or angles, then installing the foot plate attachment 500 a person could achieve a wide variety of positions for the foot plate attachment 500, then a person could exercise the foot plate attachment 500 in a wide variety of ways with other parts of the body not mentioned here, such as the hands. Incorporating other apparatuses such as chairs, tables, etc., a person could put their body into a wide variety of positions while utilizing foot plate attachment 500.

Figure 9:
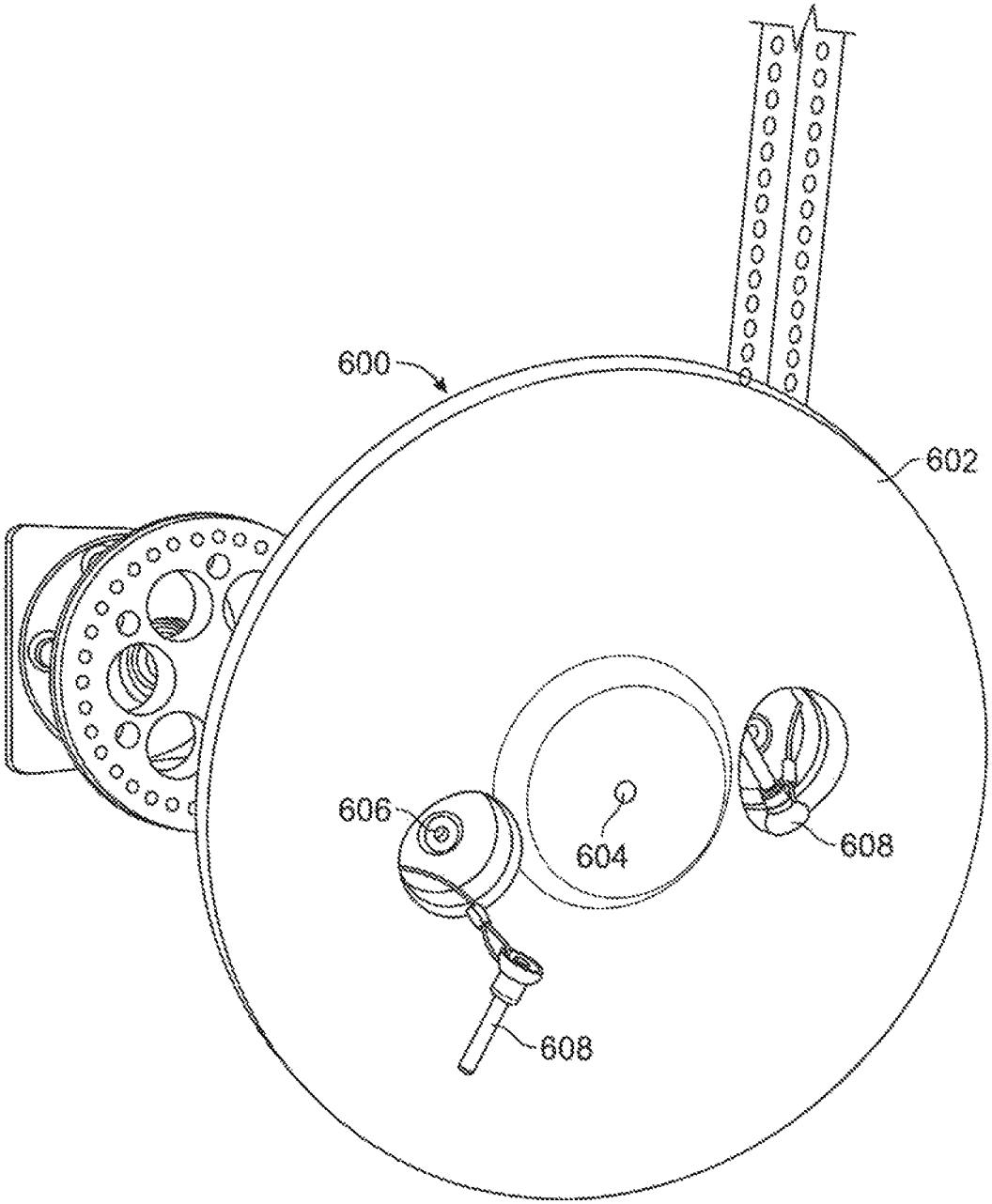
FIG. 9 is a perspective view of an embodiment of a hand plate attachment.

Referring to FIG. 9, shoulder rotation and/or wrist rotation and/or elbow rotation and/or hand rotation, and/or arm rotation exercises are provided by utilizing the hand plate attachment 600 in the current invention which is more effective than the prior art when used to strengthen the shoulder joint and/or elbow joint and/or wrist joint and related muscles in a supination, and/or pronation and/or rotation motion. The counteracting force from the machine directly opposes the user's supination and/or pronation and/or rotation forces. The user positions their arm in such a way that the supination and pronation of the shoulder and/or elbow and/or wrist and/or hand are isolated, and exercised when moving through the selected range of motion. Preferably, hand plate attachment 600 comprises hand placement surface 602, center pin position hole 604, other pin position hole 606, and easy insertion/release pins 608. To install the attachment temporarily to the exercise apparatus 10, the user will preferably insert an easy insertion/release pin (not shown) through center pin position hole 604 into center perforation 28 on wheel 16, and easy insertion/release pins 608 into off center perforations 26 on wheel 16. In one embodiment, the central easy insertion/release pin is affixed to hand plate attachment 600. Preferably a user will adjust wheel 16, and the adjustable wheel platform arm 32 to a position that is preferably shoulder height with the axis of rotation of the wheel facing their shoulder joint, then they will install the hand plate attachment 600 to the wheel, and place their palm over center pin position hole 604, then rotate their straight arm either externally or internally in order to exercise against the resistance provided by the machine.

Figure 10:
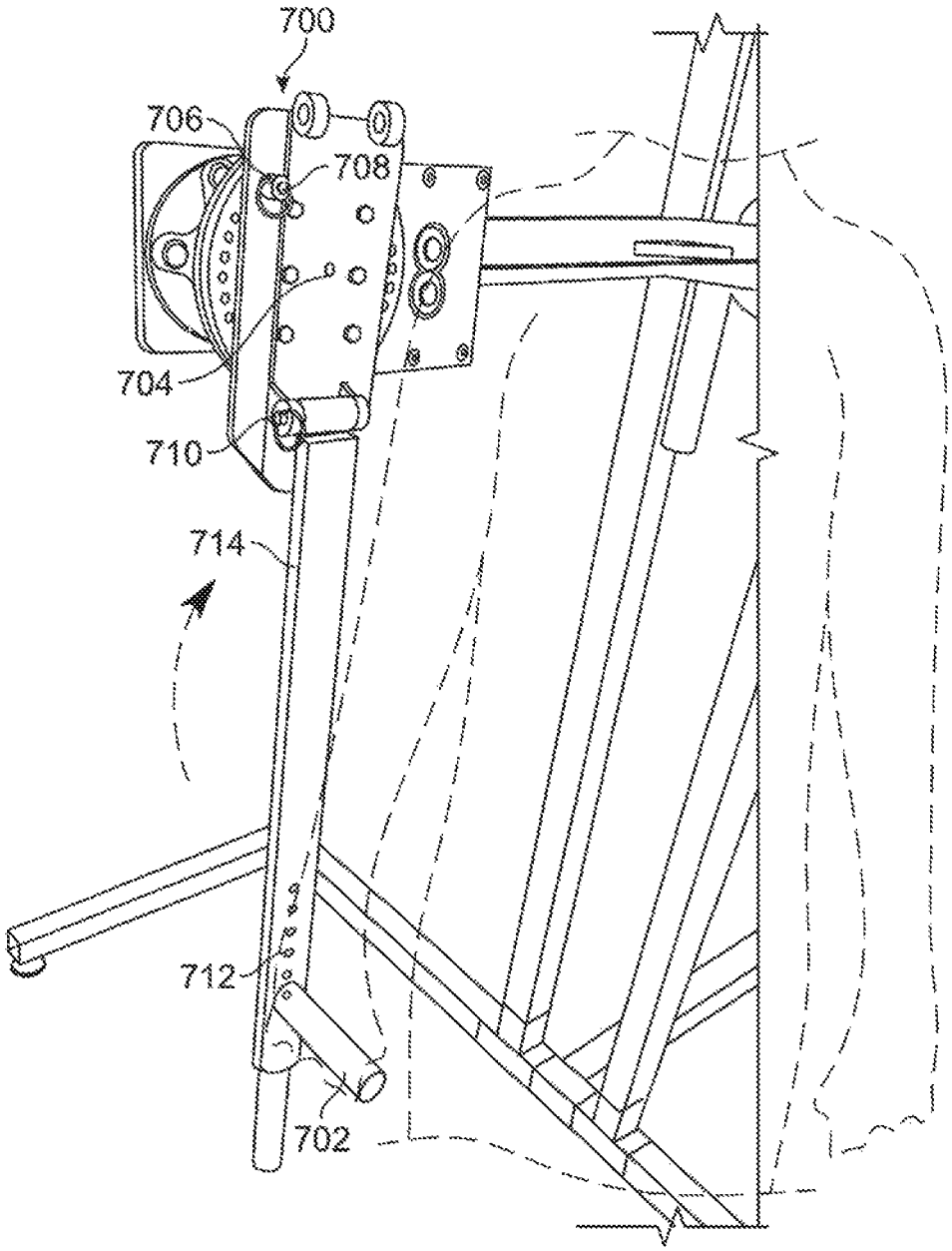
FIG. 10 is a perspective view of an embodiment of a long shoulder handle.

Referring to FIG. 10, shoulder rotation provided by utilizing long shoulder handle attachment 700 in the present invention is more effective than the prior art when used to strengthen the shoulder joint and related muscles in a supination, and/or pronation and/or rotation motion. The counteracting force from the machine directly opposes the user's supination and/or pronation and/or rotation forces. The user positions their arm in such a way that the supination and/or pronation and/or rotation of the shoulder is isolated, and exercised when moving through the selected range of motion. Preferably, long shoulder handle attachment 700 comprises removable handle 702, center pin position hole 704, range of motion pin position hole 706, and easy insertion/release pin 708. The user will preferably insert an easy insertion/release pin (not shown) through center pin positioning hole 704 into center perforation 28 on wheel 16, and easy insertion/release pin 708 through range of motion pin position hole 706 into off center perforations 26 on wheel 16. Preferably user will remove removable handle 702 and place it into removable handle insertion points 712 of their choice. Optionally, user can remove long arm 714 by releasing easy release hinge 710. In one embodiment, the central easy insertion/release pin is affixed to long shoulder handle attachment 700. Preferably a user will adjust wheel 16 and adjustable wheel platform arm 32 to a position in space to where the center pin position hole 704 is at shoulder height, and the axis of rotation of wheel 16 is directed at the shoulder joint, then the user will grasp removable handle 702 with their hand and position their body next to the wheel 16 at an optional angle, then a user will move removable handle 702 around center pin positioning hole 704 in order to work against the resistance provided by the exercise apparatus 10.

Figure 11:
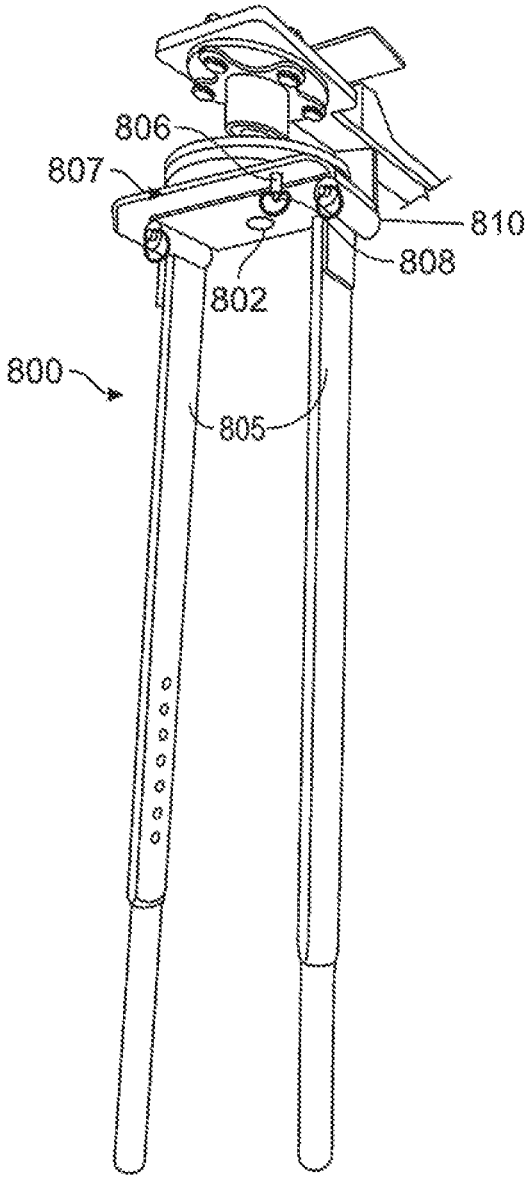
FIG. 11 is a perspective view of an embodiment of a long over-head handles attachment.

Referring to FIG. 11, spine rotation and/or hip rotation and/or knee rotation and/or ankle rotation provided by utilizing long overhead handles attachment 800 is more effective than the prior art when used to strengthen the spine and/or hip and/or knee and/or ankle joints and related muscles in a rotating motion. The counteracting force from the machine directly opposes the user's rotation forces. The user positions their body in such a way that the rotation and/or supination and/or pronation of the spine and/or hip and/or knee and/or ankle and/or foot and related muscles are isolated, and exercised when moving through the selected range of motion. Preferably, long overhead handles attachment 800 comprises center pin position hole 802, range of motion pin position hole 806, long arms 805, and one or more easy release hinges 810. The user will preferably insert an easy insertion/release pin (not shown) through center pin positioning hole 802 into center perforation 28 on wheel 16, and pin 808 through range of motion pin position hole 806 into off center perforations 26 on wheel 16. Optionally user can remove long arms 808 by removing easy release hinge (s) 810. In one embodiment, the central easy insertion/release pin is affixed to long overhead handles attachment 800. A user will preferably orient the wheel to an overhead position with the wheel facing towards the ground, then install the long overhead handles attachment onto the wheel, then choose to have one or two long arms 805 installed, then position themselves in a standing position under the center pin position hole 802, then the user will grasp with their hand or hands on one or both of the long arms 805, and preferably the user will then rotate their spine and legs in such a way as to turn their bodies from side to side, or laterally and/or medially rotate their torso in such a way as to exercise against the resistance provided by the exercise apparatus 10. A user could potentially incorporate a chair or wheelchair into their exercise routine along with the exercise apparatus 10 in order to accomplish torso rotation from a seated position.

Figure 12:
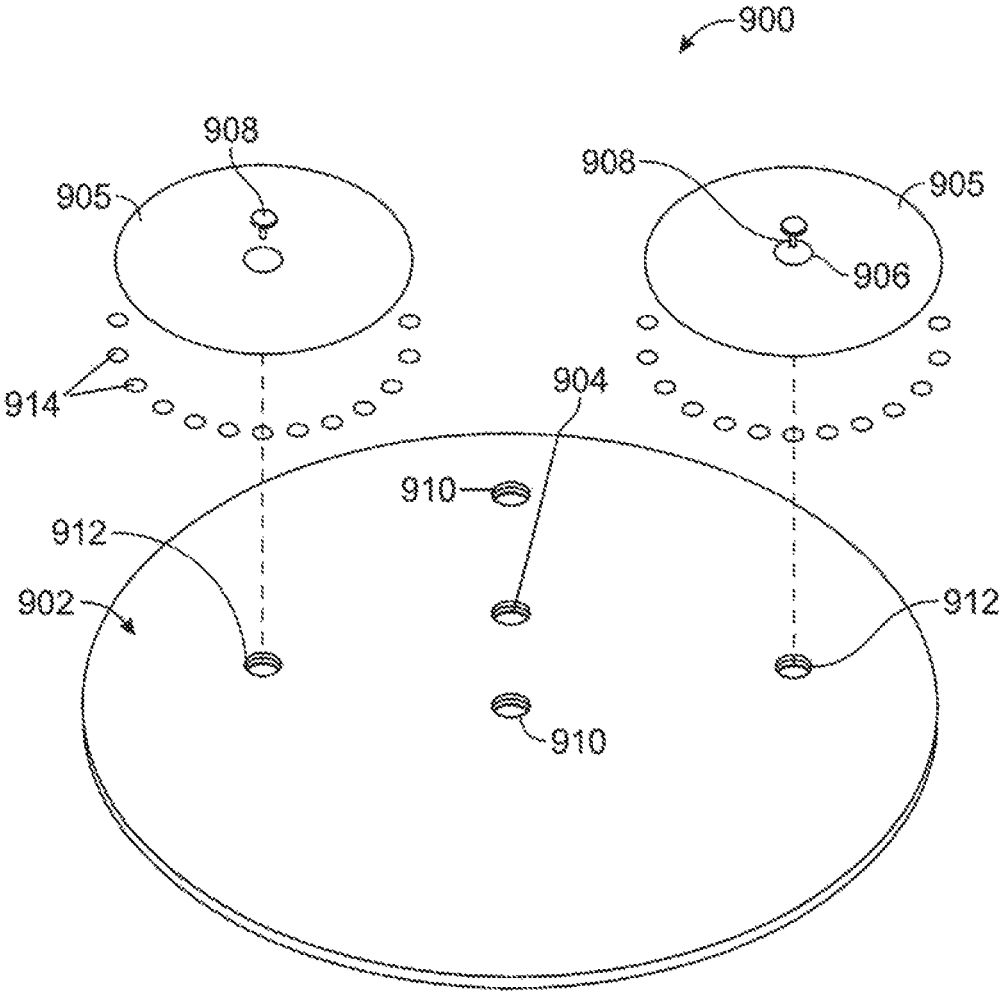
FIG. 12 is a perspective view of an embodiment of a twin free foot spin foot plate attachment.

Referring FIG. 12, hip and/or knee and/or ankle and/or spine rotation and/or supination and/or pronation and or circumduction provided by utilizing twin free spin foot plate attachment 900 is more effective than the prior art when used to strengthen the spine and/or hip and/or knee and/or ankle joints and related muscles in a supination, and/or pronation and/or rotation motion. The counteracting force from the machine directly opposes the user's supination and/or pronation and/or rotation forces. Preferably, twin free spin foot plate attachment 900 comprises support surface 902, center pin position hole 904, range of motion pin position holes 910, easy insertion/release pin 908, foot pads 905, pin holes 912, and bearings 914. The user will preferably insert an easy insertion/release pin (not shown) through center pin positioning hole 904 into center perforation 28 on wheel 16, which is underneath support surface 902, and easy insertion/release pins (not shown) through range of motion pin position holes 910 into off center perforations 26 on wheel 16. In one embodiment, the easy insertion/release pins are affixed to twin free spin foot plate attachment 900. In another embodiment, easy insertion/release pin 908 inserts into foot pad 905 and into pin hole 912, thus securing bearings 914 between foot pad 905 and support surface 902, allowing a user to place their foot or body part onto foot pad 905 and then rotate support surface 902 around center pin position hole 904, thus causing the overall effect of moving support surface 902 clockwise or counterclockwise. Preferably a user will position the wheel 16 in a low position with the wheel facing towards the sky, then install the twin free spin foot plate attachment 900 onto the wheel 16 and optionally place next to the exercise apparatus 10 a small platform (not shown) in which to place one foot, then a user will place their other foot onto one of the foot pads 905, then a user will move foot pads 905 in a path around center pin position hole 904 while foot pad 905 is free to spin as it moves in a path around center pin position hole 904, while doing this, the user will be able to exercise their leg which is using foot pad 905 in a circumduction motion. Positioning the wheel at a different height, or a different angle will give the user a unique position to utilize twin free spin foot plate attachment. A user could place one foot onto one of the foot pad 905, and the other foot onto the other foot pad 905, then the user could use their feet to move the two foot pads 905 around the center pin position hole 904 in order to exercise their legs in a circumduction and/or rotation motion and/or their spine against the resistance provided by the exercise apparatus 10.

Figure 13:
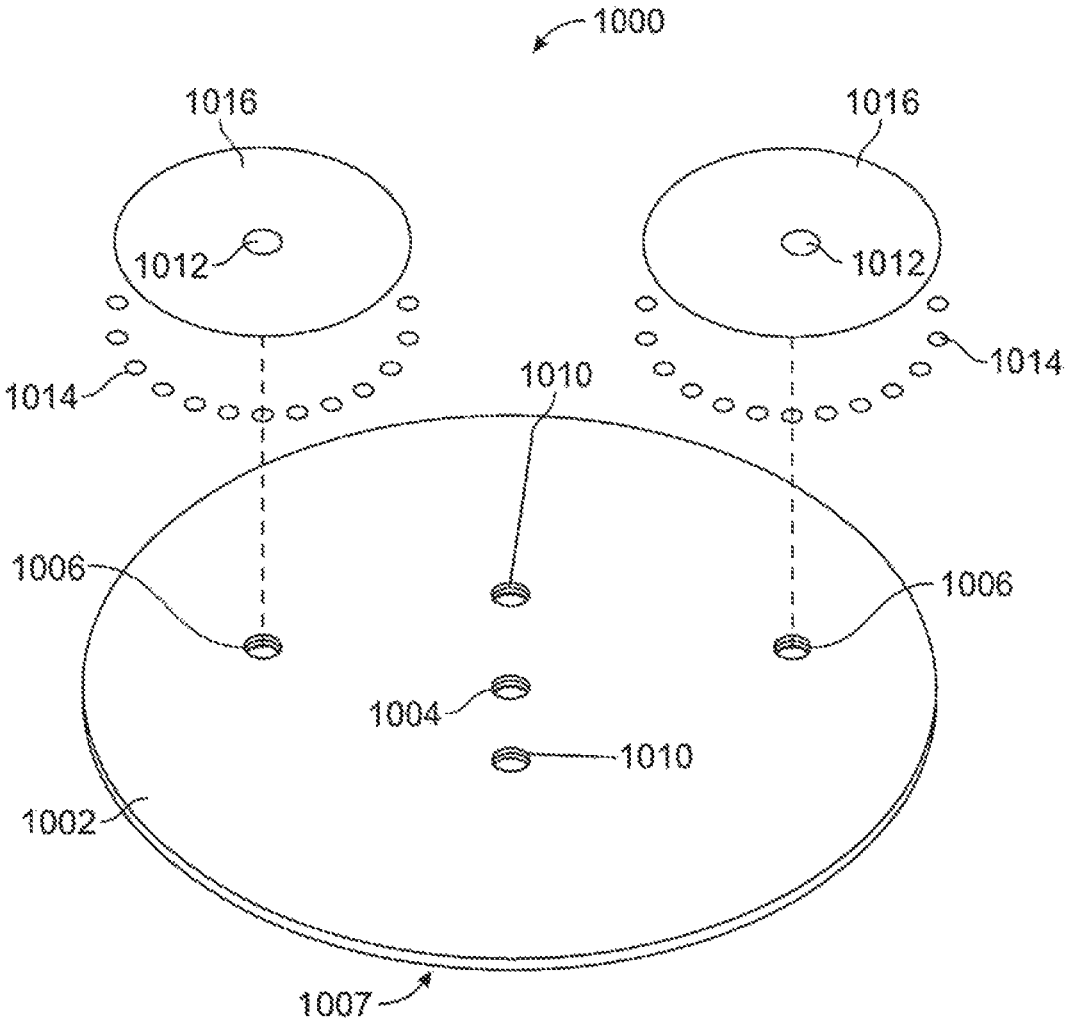
FIG. 13 is a perspective view of an embodiment of a twin free hand spin foot plate attachment.

Referring to FIG. 13, in one embodiment, shoulder and/or elbow and/or wrist supination and/or pronation and/or rotation provided by utilizing the twin free spin hand plate 1000 attachment in the present invention is more effective than the prior art when used to strengthen the shoulder and/or elbow and/or hands and/or wrist joints and related muscles in a supination, and/or pronation and/or rotation motion. The counteracting force from the machine directly opposes the user's supination and/or pronation and/or rotation forces. The user positions their arms in such a way that the supination and/or pronation and/or rotation of the shoulder and/or elbow, and/or wrist and/or hands are isolated, and exercised when moving through the selected range of motion. Preferably, twin free spin hand plate attachment 1000 comprises support surface 1002, center pin position hole 1004, range of motion pin position holes 1010, hand pads 1016, pin hole 1012, which aligns with support surface pin holes 1006, and bearings 1014. The user will preferably insert an easy insertion/release pin (not shown) through center pin positioning hole 1004 and into center perforation 28 on wheel 16, which is under support surface 1002, and insert easy insertion/release pins (not shown) through range of motion pin position holes 1010 into off center perforations in wheel 26 on wheel 16. In one embodiment, the easy insertion/release pins are affixed to twin free spin hand plate 1000. In another embodiment, an easy insertion/release pin inserts into pin hole 1012 in hand pad 1016, thus securing bearings 1014 between hand pad 1016 and support surface 1002, allowing a user to place their hand or body part onto hand pad 1016 and then rotate support surface 1002 around center pin position hole 1004, thus causing the overall effect of moving support surface 1002 clockwise or counterclockwise. Preferably a user will adjust exercise apparatus 10 in such a way as to place the wheel 16 at shoulder height with the wheel facing their chest as they stand in front of it, then a user will install twin free spin hand plate attachment 1000 onto the wheel 16, then a user will place one or both of their hands with the fingers pointing to the sky onto one or both of the hand pads 1016 with center pin position hole 1010 facing their chest. A user will then move one or both of the hand pads 1016 in a path around the center pin position hole 1010 in order to exercise against the resistance provided by the exercise apparatus 10. Preferably as their hands are moving around center pin position hole 1010, their fingers are able to remain pointing to the sky because hand pads 1016 rotate freely and independently from free spin hand plate attachment 1000. Different hand positions are possible, and different positions of the installed twin free spin hand plate attachment are possible depending on the position a user places the wheel 16.

Figure 14:
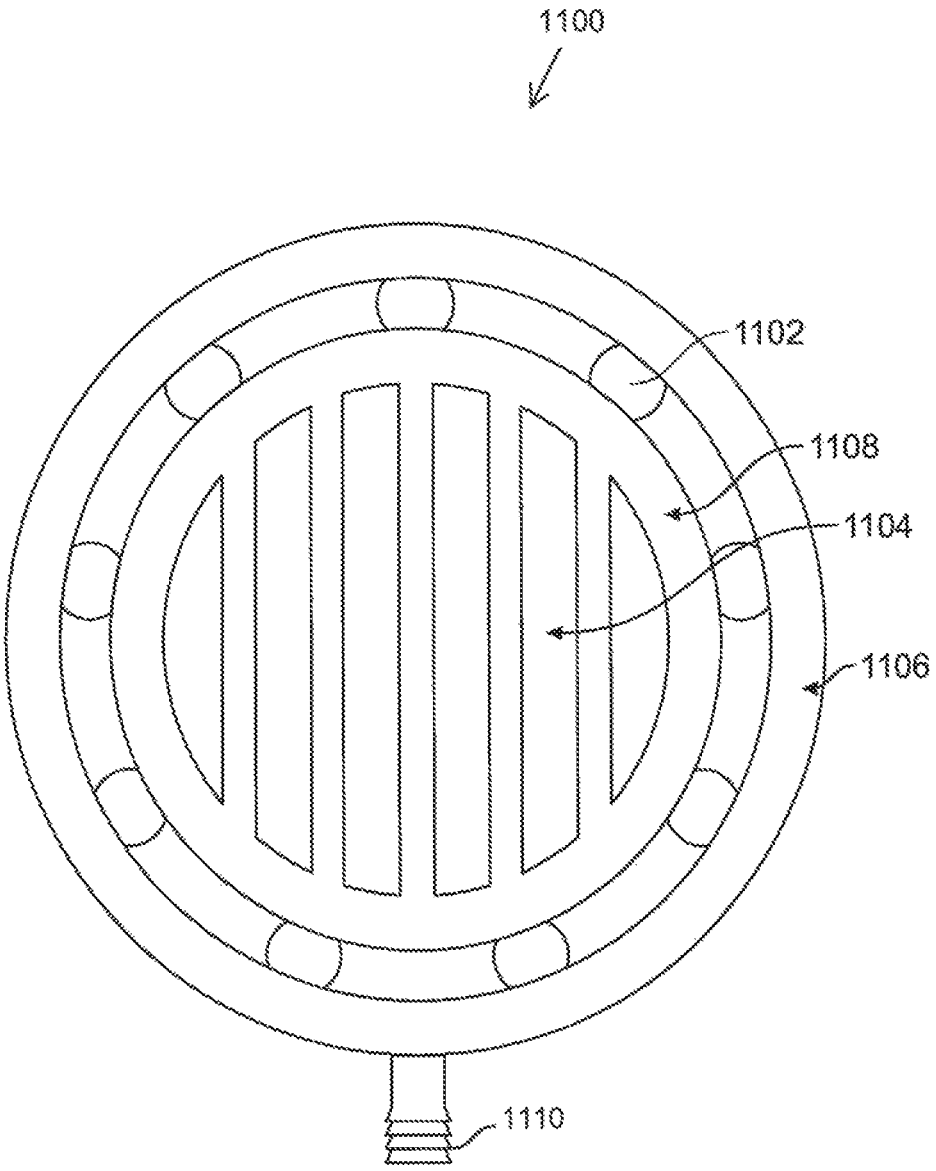
FIG. 14 is a perspective view of an embodiment of a free spinning finger cradle attachment.

Referring to FIG. 14, shoulder rotation and/or elbow rotation and/or wrist rotation and/or spine rotation provided by utilizing free spinning finger cradle attachment 1100 in the current invention is more effective than the prior art when used to strengthen the shoulder joint and/or elbow joint and/or wrist joint and/or the spine and related muscles in a supination, and/or pronation and/or rotational motion. The counteracting force from the machine directly opposes the user's supination, pronation, and rotational forces. The free spinning finger cradle attachment allows the user to supinate or pronate their hand freely, without an opposing force applied to that particular supination or pronation, while pronating and/or supinating and/or rotating another body part. Preferably free spinning finger cradle attachment 1100 comprises bearings 1102, finger placement slots 1104, outer housing 1106, inner housing 1108, and threaded insertion 1110. Preferably free spinning finger cradle attachment 1100 is attached to elbow cradle attachment 100 in place of the elbow cradle handle 102 (shown in FIG. 4), or to long shoulder handle attachment 700, in place of removable handle 702 (shown in FIG. 10).

Referring to FIGS. 15-20, in one embodiment, multi-function rotational resistance exercise apparatus 1200 comprises force transferring material such as cable 12, which is preferably connected at one end to rotational resistance assembly 1300, and optionally connected to functional assembly 1201 at the other end. Cable 12 passes through a series of pulleys 42 (some of which are not shown), and first pulley 54, preferably in such a way that the weights 14, are lifted when either end of the cable is drawn out from its resting position. Preferably main arm 1202, is secured to main arm carriage 1208, by main arm pins 1209. Main arm carriage 1208, is vertically adjustable on vertical frame post 1203, and lockable into position of choice by means of, for example, lock cog (not shown). Preferably a lock cog (not shown) is secured onto main carriage 1208 and can be moved by a user in such a way so that the lock cog will insert into lock cog insertion holes on vertical frame post 1203, thus holding main arm carriage 1208 in a static position, and allowing a user to exercise and/or place their body weight onto main arm 1202, without causing main arm carriage 1208 to move from its static position. Preferably the lock cog has multiple protrusions that insert into multiple lock cog insertion holes simultaneously. The lock cog operates similarly to a common indexing plunger with the addition of multiple protrusions that engage a hole or slot as opposed to a single protrusion that engages a hole or slot. Preferably when main arm carriage 1208, is adjusted vertically, main arm 1202, adjusts vertically as well because they are preferably secured to one another by main arm pins 1209. Optionally articulating safety handle 1205, is adjustable in position by safety handle lock 1206. Optionally safety handles 1205 are adjustable in length. Optionally stationary platform 1207, is attachable to a part of multi-function rotational resistance exercise apparatus 1200, providing a place for a user to stand or sit. Preferably a user adjusts the height of main arm 1202 by disengaging the lock cog from the lock cog insertion holes and sliding main arm 1202 up or down vertically on vertical frame post 1203.

Figure 15:
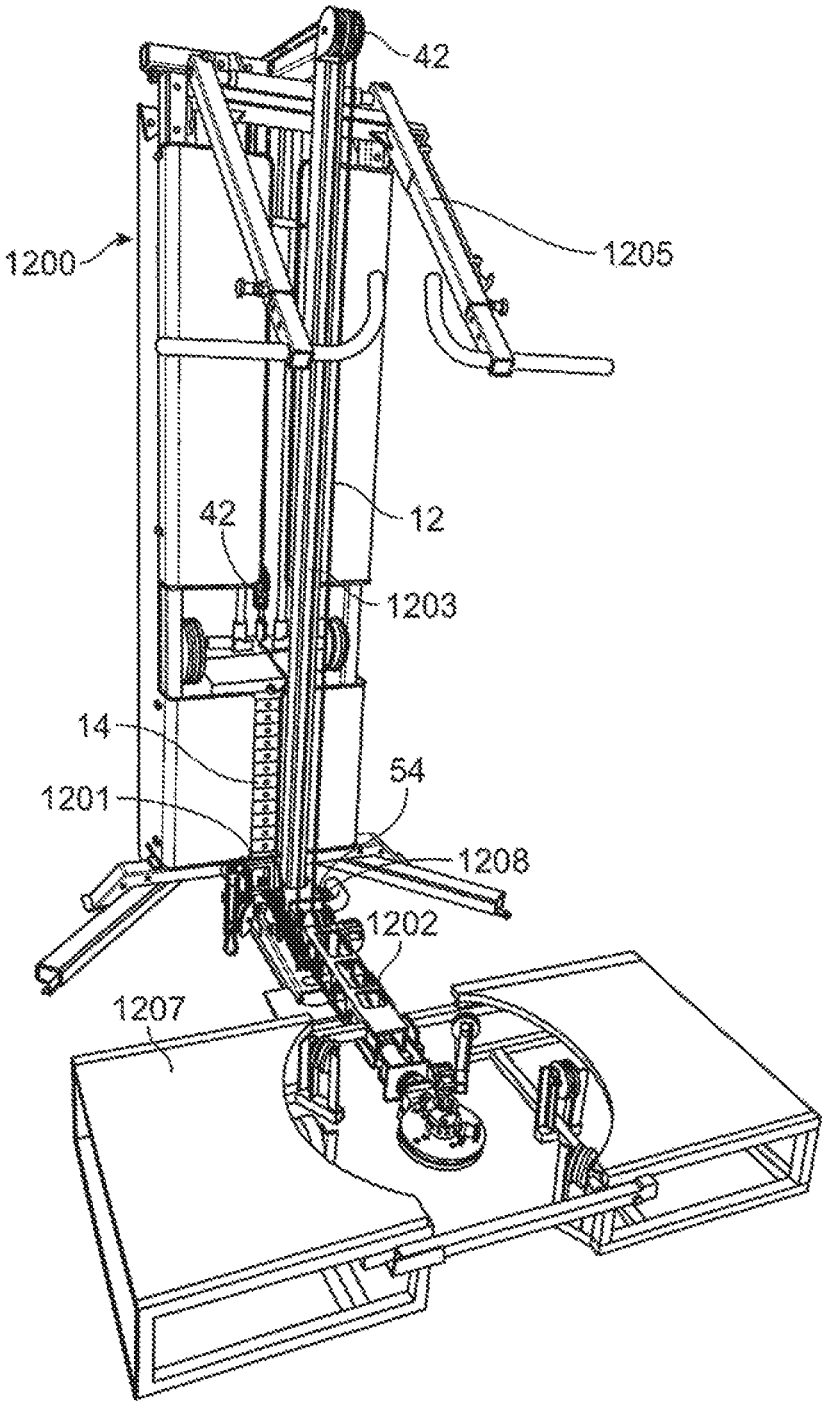
FIG. 15 is a perspective view of one embodiment of the present invention.
Figure 16:
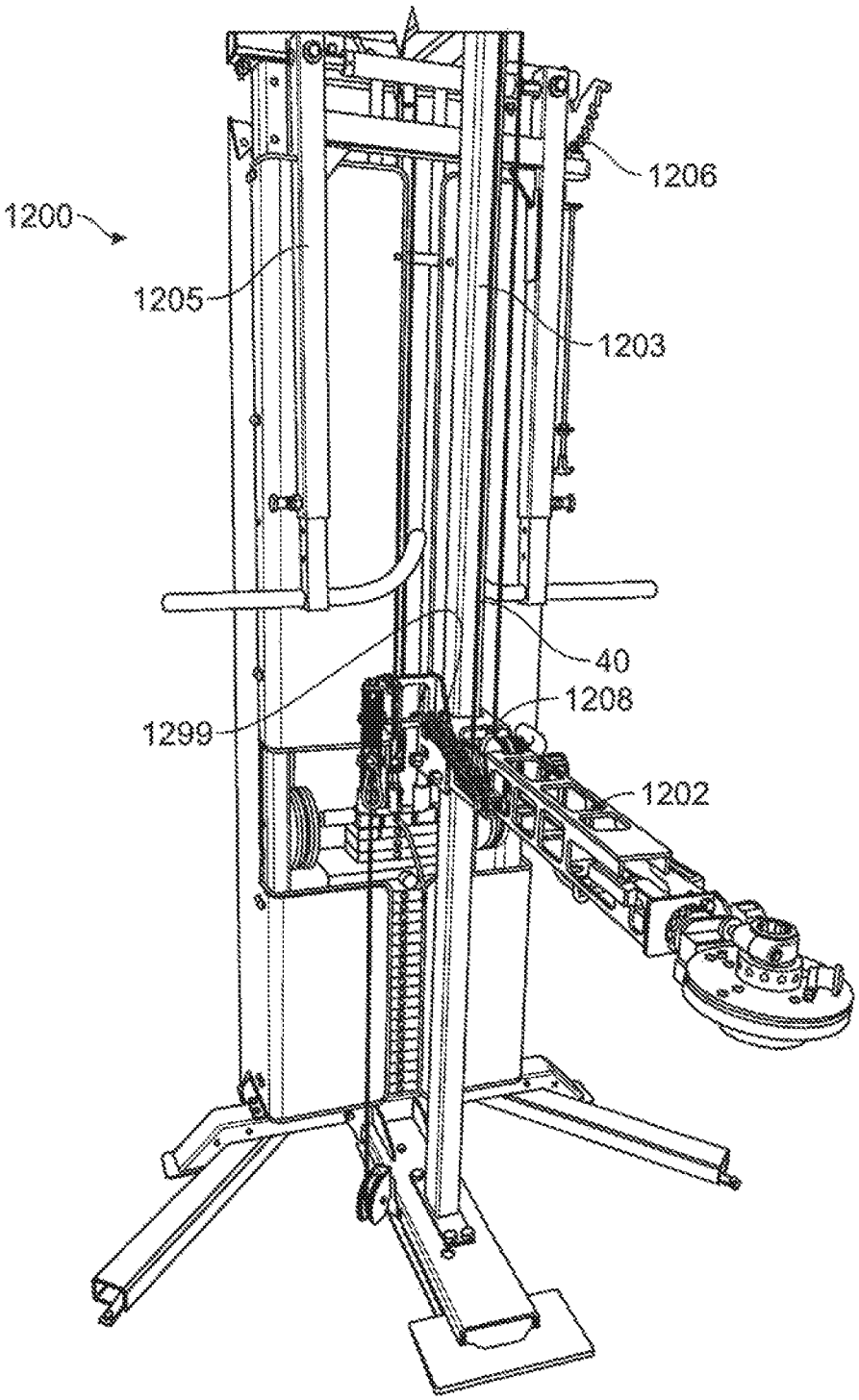
FIG. 16 is a perspective view of one embodiment of the present invention.

Referring more particularly to FIG. 16, in one embodiment, multi-function rotational resistance exercise apparatus 1200 is shown with a different vertical setting of main arm carriage 1208 on vertical frame post 1203, when compared to FIG. 15. One embodiment comprises counterweight cable 40, which is preferably connected at one end to counterweight 38, and connected to main arm carriage 1208, at the other end. Preferably when the main arm carriage 1208 is moved to a different vertical position by a user, counterweight 38, assists the user's efforts. Preferably main arm lift assist 1299, is connected at one end to main arm 1202, and connected at the other end to main arm carriage 1208, and preferably main arm lift assist 1299 provides lifting assistance when a user is articulating main arm 1202, into a new position around main arm pins 1209. Main arm lift assist 1209 could comprise a spring, or a hydraulic cylinder. Articulating safety handle 1205 is shown in a different position when compared to FIG. 15, and locked into position with safety handle lock 1206.

Figure 17:
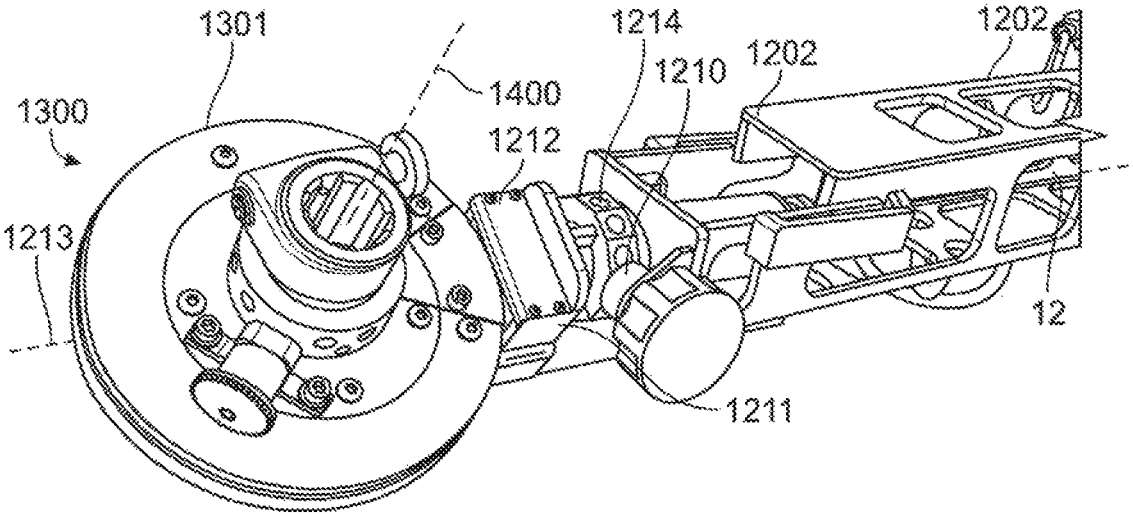
FIG. 17 is a closer view of an embodiment of a rotational resistance assembly with axis of rotation adjusted off vertical.

Referring more particularly to FIG. 17, in one embodiment main arm 1202 comprises tilt lock 1210 mounted on it. Preferably main arm 1202 comprises tilting hub 1211 rotatably mounted on its end. Preferably tilting hub 1211 has rotational resistance assembly 1300 rotatably mounted on its surface. Preferably tilt lock 1210 secures tilting hub 1211 into position around tilting hub axis of rotation 1213 by inserting into tilt lock holes 1214. Preferably adjusting the position of the tilting hub 1211 results in a change in the angle for the attachment extension port axis of rotation 1400 of rotational resistance assembly 1300. Preferably a user can unlock tilt lock 1210, and rotate tilting hub 1211 to any desired angle around tilting hub axis of rotation 1213. Preferably tilting hub axis of rotation 1213 of tilting hub 1211 is coincidental with cable 12, as cable 12 approaches and secures into rotational resistance assembly 1300. Beneath pulley cover 1212, are preferably two pulleys mounted to tilting hub 1211 (not shown in FIG. 17) that guide cable 12 around the perimeter of resistance force translator 1301 when rotational resistance assembly 1300 is rotated. Pulleys 17, which are located under pulley cover 1212 are preferably mounted to tilting hub 1211. Preferably when a user rotates rotational resistance assembly 1300 in clockwise and/or counterclockwise direction, cable 12 will lift weights 14 (not shown in FIG. 17), thus causing weights 14 to give resistance to the rotating motion of rotational resistance assembly 1300.

Figure 18:
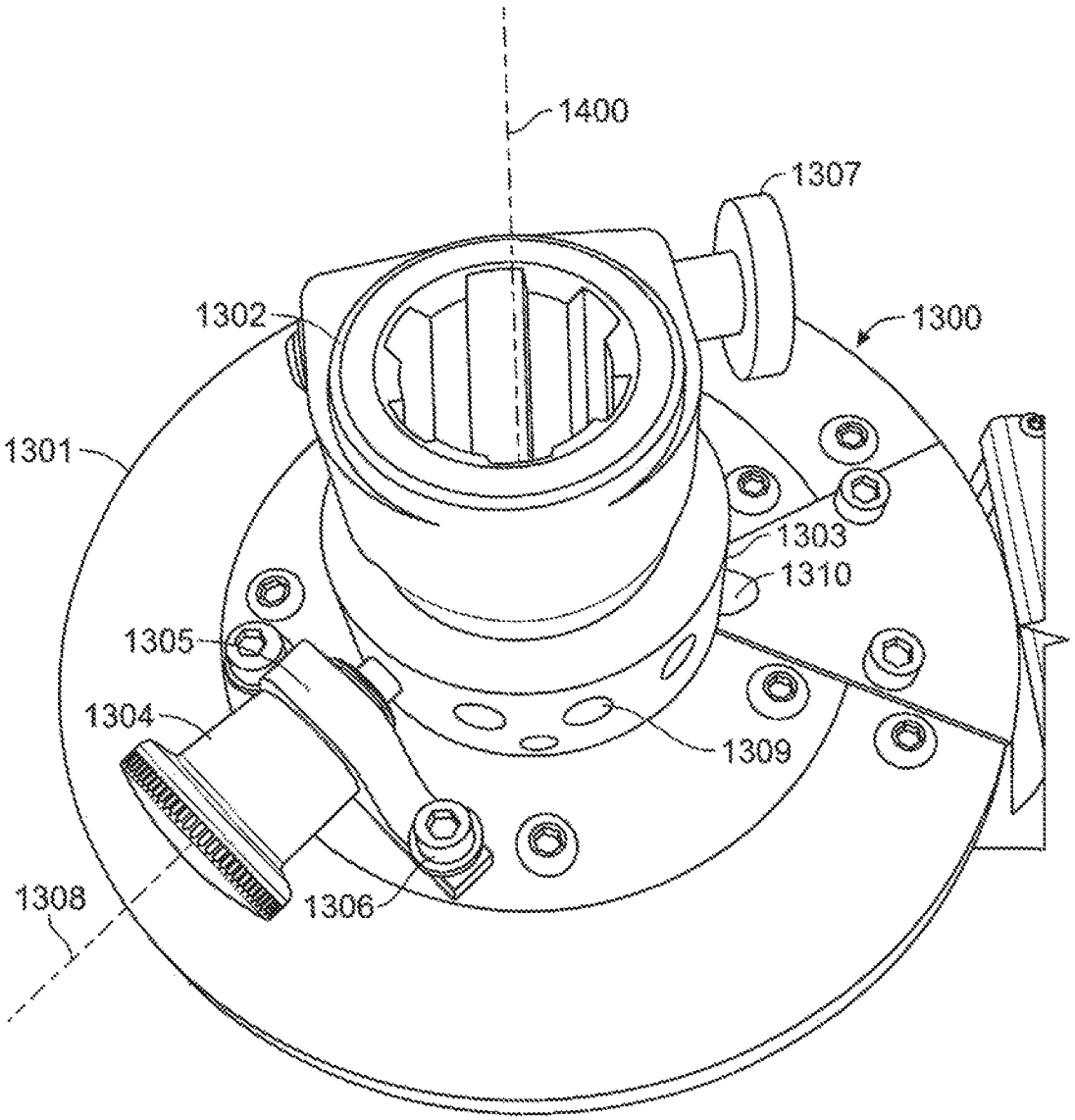
FIG. 18 is a closer view of an embodiment of a rotational resistance assembly.

Referring in more detail to FIG. 18, in one embodiment rotational resistance assembly 1300 preferably comprises attachment extension port 1302 which is rotatably mounted within tilting hub 1211 (not shown in FIG. 18) and optionally rotates around attachment extension port axis of rotation 1400. In one embodiment, attachment extension port 1302 is preferably the location for attaching attachment extension 2100 (not shown in FIG. 18), or other devices which are attachable to attachment extension port 1302. Preferably, attachment extension orientation ring 1303 is secured to attachment extension port 1302 with, for example, a bolt. Optionally attachment extension orientation ring lock 1304 is secured within attachment extension port lock housing 1305, and comprises attachment extension orientation ring lock axis of rotation 1308. Preferably attachment extension port lock housing 1305, is secured to the resistance force translator 1301 with 2, for example, bolts 1306. Optionally attachment extension orientation lock 1304 moves into attachment extension orientation ring hole 1309 which is optionally located on the perimeter of attachment extension orientation ring 1303. Preferably, by a user retracting attachment extension port lock 1304 along attachment extension orientation ring lock axis of translation 1308, then turning the attachment extension port 1302, results in the ability to turn attachment extension port 1302 around attachment extension port axis of rotation 1400, without turning resistance force translator 1301. Preferably, when attachment extension orientation ring lock 1304 is inserted into attachment extension orientation ring hole 1309 and a person rotates attachment extension port 1302, resistance force translator 1301 will rotate as well. In one embodiment, cable ball capture 1310 is a feature within the body of resistance force translator 1301, and secures the end of the cable 12 (not shown in FIG. 18) onto the perimeter of resistance force translator 1301. Preferably when resistance force translator 1301 rotates, cable ball capture 1310 rotates also, causing cable 12 (not shown in FIG. 18) to lift the weights 14, preferably causing the user to experience rotational resistance to their effort. Optionally, attachment extension port 1302 comprises attachment extension port lock 1307 which when engaged by a user, locks an attachment extension 2100 (not shown in FIG. 18), or attachment of choice into attachment extension port 1302, thus making it possible to rotate the attachment extension port 1302 by rotating the attachment extension 2100, or the attachment which is secured to the attachment extension port 1302.

Figure 19:
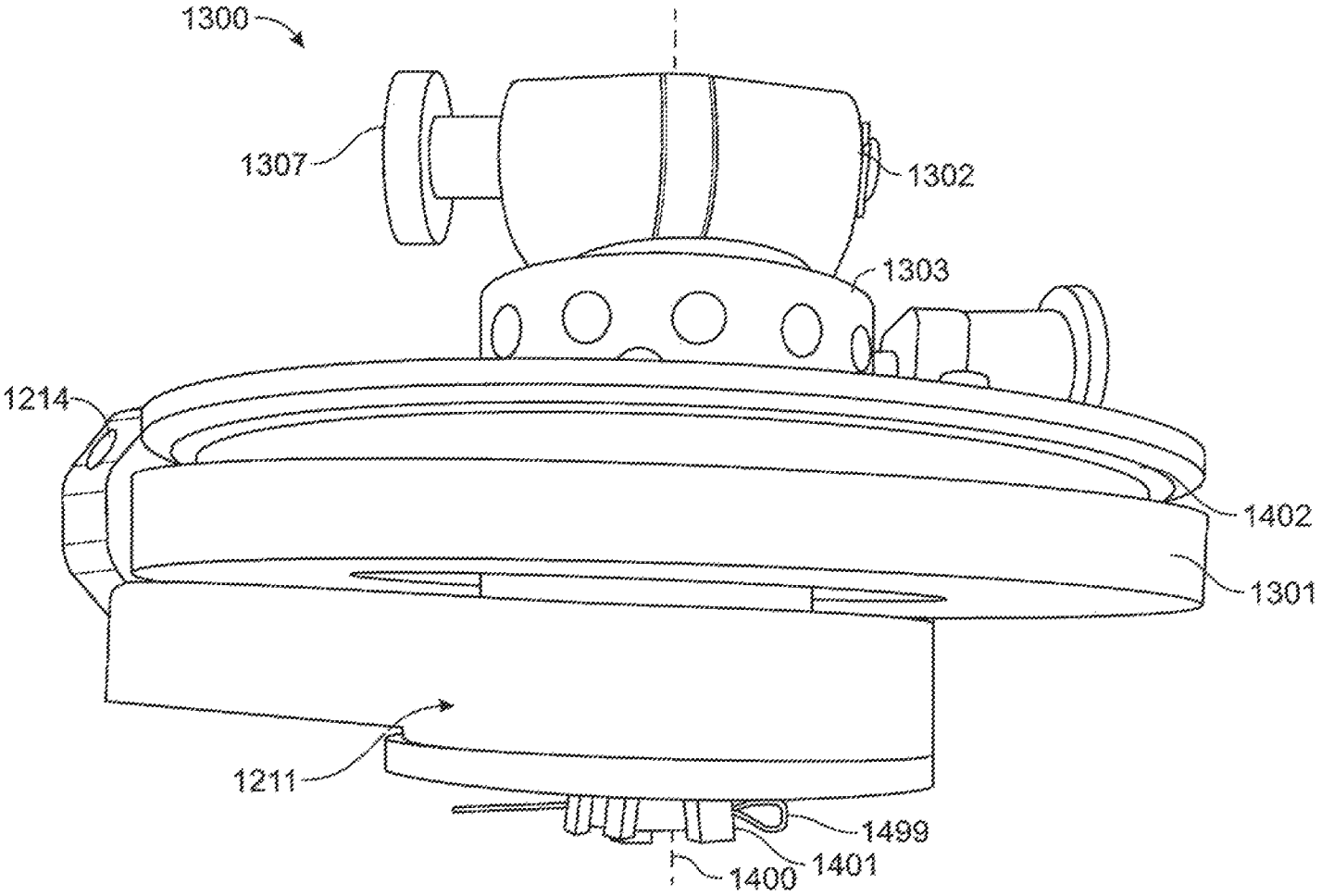
FIG. 19 is a side view of an embodiment of a rotational resistance assembly.

Referring in more detail to FIG. 19, in one embodiment, rotational resistance assembly 1300 comprises tilting hub 1211 which houses bearings (not shown), and preferably the bearings have the same axis of rotation as the attachment extension port axis of rotation 1400. Optionally attachment extension port 1302 passes through the center of attachment extension orientation ring 1303, and through the center of resistance force translator 1301, and through a passage in tilting hub 1211, and through the center of the bearings (not shown) to be secured to tilting hub 1211 by, for example, a nut 1401 and cotter pin 1499 on the underside of tilting hub 1211. Preferably, between tilting hub 1211 and resistance force translator 1301, there is friction reduction material (not shown) which preferably allows the attachment extension port 1302 to remain free to rotate independent of the tilting hub 1211. Optionally, resistance force translator 1301 comprises resistance force translator groove 1402 on its periphery for capturing cable 12 when it is rotated.

Figure 20:
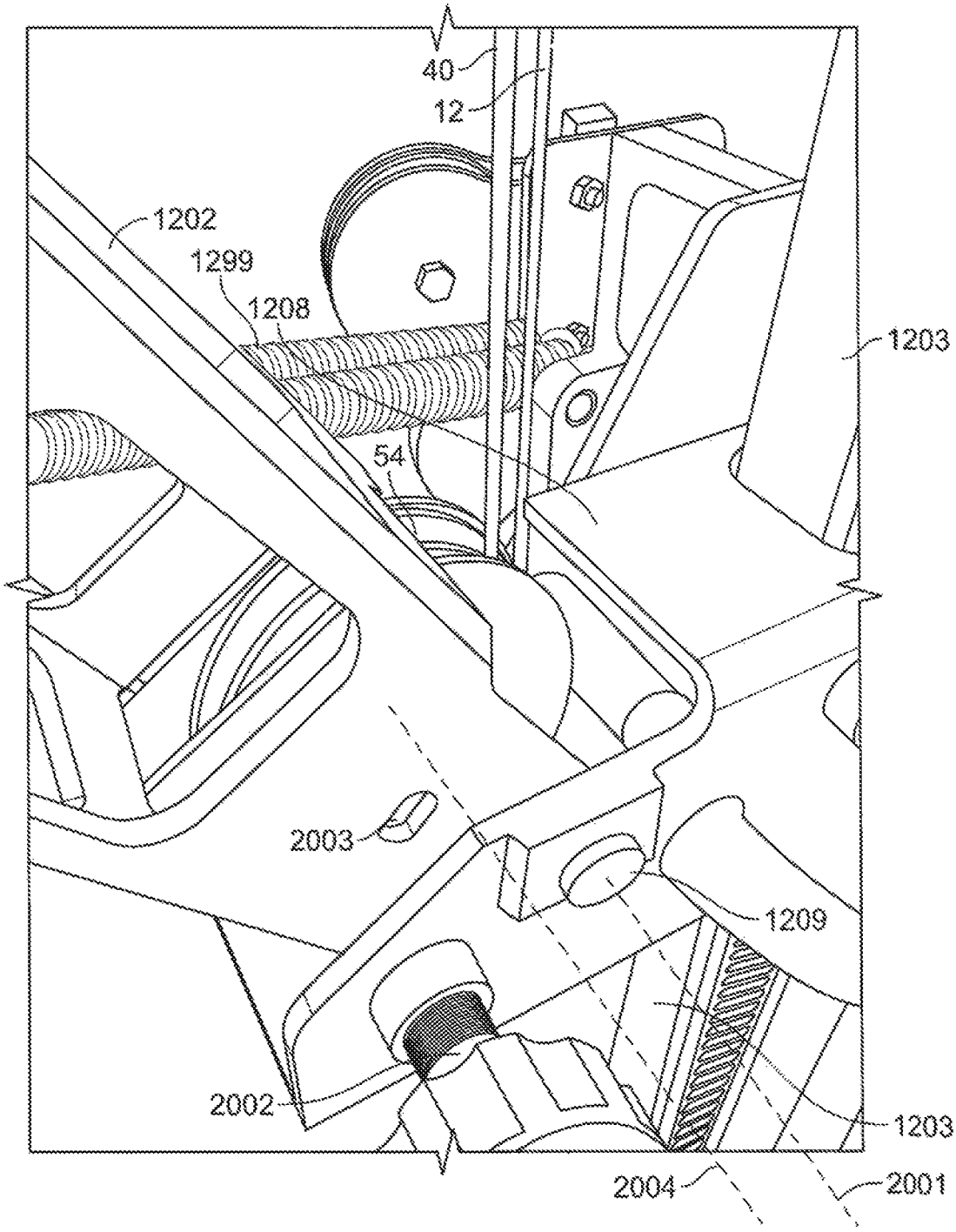
FIG. 20 is a view of an embodiment of a main arm with first pulley.

Referring in more detail to FIG. 20, in one embodiment, main arm 1202 is mounted to main arm carriage 1208 with main arm pins 1209, and main arm 1202 is optionally rotatable about the axis of rotation of main arm pins 2001. Optionally main arm 1202 can be locked into a plurality of positions by engagement of main arm lock 2002 into main arm lock position holes 2003. Preferably, first pulley 54 is mounted onto main arm 1202, and has a first pulley axis of rotation 2004 which is not coincidental with the axis of rotation of main arm pins 2001. Preferably at the time main arm 1202 is rotated around axis of rotation of main arm pins 2001, weights 14 (not shown) will not be moved by cable 12.

Figure 21:
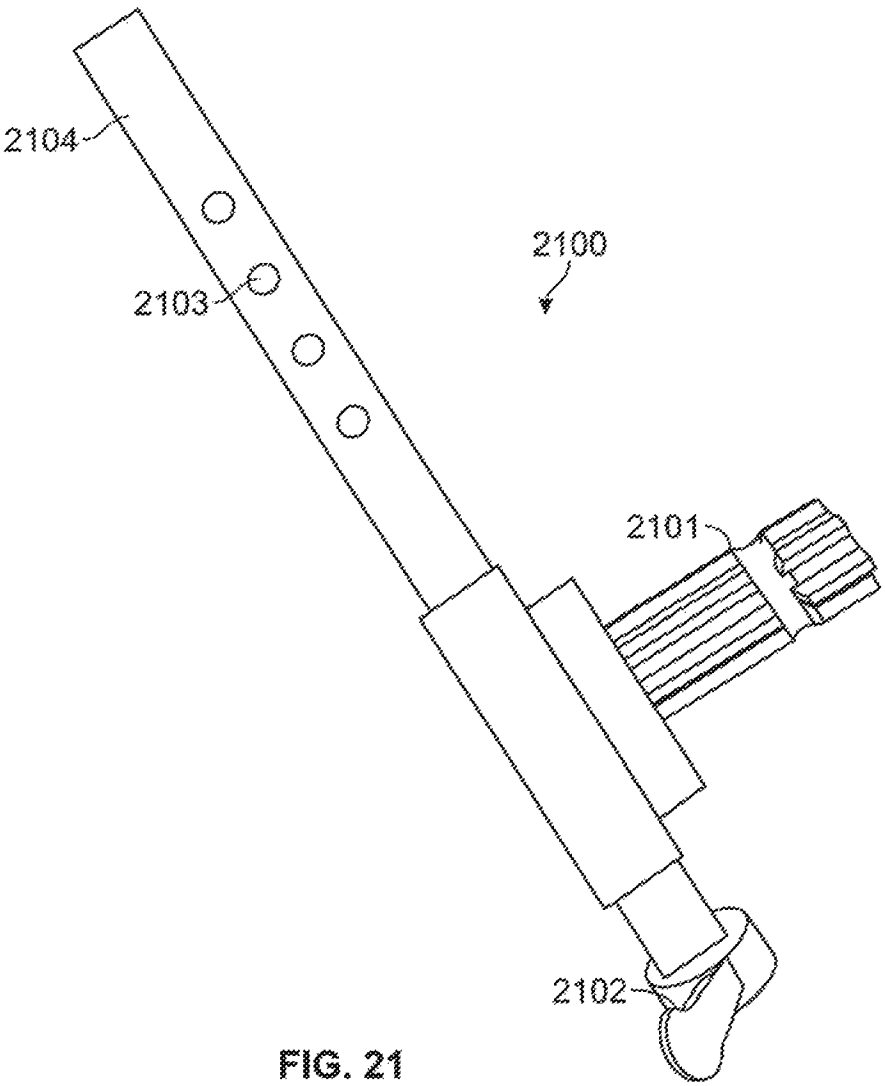
FIG. 21 is a perspective view of an embodiment of an attachment extension.

Referring to FIG. 21, in one embodiment attachment extension 2100, comprises attachment extension port plug 2101, which is optionally attachable to attachment extension port 1302 (not shown in FIG. 21), and optionally further comprises attachment counterweight lock 2102, which optionally secures an attachment counterweight 2601 (not shown in FIG. 21) onto attachment extension 2100, and optionally further comprises attachment securing holes 2103, which allow for the insert of attachment lock pin 2202 (not shown in FIG. 21) onto the attachment extension 2100, and optionally further comprises attachment extension shaft 2104, which inserts into attachment extension shaft receiver 2201 (not shown in FIG. 21). Preferably when attachment extension 2100 is installed into attachment extension port 1302, a person can rotate attachment extension 2100 around attachment extension port axis of rotation 1400 (not shown in FIG. 2100) in order to lift weights 14.

Figure 22:
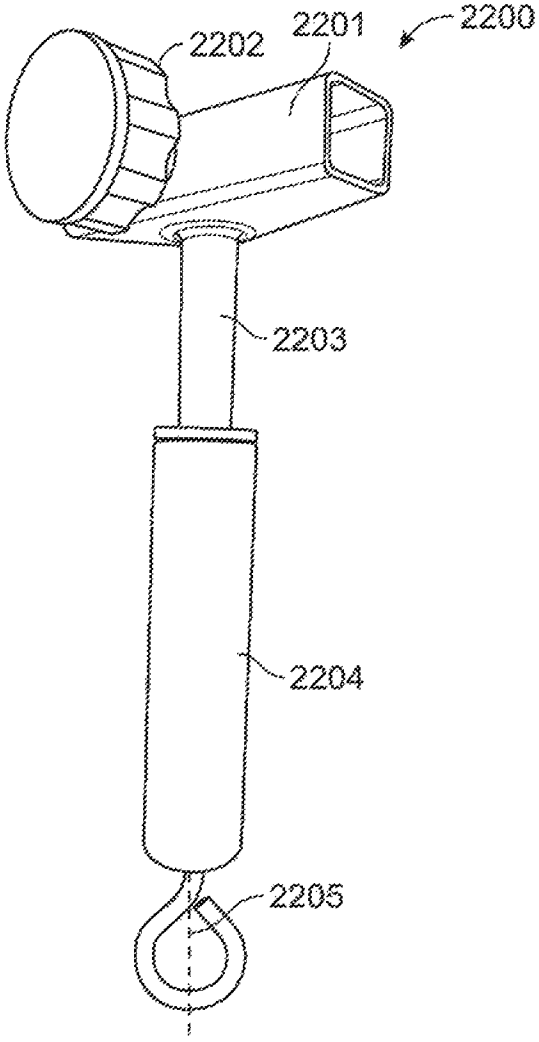
FIG. 22 is a perspective view of an embodiment of a free spinning grip attachment.

Referring to FIG. 22, in one embodiment, free spinning grip attachment 2200, optionally comprises attachment extension shaft receiver 2201, which optionally slides over attachment extension shaft 2104 (not shown in FIG. 22), and optionally comprises attachment lock pin 2202, which inserts into attachment securing holes 2103 (not shown in FIG. 22), and optionally comprises attachment axle 2203, which is optionally secured to attachment extension shaft receiver 2201, and optionally further comprising free spinning grip 2204, which has bearings (not shown) positioned in between free spinning grip 2204, and attachment axle 2203, causing free spinning grip 2204, to spin freely on free spinning grip axis of rotation 2205. Optionally, securing free spinning grip attachment 2200 onto attachment extension 2100, and then securing the attachment extension shaft receiver 2201 to the attachment extension port 1302 (not shown in FIG. 22), preferably results in free spinning grip axis of rotation 2205, to be parallel to attachment extension port axis of rotation 1400 (not shown in FIG. 22).

In different embodiments of the present invention the angle between the attachment axle 2203 and the attachment extension shaft receiver 2201 is not 90 degrees, resulting in the free spinning grip attachment 2200, when it is installed onto rotational resistance exercise device (not shown), having a free spinning grip axis of rotation 2205 that is not parallel to attachment extension port axis of rotation 1400. The free spinning grip axis of rotation 2205 can be other than parallel to the attachment extension port axis of rotation, depending on what angle is between the attachment axle 2203 and the attachment extension shaft receiver 2201. In other embodiments of the present invention, a user could adjust the rotational resistance assembly 1300 to a waist level position, and tilt the tilting hub 1211 to be facing the sky, then insert an attachment extension 2100 into the attachment extension port 1302, and attach a free spinning grip attachment 2200 onto the attachment extension 2100, preferably resulting in the free spinning grip axis of rotation 2205 pointing up towards the sky directly in front of the user who then can grasp the free spinning grip 2204 with their hand and rotate it around the attachment extension port axis of rotation 1400 in order to exercise against the resistance offered by the multi-function rotational resistance exercise apparatus 1200.

Figure 23:
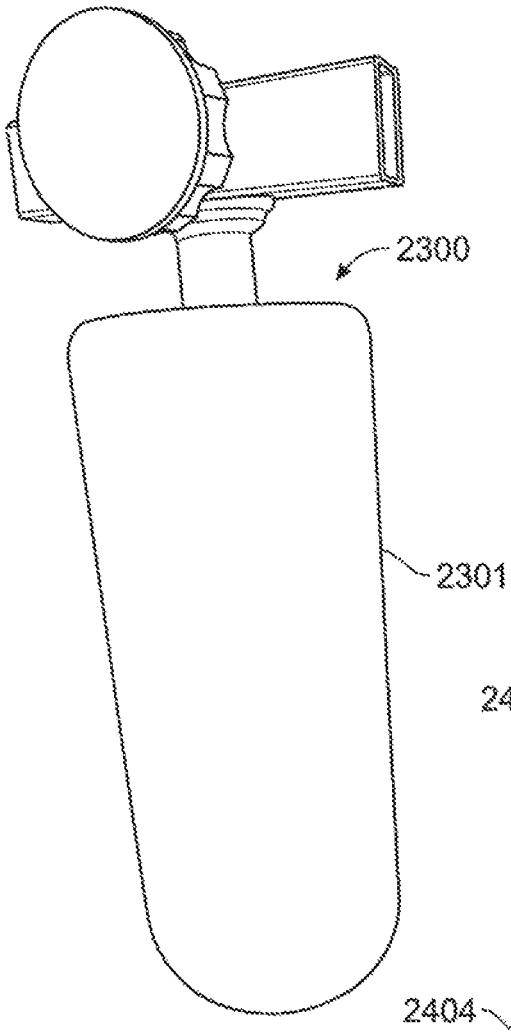
FIG. 23 is a perspective view of an embodiment of a free spinning pad attachment.

Referring to FIG. 23, in one embodiment, free spinning pad attachment 2300, optionally comprises a construction similar to free spinning grip attachment 2200, with the optional exception that free spinning pad 2301 is used in place of free spinning grip 2204 (not shown in FIG. 23). Free spinning pad attachment 2300 can optionally be installed onto an attachment extension 2100 in the same way that the free spinning grip attachment 2200, then that assembly of the two can be installed onto a multi-function rotational resistance exercise apparatus 1200. Once the free spinning pad attachment is installed onto the multi-function rotational resistance exercise apparatus 1200, a person can perform a very wide variety of exercises by moving the free spinning pad 2301 around the attachment extension port axis of rotation 1400 with their choice of personal body part such as the arm, leg, torso, or head. For instance, a person could perform neck flexion exercises against resistance by utilizing the free spinning pad attachment 2300 by standing next to the installed free spinning pad attachment and resting their forehead onto the free spinning pad 2301 and moving their forehead down towards their chest while the multi-function rotational resistance exercise apparatus 1200 offers the user resistance to exercise against.

Figure 24:
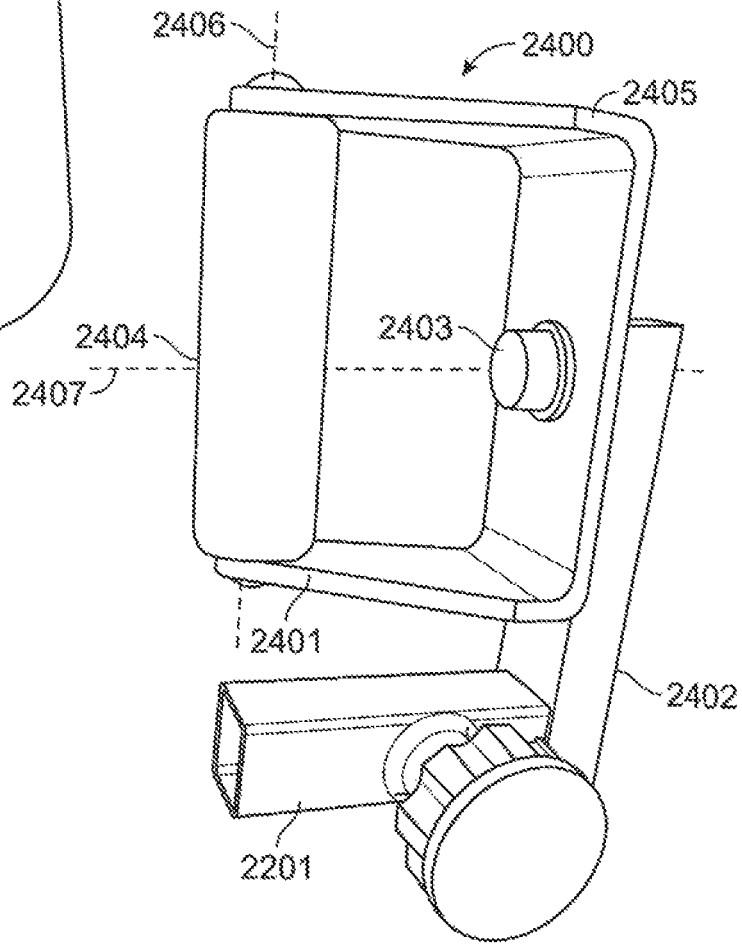
FIG. 24 is a perspective view of an embodiment of a free spinning pad attachment.

Referring to FIG. 24, in one embodiment, free spinning grip attachment 2400 optionally comprises offset grip twist assembly 2401 which is rotatably mounted with axle 2403 passing through attachment extension shaft receiver flange 2402. Offset grip twist assembly 2401 preferably comprises attachment extension shaft receiver flange 2402 mounted in a rigid fashion to its surface at an angle relative to attachment extension shaft receiver 2201. Offset grip twist assembly 2401 optionally comprises grip 2404, mounted onto offset bracket 2405, and optionally offset bracket 2405 secures grip 2404 into a position such that grip axis of rotation 2406, does not pass through axle axis of rotation 2407. In another embodiment the free spinning grip attachment 2400 is secured to an attachment extension 2100 by sliding the attachment extension shaft receiver 2201 over the attachment extension shaft 2104 and locking it into place, then a user can optionally attach these together as one unit onto a multi-function rotational resistance exercise apparatus 1200, which has the rotational resistance assembly 1300 set to the height of their elbow and the attachment extension port axis of rotation 1400 set to an upward angle, the user then can preferably place their elbow over the attachment extension port axis of rotation 1400 and grasp the grip 2404 with their hand, then the user will rotate the grip 2404 around the attachment extension port axis of rotation 1400 in order to exercise against the resistance while being free to rotate their wrist in an independent axle axis of rotation 2407, furthermore the user will preferably be exercising their arm and/or shoulder in an internal and/or external rotation motion.

Figure 25:
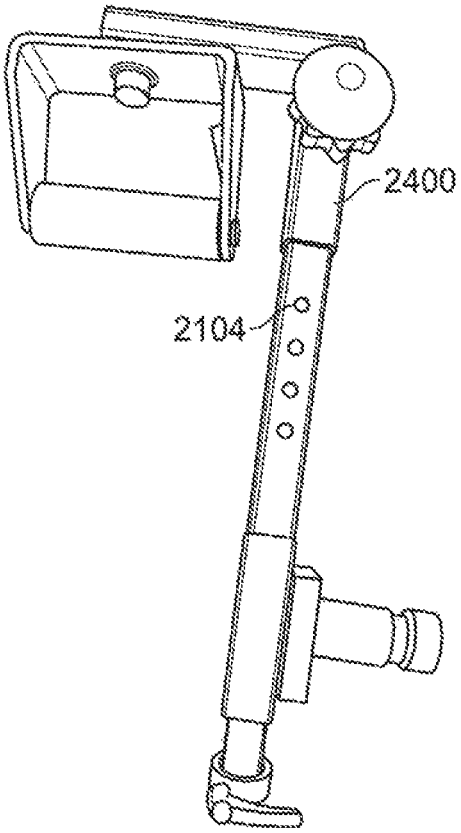
FIG. 25 is a perspective view of an embodiment of a free spinning grip attachment mounted on an attachment extension shaft.

Referring to FIG. 25, in another embodiment, free spinning grip attachment 2400, is attached to attachment extension shaft 2104.

Figure 26:
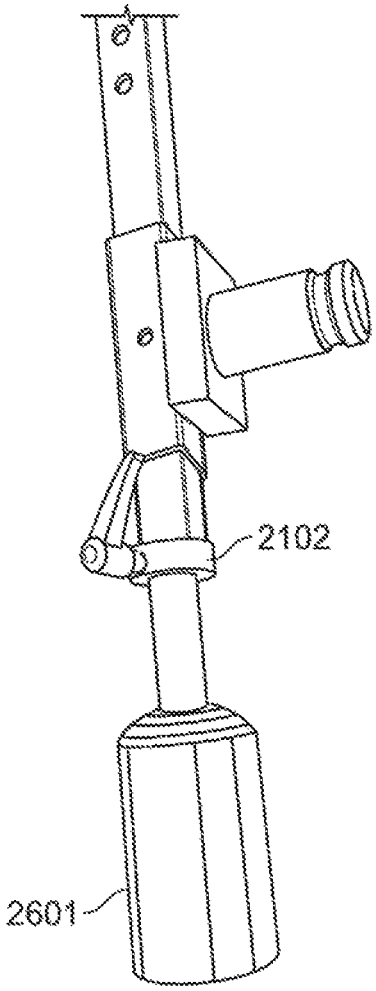
FIG. 26 is a perspective view of an embodiment of an attachment extension and an attachment extension counterweight.

Referring to FIG. 26, in one embodiment, attachment extension counterweight 2601 is installed into attachment extension counterweight lock 2102.

Figure 27:
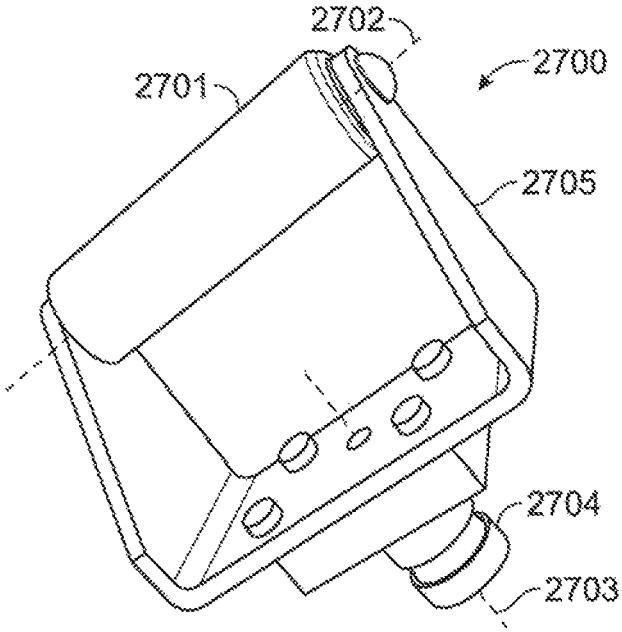
FIG. 27 is a perspective view of an embodiment of a grip twist attachment.

Referring to FIG. 27, in one embodiment, grip twist attachment 2700 optionally comprises grip area 2701 which has a grip area axis of rotation 2702. Grip area 2701 is held in a position by offset flange 2705, such that attachment extension port plug axis of rotation 2703 does not intersect grip area axis of rotation 2702. Optionally attachment extension port plug 2704 is attachable to attachment extension port 1302 (not shown), such that preferably when a person rotates grip twist attachment 2700 around attachment extension port axis of rotation, they rotate resistance force translator 1301 (not shown in FIG. 27). Optionally when a person installs grip twist attachment 2700 onto a multi-function rotational resistance exercise apparatus 1200 they will adjust the rotational resistance assembly 1300 to a height near the height of their shoulder, and direct the attachment extension port axis of rotation 1400 horizontally towards their shoulder, then the user will grasp the grip area 2701 with their hand and rotate their arm internally or externally in order to exercise their various muscles against the resistance of the multi-function rotational resistance exercise apparatus 1200.

In another embodiment of a grip twist attachment, the attachment extension port plug axis of rotation 2703, does intersect the grip area axis of rotation 2702.

Figure 28:
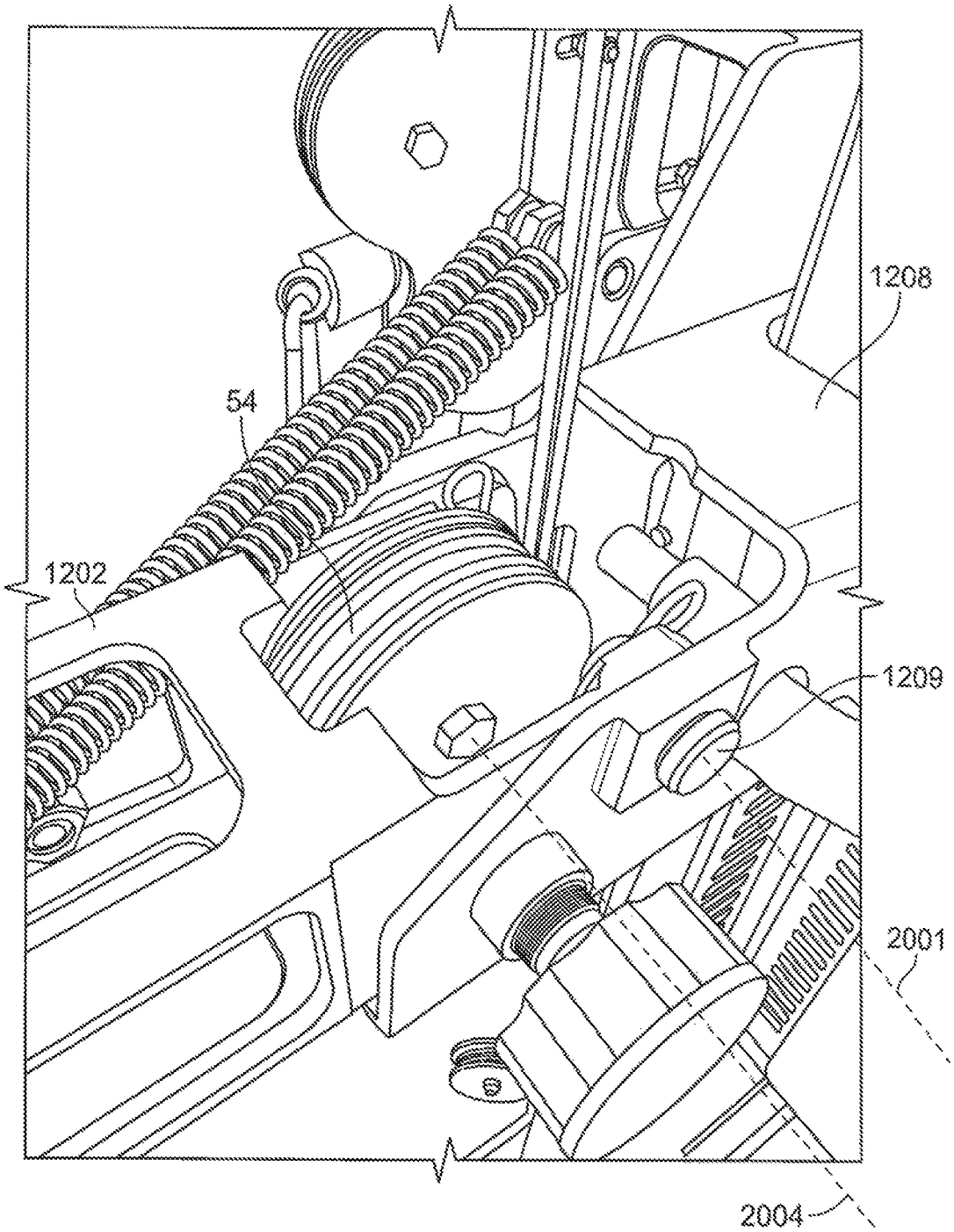
FIG. 28 is a closer view of an embodiment of the main arm and first pulley.

Referring to FIG. 28, in one embodiment, main arm 1202 is rotatably mounted to main arm carriage 1208 with main arm pins 1209. First pulley 54 has first pulley axis of rotation 2004, and main arm pins 1209 have axis of rotation of main arm pins 2001 and the two axes of rotation are not coincidental. First pulley 54 is preferably mounted to main arm 1202 such that when main arm 1202 rotates around the axis of rotation of main arm pins 2001 first pulley 54 will be moved in circular path around the axis of rotation of main arm pins 2001. In another embodiment, the two axes of rotation are coincidental.

Figure 29:
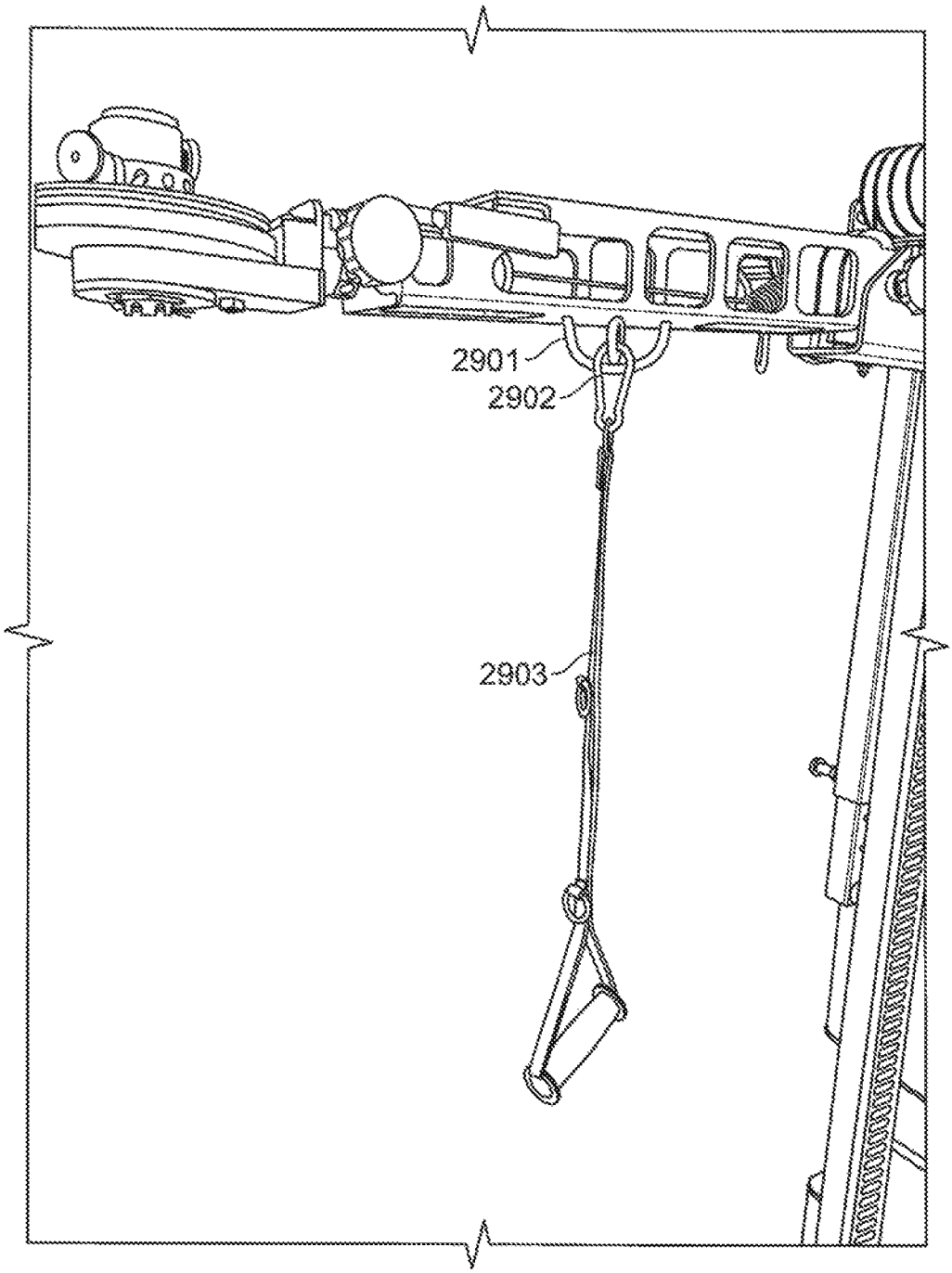
FIG. 29 is a perspective view of an embodiment of an attachment point.

Referring to FIG. 29, in one embodiment, attachment point 2901 is secured to main arm 1202 and preferably is providing a location for a person to safely secure, for example, carabiner 2902, and/or a rope 2903. In another embodiment, attachment point 2901 is secured to a different part of the invention. Attachment point 2901 allows a person to perform commonly known suspension exercises by pulling or pressing on rope 2903 which is attached to attachment point 2901. Main arm 1202 is preferably constructed in such a way that it is able to support the weight of a person safely without collapsing thus providing a safe structure from which to attach rope 2903 and then rest their body weight onto rope 2903. Multi-function rotational resistance exercise apparatus 1200 supports main arm 1202 in such a way that the multi-function rotational resistance exercise apparatus 1200 will not move from its position when a person rests their weight onto or hangs their weight from main arm 1202. In another embodiment, a user's body weight can be safely suspended from the attachment point 2901, without damage to the overall invention, or movement of the overall invention.

Figure 30:
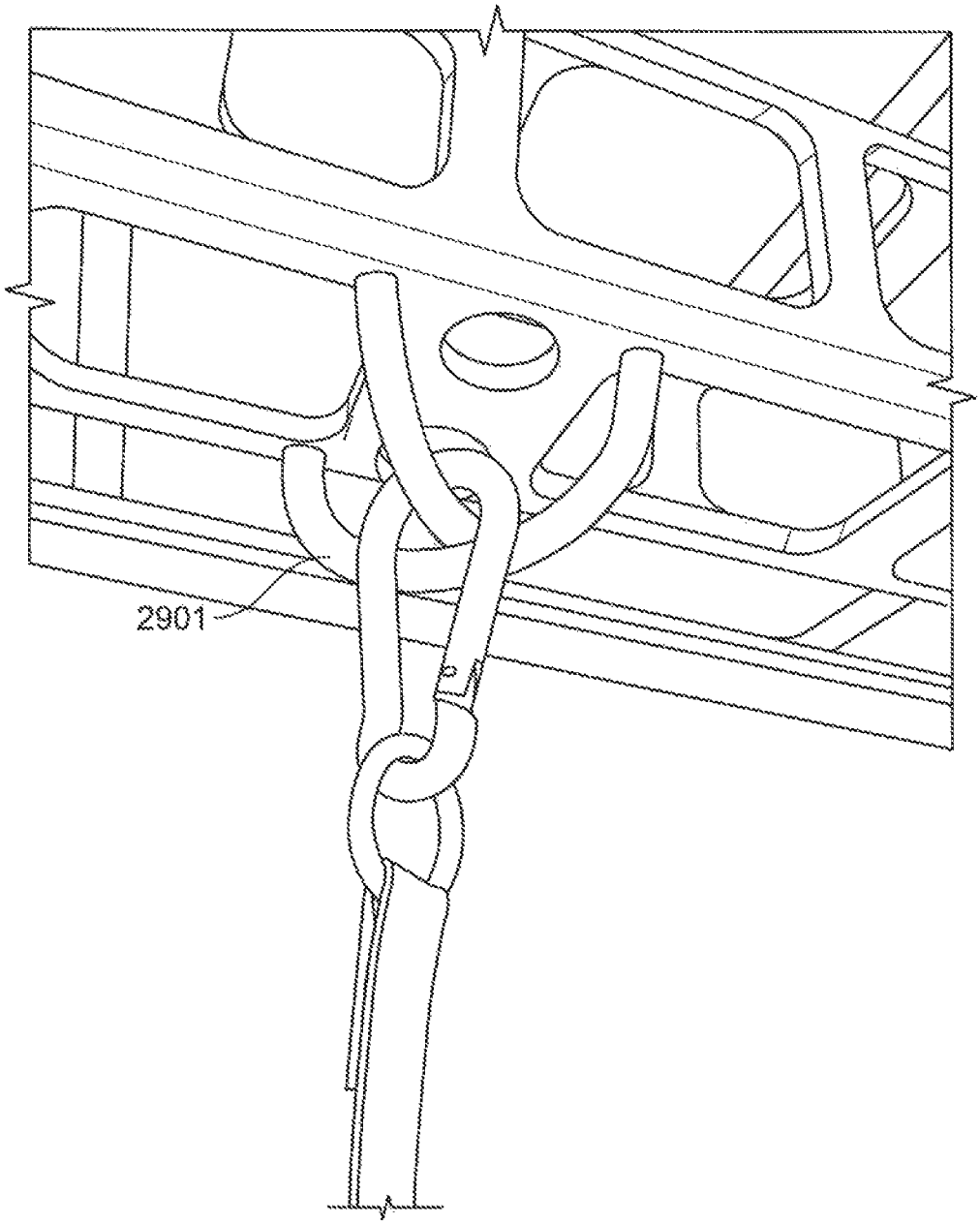
FIG. 30 is a closer view of an embodiment of an attachment point.

Referring to FIG. 30, attachment point 2901 provides multiple features for a person to utilize. A person could attach a common carabiner onto attachment point 2901, or thread a rope through attachment point 2901, or even attach a hook to attachment point 2901. Attachment point 2901 is preferably a ridged structure designed to accept a plurality of common devices attached to it preferably with the intent of providing a person a secure and stable structure to push or pull on for exercise purposes without the structure moving from its place.

Figure 31:
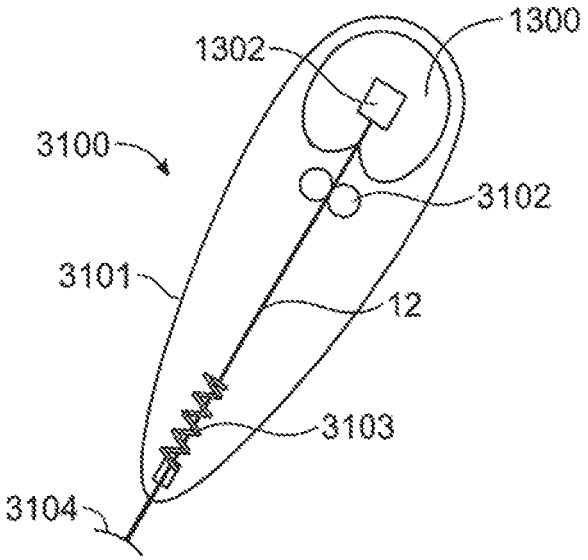
FIG. 31 is a top view of an embodiment of a rotational resistance exercise apparatus within a housing.

Referring to FIG. 31, in one embodiment, a rotational resistance exercise apparatus 3100 comprises housing 3101. Contained within housing 3101 are features such as pulleys 3102, which are rotatably mounted to housing 3101, and optionally also within housing 3101 a rotational resistance assembly 1300, which is rotatably mounted to the housing. Preferably contained within the housing is cable 12, which preferably attaches to spring 3103 at one end and attaches to rotational resistance assembly 1300 at the other end. Spring 3103 attaches at one end to spring tension adjuster 3104, such that when spring tension adjuster 3104 it rotated, it will tighten or loosen the tension on spring 3103. Attachment extension port 1302 extends outside housing 3101, preferably providing access for a user to attach a type of attachment for exercise. Preferably when attachment extension port 1302 is rotated by a user, cable 12 will be wrapped around the perimeter of rotational resistance assembly 1300, and spring 3103 will be stretched by the movement of cable 12, thus giving the user resistance for exercise. In one embodiment a user will secure the rotational resistance exercise apparatus 3100 to a solid structure such as a door frame or a table by means of a mounting system (not shown), such that the rotational resistance exercise apparatus 3100 does not move about, then the user will attach their choice of attachment, such as an attachment extension 2100 to the attachment extension port 1302, then attach an attachment such as a free spinning pad attachment 2300 to the attachment extension 2100, then they can work against the resistance provided by the rotational resistance exercise apparatus 3100 by rotating the attachment extension port 1302 clockwise or counterclockwise by moving the various attachments. The adjustable tension on spring 3103 will allow a person to choose how much resistance they want to exercise against. Preferably when a person rotates attachment extension port 1302, the rotational resistance assembly 1300 will rotate as well causing the cable 12 to wrap around the periphery of rotational resistance assembly 1300, while simultaneously causing cable 12 to by pulled away from spring 3103, and preferably cable 12 will elongate spring 3103 which is attached at one end to cable 12, and at the other end attached to spring tension adjuster 3104, while spring tension adjuster 3104 is secured by screw threads to the housing 3101. In another embodiment the rotational resistance exercise apparatus 3100 is a rotational resistance assembly which can optionally be used within a multi-function rotational resistance exercise apparatus 1200.

In another embodiment, the spring 3103 is mounted directly to housing 3101 and optionally spring tension adjuster 3104 is not present.

In another embodiment spring 3103 is interchangeable.

Figure 32:
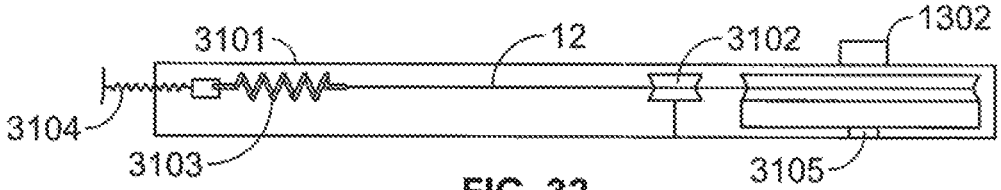
FIG. 32 is a side view of an embodiment of a rotational resistance exercise apparatus within a housing.

Referring to FIG. 32, a side view of FIG. 31 is shown with spring tension adjuster 3104 threaded into the side of the housing 3101 such that when it is rotated, it extends or retracts spring 3103. Bearings 3105 secure the rotational resistance assembly 1300 rotatably to housing 3101. Attachment extension port 1302 optionally extends outside housing 3101, and optionally pulley 3102 guides cable 12 around the periphery of rotational resistance assembly 1300.

Figure 33:
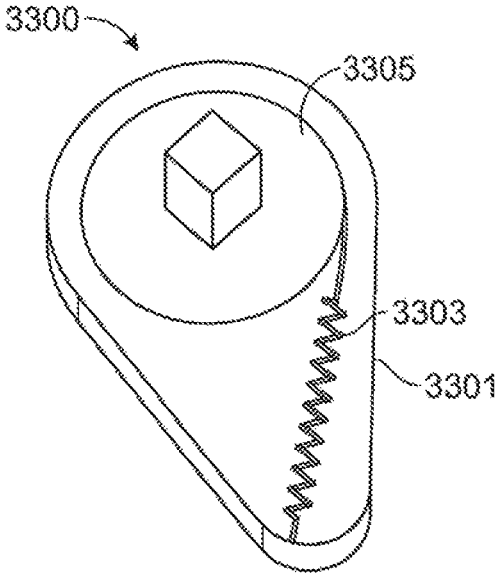
FIG. 33 is a perspective view of an embodiment of a rotational resistance exercise apparatus within a housing.

Referring to FIG. 33, in one embodiment, preferably a rotational resistance exercise apparatus 3300 within a housing 3301 comprises spring 3303, mounted at one end to housing 3301, and to the rotational resistance assembly 3305 at the other end. In another embodiment rotational resistance exercise apparatus 3300 is a rotational resistance assembly which can optionally be used within a multi-function rotational resistance exercise apparatus 1200.

In another embodiment, optionally spring 3303 is mounted to rotational resistance assembly 3305 at one end, and to a spring tension adjuster (not shown) at the other end.

Figure 34:
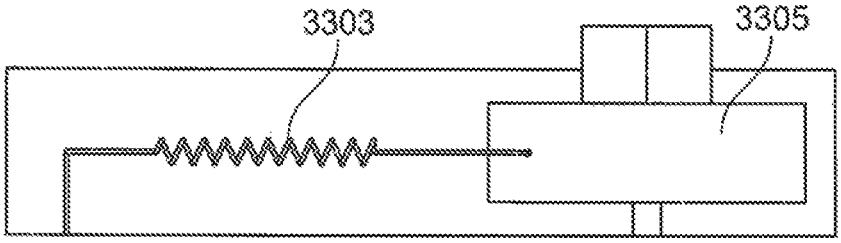
FIG. 34 is a side view of an embodiment of a rotational resistance exercise apparatus within a housing.

Referring to FIG. 34, spring 3303 wraps around the perimeter of rotational resistance assembly 3305 when rotational resistance assembly 3305 is rotated by a user.

In another embodiment, flexible material (not shown) is used in place of spring 3103.

Figure 35:
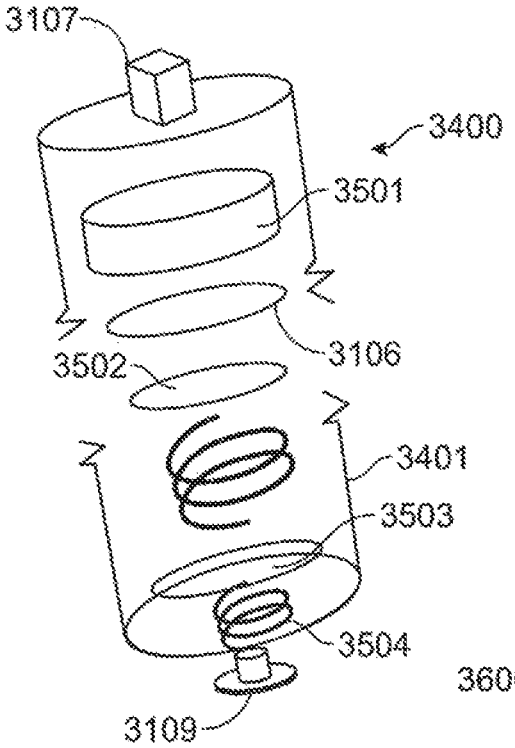
FIG. 35 is an exploded view of an embodiment of a rotational resistance exercise apparatus within a housing.

Referring to FIG. 35, optionally an embodiment of rotational resistance exercise apparatus 3400 comprises a housing 3401, and friction material 3106, which provides resistance for a user when they rotate resistance output shaft 3107. Resistance output shaft 3107 is where a person can attach an attachment of their choice (not shown). Optionally tension adjuster 3109, when rotated, will press the friction material 3106 sandwiched between friction components 3501, 3502, and 3503 via springs 3504 against resistance output shaft 3107 thus causing resistance to the rotation of resistance output shaft 3107. Optionally, tension adjuster 3109 is threaded into housing 3101, and resistance output shaft 3107 is rotatably mounted to housing 3101 with a portion of resistance output shaft 3107 extending outside housing 3101. A person could optionally secure housing 3401 to a stationary object such as a piece of furniture, or a feature in their home by means of a clamping system, or screws, such that when they exercise by rotating resistance output shaft 3107 by means of an attachment (not shown), the rotational resistance exercise apparatus 3400 will not move as a whole, but the housing 3401 will be held in place, while the internal parts rotate and provide resistance to the user's effort. In another embodiment the rotational resistance exercise apparatus 3400 is a rotational resistance assembly which can optionally be used within a multi-function rotational resistance exercise apparatus 1200.

Figure 36:
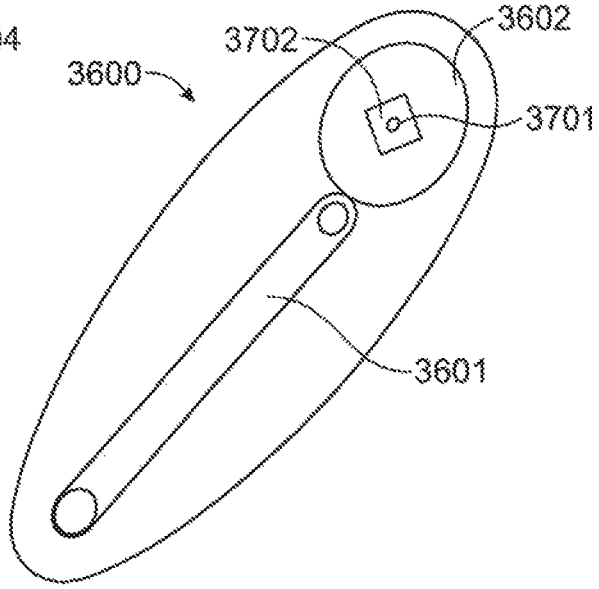
FIG. 36 is a top view of an embodiment of a rotational resistance exercise apparatus within a housing.

Referring to FIG. 36, optionally an embodiment of a rotational resistance exercise apparatus 3600 comprises a housing and a flexible material 3601 which is attached to the housing at one end, and attached to wheel 3602 at the other end. When wheel 3602 is rotated about the wheel axis of rotation 3701, flexible material 3601 is wrapped around the perimeter of wheel 3602. Wheel 3602 is rotatable mounted to the housing. Wheel 3602 optionally comprises protrusion 3702 which extends outside the housing. In another embodiment the rotational resistance exercise apparatus 3600 is a rotational resistance assembly which can optionally be used within a multi-function rotational resistance exercise apparatus 1200.

Optionally protrusion 3702 provides a place a person can secure an attachment (not shown) to the wheel.

Figure 37:
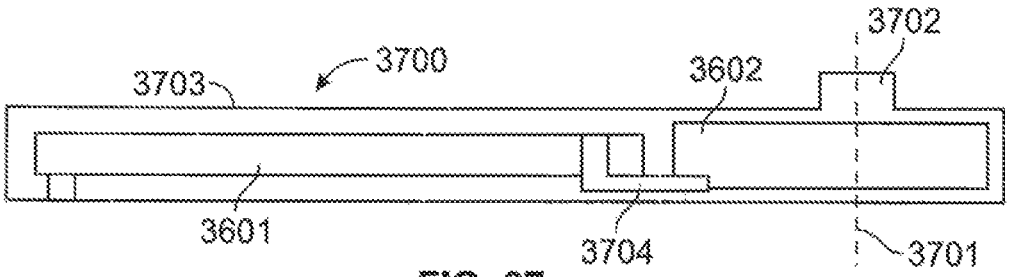
FIG. 37 is a top view of an embodiment of a rotational resistance exercise apparatus within a housing.

Referring to FIG. 37, optionally an embodiment of a rotational resistance exercise apparatus 3700 comprising housing 3703 comprises wheel axis of rotation 3701. Connecting an attachment (not shown) to protrusion 3702 will allow a user to rotate wheel 3602. Wheel 3602 is preferably connected to flexible material 3601 with connecting link 3704. Flexible material 3601 is connected to housing 3101 at an opposite end. When a person rotates the attachment (not shown) the rotational resistance experienced will be around the wheel axis of rotation 3701. In one embodiment, an attachment is attachment extension 2100 (shown in FIG. 21). In another embodiment the rotational resistance exercise apparatus 3700 is a rotational resistance assembly which can optionally be used within a multi-function rotational resistance exercise apparatus 1200.

Figure 38:
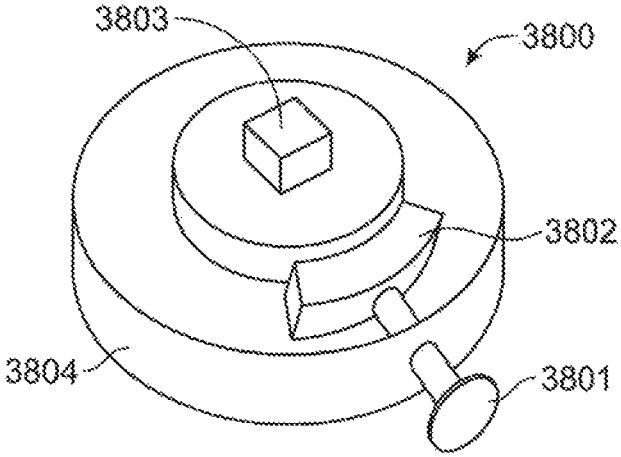
FIG. 38 is a perspective view of an embodiment of a rotational resistance exercise apparatus within a housing.

Referring to FIG. 38, in one embodiment, a rotational resistance exercise apparatus 3800 inside housing 3804 comprises tension adjustment screw 3801 threaded into housing 3804. Preferably friction material 3802 is pressed into rotational resistance output 3803 by a user rotating tension adjustment screw 3801. Rotational resistance output 3803 is rotatably mounted to housing 3804. When a user rotates the rotational resistance output 3803, they will work against the friction of the apparatus. Rotational resistance output 3803 preferably allows a person to attach a choice or exercise attachments. Optionally a person could secure housing 3804 to a stationary object by means of a clamp, screw, or a weld (not shown), then they can attach a mechanism such as is shown in FIG. 25 to the rotational resistance output 3803 and rotate the attachment around the axis of rotation of rotational resistance output 3803 in order to work against the resistance offered by the rotational resistance exercise apparatus 3800. By mounting the rotational resistance exercise apparatus 3800 to stationary objects at different angles or heights, such as an overhead door frame, or a table top, a user can achieve a plurality of positions which are advantageous to exercising different parts of the body. In another embodiment the rotational resistance exercise apparatus 3800 is a rotational resistance assembly which can optionally be used within a multi-function rotational resistance exercise apparatus 1200.

Figure 39:
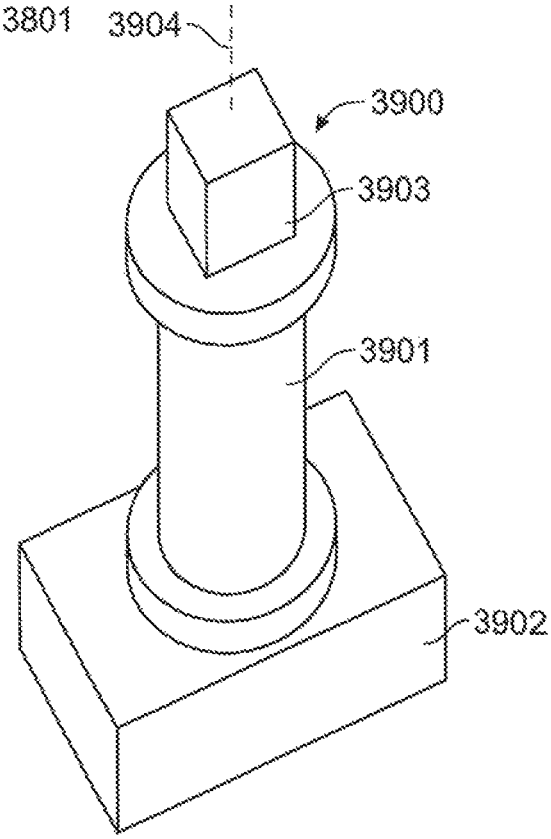
FIG. 39 is a perspective view of an embodiment of a rotational resistance exercise apparatus in a resting state.

Referring to FIG. 39, in one embodiment, a rotational resistance exercise apparatus 3900 comprises flexible material 3901, which is attached at one end to a base 3902 and optionally attached at the other end to attachment connecting point 3903. Optionally, flexible material axis of rotation 3904 is the axis around which a person could rotate attachment connecting point 3903 and cause a twisting effect upon flexible material 3901. The twisting effect preferably gives the user rotational resistance to work against. In one embodiment, base 3902 is held stationary by a frame (not shown). In another embodiment, the frame (not shown) is adjustable to secure it to a fixed object. In another embodiment the rotational resistance exercise apparatus 3900 is a rotational resistance assembly which can optionally be used within a multi-function rotational resistance exercise apparatus 1200.

Figure 40:
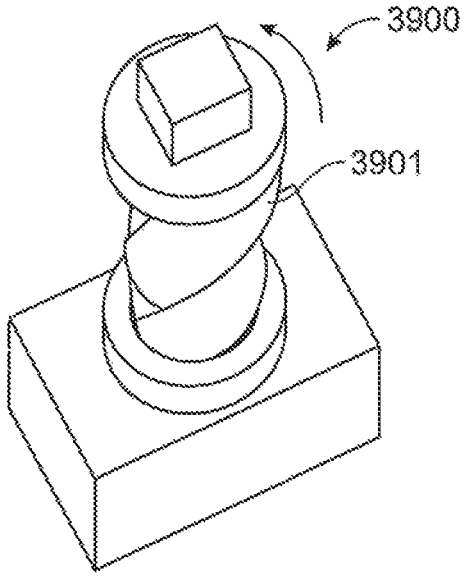
FIG. 40 is a perspective view of an embodiment of a rotational resistance exercise apparatus within a housing in a rotated position.

Referring to FIG. 40, in one embodiment, rotational resistance exercise apparatus 3900 optionally comprises flexible material 3901 which becomes deformed when it is rotated counterclockwise as depicted by the directional arrow.

Figure 41:
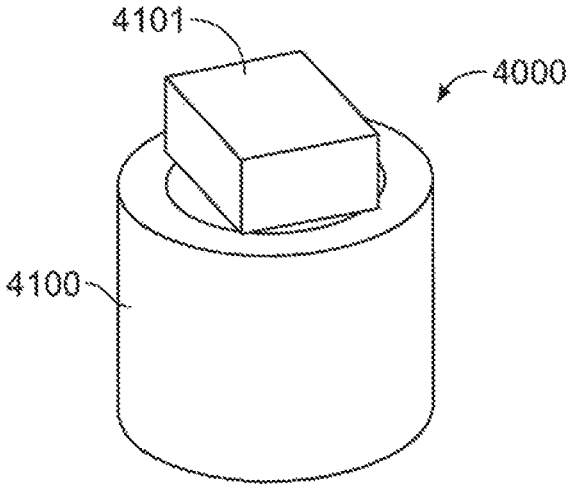
FIG. 41 is a perspective view of an embodiment of a rotational resistance exercise apparatus within a housing.

Referring to FIG. 41, in one embodiment, rotational resistance exercise apparatus 4000 comprises housing 4100, which comprises resistance output 4101 rotatably mounted on it. Optionally, within the housing is an electrically operated rotational resistance source (not shown). The electrically operated rotational resistance source (not shown) is mounted within housing 4100. The electrically operated rotational resistance source (not shown) resists the rotation of resistance output 4101. When a person tries to rotate resistance output 4101, the electrically operated rotational resistance source (not shown) will resist their rotational effort in an opposing direction. Preferably, the result of attempting to rotate resistance output 4101 results in a beneficial exercise for the user. Preferably, an attachment can be mounted onto resistance output 4101. The electrically operated rotational resistance source can be any device, such as a stepper motor, a magnetic motor, an electric motor, or a hydraulic motor. Additional programming and hardware are preferably incorporated to the rotational resistance exercise apparatus in order to give the user a desired level of resistance which may be constant or variable. In another embodiment the rotational resistance exercise apparatus 4000 is a rotational resistance assembly which can optionally be used within a multi-function rotational resistance exercise apparatus 1200.

Figure 42:
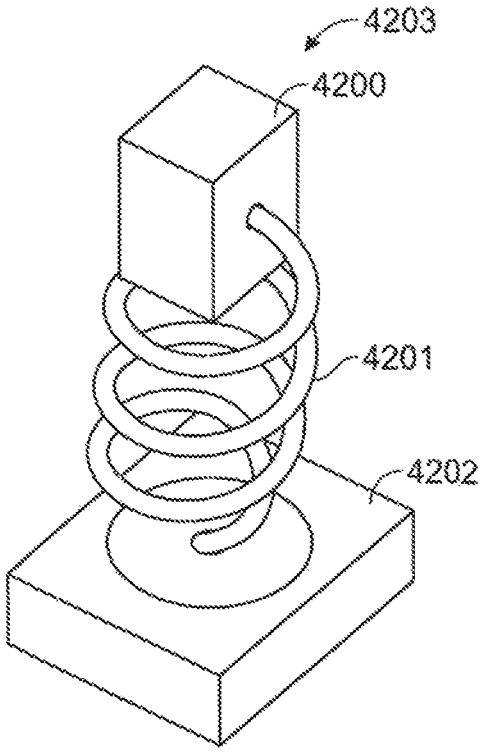
FIG. 42 is a perspective view of an embodiment of a rotational resistance exercise apparatus within a housing.

Referring to FIG. 42, in one embodiment, rotational resistance exercise apparatus 4203 optionally comprises attachment location 4200 connected to one end of torsion spring 4201, and optionally torsion spring 4201 is connected at the other end to base 4202. Rotating attachment location 4200 preferably results in torsion spring 4201 being temporarily deformed, and the torsion spring 4201 exerting a rotational force which opposes the user's force. Optionally, base 4202 will be held stationary. Optionally, attachment location 4200 secures to an attachment (not shown). Optionally, base 4202 secures to a stationary object by, for example, a clamp (not shown), etc. In another embodiment the rotational resistance exercise apparatus 4203 is a rotational resistance assembly which can optionally be used within a multi-function rotational resistance exercise apparatus 1200.

Figure 43:
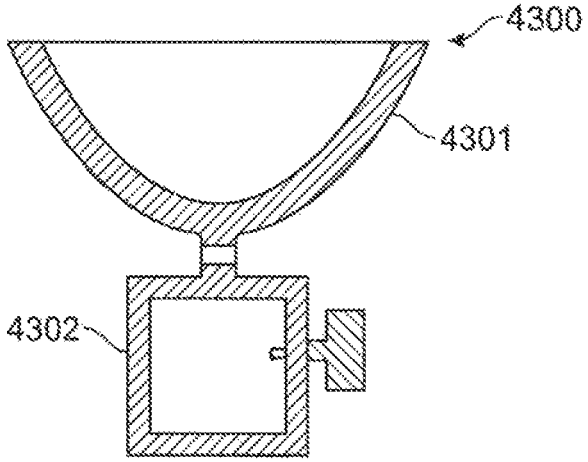
FIG. 43 is a sectional view of an embodiment of a free spinning dish attachment.

Referring to FIG. 43, in one embodiment, free spinning dish attachment 4300 comprises dish 4301 which is optionally rotatably mounted onto attachment extension receiver 4302 by bearings (not shown) Optionally, attachment extension receiver 4302 is secured to an attachment extension (not shown). In another embodiment, free spinning dish attachment 4300 is mounted to attachment extension receiver 4302 in a non-rotatable fashion. When a person uses the free spinning dish attachment, it will be in a way similar to the free spinning grip attachment 2200. In other embodiments of the present invention, a user could adjust the rotational resistance assembly 1300, which is part of the multi-function rotational resistance exercise apparatus 1200, to a waist level position, and tilt the tilting hub 1211 to be facing the sky, then insert an attachment extension 2100 into the attachment extension port 1302, and attach a free spinning dish attachment 4300 onto the attachment extension 2100, preferably resulting in the free spinning dish axis of rotation (not shown) pointing up towards the sky directly in front of the user who then can place their hand inside of the dish 4301 then their hand can rotate the free spinning dish attachment 4300 around the attachment extension port axis of rotation 1400 in order to exercise against the resistance offered by the multi-function rotational resistance exercise apparatus 1200. Their hand would be able to freely spin the dish 4301 in a manor independent from the rotation of the attachment extension port 1302.

Figure 44:
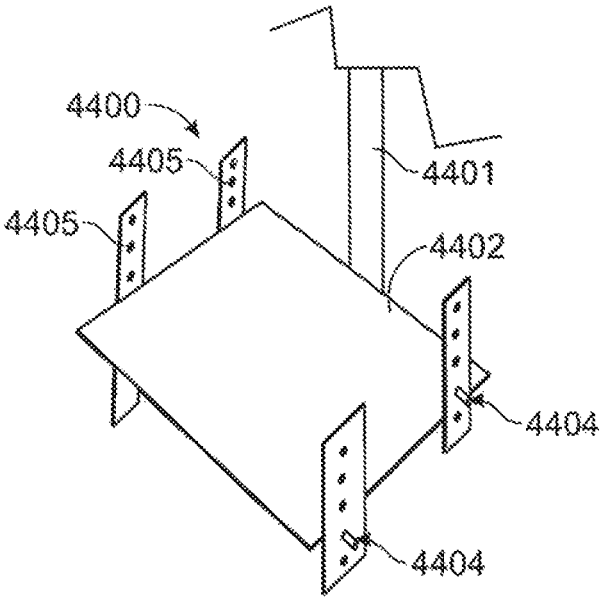
FIG. 44 is a perspective view of an embodiment of an adjustable standing platform.

Referring to FIG. 44, in one embodiment, adjustable standing platform 4400 preferably comprises frame 4401 which is connectable to a frame (not shown). Preferably, adjustable standing platform 4400 further comprises standing platform 4402, which is held at an elevation of choice by pins 4404, with the pins being held up by selection holes 4405. Standing platform 4400 optionally provides a place for a person to stand, sit or lay down upon at choice of elevation. Optionally the adjustable standing platform 4400 could be combined with any of the inventions mentioned here in order to elevate a person to a height that is desirable for a particular exercise. For instance in a case where parts of an apparatus are constructed in a way that they do not adjust for different elevations, a person could adjust the height of the adjustable standing platform 4400 in order to stand on it at different elevations, effectively changing their own personal elevation in order to exercise a particular part of their body.

Figure 45:
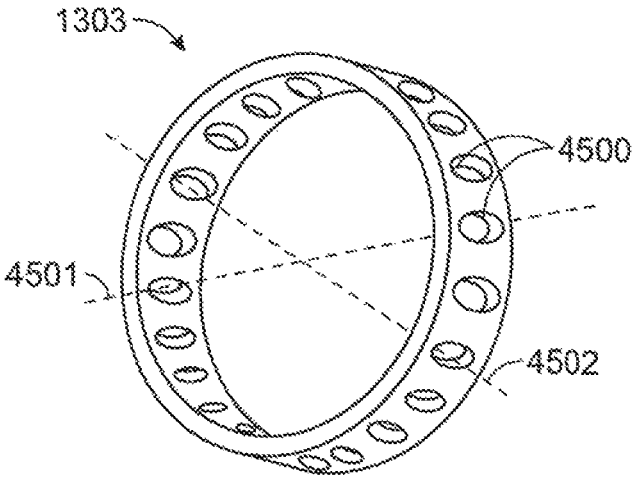
FIG. 45 is a perspective view of an embodiment of an attachment extension orientation ring.

Referring to FIG. 45, in one embodiment, attachment extension orientation ring 1303, optionally comprises attachment extension orientation ring holes 4500 which are oriented with the hole axis of rotation 4502, intersecting attachment extension orientation ring axis of rotation 4501.

Figure 46:
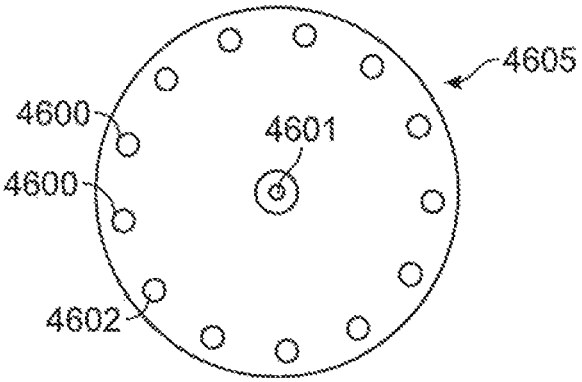
FIG. 46 is a front view of an embodiment of an attachment extension orientation ring.

Referring to FIG. 46, in one embodiment, attachment extension orientation ring 4605, similar to attachment extension orientation ring 1303 previously described, optionally comprises attachment extension orientation ring holes 4600, which are oriented with hole axis of rotation 4602 not intersecting attachment extension orientation ring axis of rotation 4601.

Figure 47:
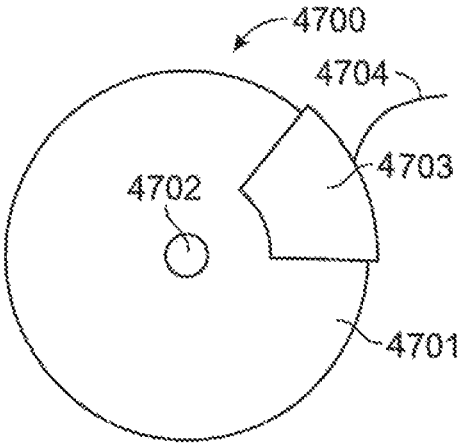
FIG. 47 is a front view of an embodiment of rotational resistance with friction.

Referring to FIG. 47, in one embodiment, rotational resistance with friction 4700 optionally comprises wheel 4701 which is rotatably mountable around center of rotation 4702, and further comprises friction material 4703 which presses against wheel 4701. Friction adjuster 4704 optionally adjusts the amount of force friction material 4703 places upon the wheel 4701. Wheel 4701 is preferably connectable to an attachment (not shown). When an attachment (not shown) rotates wheel 4701 the attachment will work against the friction produced by the pressure of friction material 4703 against wheel 4701. Rotational resistance with friction 4700 is similar to a common automobile brake rotor with a caliper and brake pad. Adjusting the pressure exerted by friction material 4703 upon wheel 4701 can be accomplished in many ways, one of which being a simple screw type tensioner (not shown).

Figure 48:
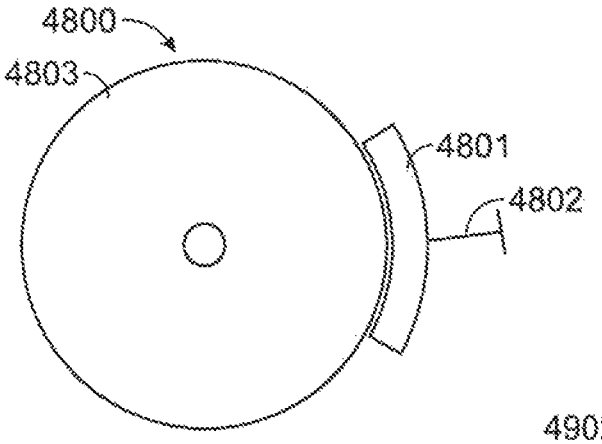
FIG. 48 is a front view of an embodiment of rotational resistance with friction.

Referring to FIG. 48, in one embodiment, rotational resistance with friction 4800 optionally comprises friction material 4801 which presses against the periphery of wheel 4803. The amount of pressure friction material 4801 places upon wheel 4803 is adjustable by friction pressure knob 4802. A person can attach their choice of exercise attachment (not shown) onto the wheel 4803 in a plurality of ways in order to cause wheel 4803 to rotate by the effort of rotating the exercise attachment (not shown), then the person will preferably experience resistance to their efforts caused by friction between the friction material 4801 and wheel 4803. The rotational resistance with friction 4800 could optionally be incorporated into a multi-function rotational resistance exercise apparatus 1200 in place of the weighted resistance (not shown).

Figure 49:
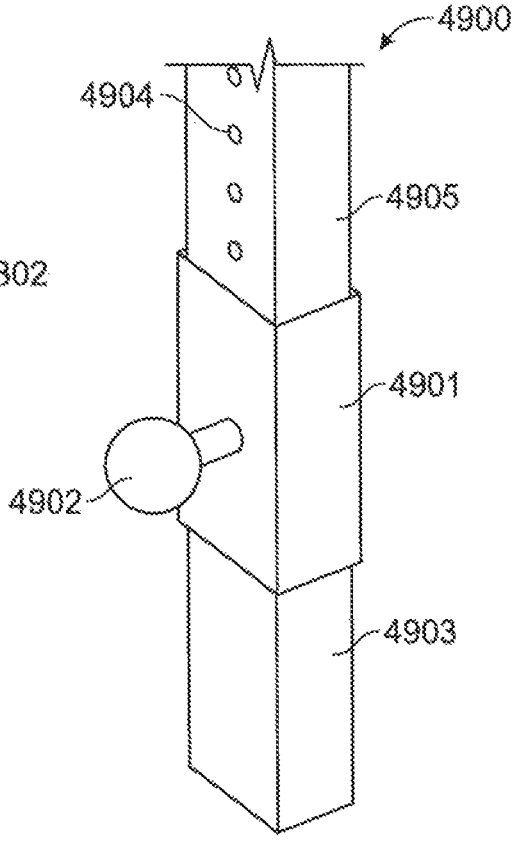
FIG. 49 is a perspective view of an embodiment of an attachment extension port extension.

Referring to FIG. 49, in one embodiment, attachment extension port extension 4900 optionally comprises attachment extension port plug 4903, which optionally inserts into an attachment extension port (not shown), and optionally is secured to attachment extension sleeve 4901. Attachment extension port extension 4900 further comprises extension arm 4905 which slides in and out of extension arm sleeve 4901, and further optionally comprises attachment extension lock 4902, which is secured to the extension arm sleeve 4901, and further optionally embodies extension arm selector holes 4904. Preferably by engaging attachment extension lock 4902 into extension arm selector hole 4904, extension arm 4905 will be supported in an extended position. Extension arm 4905 is optionally attachable to an attachment (not shown). Optionally a user will use attachment extension port extension 4900 in combination with other attachments in order to mount an attachment in a position which is further away from the attachment extension port than it would be otherwise. This new, further away, position will allow a user to perform exercises which may not be possible otherwise.

Figure 50:
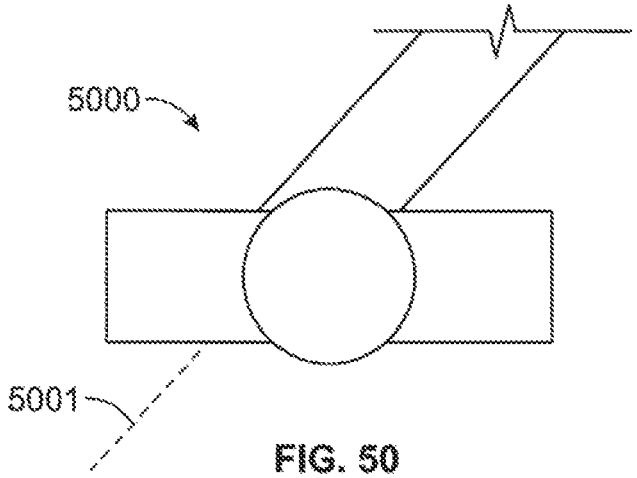
FIG. 50 is a front view of an embodiment of an off parallel axis attachment.

Referring to FIG. 50, in one embodiment, off parallel axis attachment 5000 preferably comprises an attachment which optionally attaches to an attachment extension such as extension 2100 previously described (not shown). Preferably, axis of rotation 5001 is in a direction not parallel to the axis of rotation of the rotational resistance (not shown).

Figure 51:
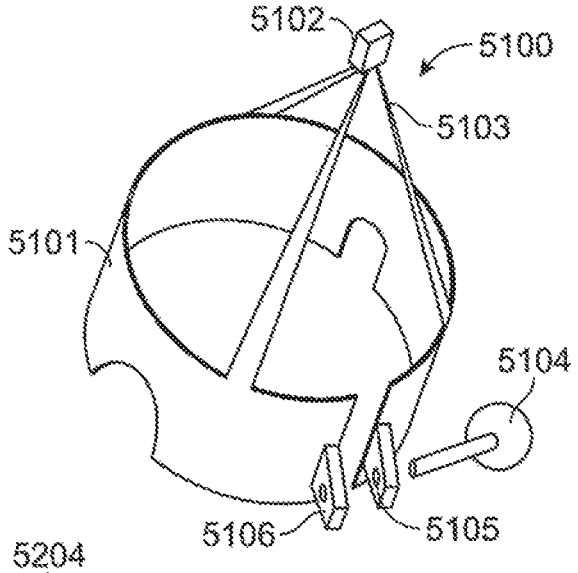
FIG. 51 is a perspective view of an embodiment of a head clamp attachment.

Referring to FIG. 51, in one embodiment, head clamp attachment 5100 optionally comprises head ring 5101, which preferably encompasses a person's head (not shown). Furthermore, head clamp attachment 5100 optionally comprises attachment extension port plug 5102 which is connected to head ring 5101 by, for example, head ring rails 5103, and is connectable to the rotational resistance exercise apparatus. Head clamp attachment 5100 optionally comprises size adjustment knob 5104 which passes through tab 5105 which is mounted on one side of head ring 5101, and threads into weld nut 5106 on the other side of head ring 5101. Preferably, when a person places their head into head ring 5101 and turns size adjustment knob 5104, they can tighten head ring 5101 onto their head. Preferably a user can secure head clamp attachment 5100 to multi-function rotational resistance exercise apparatus 1200 at the attachment extension port 1302, then secure head clamp attachment 5100 on their head then rotate their head side to side in order to exercise against the resistance of the apparatus. Optionally when a person secured a head clamp attachment 5100 to their head and connects the head clamp attachment 5100 to the rotational resistance exercise apparatus, they can work against the resistance of the apparatus by turning their head side to side as if they are giving the common gesture for "no" with their head.

Figure 52:
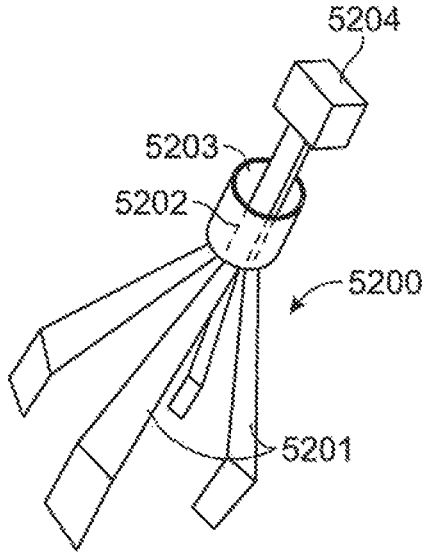
FIG. 52 is a perspective view of an embodiment of a head clamp attachment.

Referring to FIG. 52, in one embodiment, head clamp attachment 5200 optionally comprises attachment extension port plug 5204 which is mounted to head clamp rod 5203, and head clamp rod 5203 is optionally mounted to head clamp fingers 5201. Head clamp rod 5203 optionally has threads (not shown) around its exterior. Head clamp adjustment ring 5202 rotates around head clamp rod 5203 and threads along the threads of head clamp rod 5203. Preferably, when head clamp adjustment ring 5202 comes into contact with head clamp fingers 5201, head clamp fingers 5201 will come closer together or farther apart. Head clamp fingers 5201 preferably close against a person's head. When a person wearing the head clamp attachment 5200 upon their head rotates their head, head clamp attachment 5200 will rotate. Preferably a person will attach head clamp attachment 5200 to multi-function rotational resistance exercise apparatus 1200, then place their head inside of the head clamp fingers 5201 and rotate the head clamp adjustment ring 5202 in order to tighten the head clamp fingers against their head, then turn their head side to side in order to exercise the muscles of their body against the resistance of the multi-function rotational resistance exercise apparatus 1200.

Figure 53:
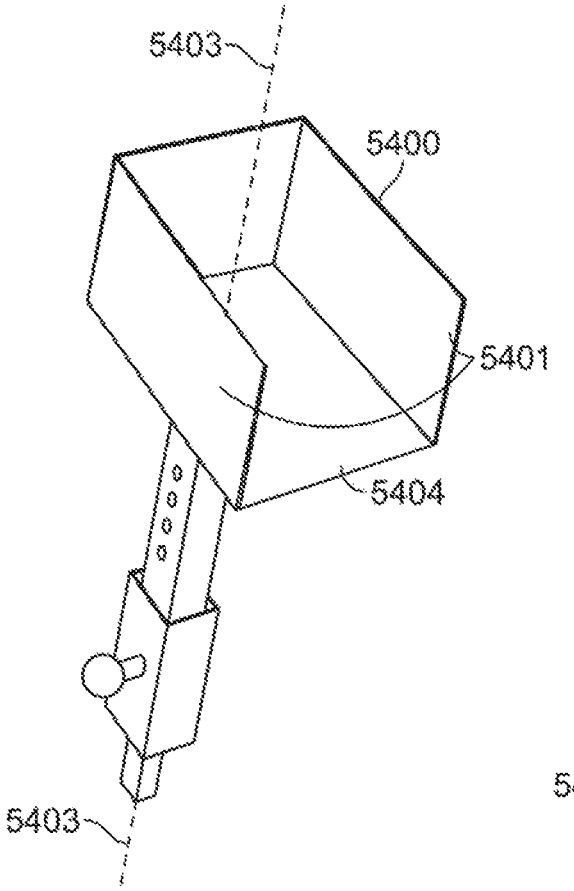
FIG. 53 is a perspective view of an embodiment of a femur rotation attachment combined with an attachment extension port extension.

Referring to FIG. 53, in one embodiment, femur rotation attachment 5400 is optionally attached to attachment extension port extension 4900 previously described. Preferably, the height of femur rotation attachment 5400 is adjustable when the height of attachment extension port extension 4900 is adjusted. Femur rotation attachment 5400 preferably comprises pressure surface 5401, which a person can press their body against causing rotation of femur rotation attachment 5400 about the femur rotation attachment axis of rotation 5403. Optionally, resting surface 5404 comprises a surface upon which a person can rest a part of their body. Optionally a person will adjust the rotational resistance assembly 1300 of multi-function rotational resistance exercise apparatus 1200 to a low position with rotational resistance assembly 1300 facing up towards the sky, then the person will install attachment extension port plug 4903 into the attachment extension port. The person will then disengage the attachment extension lock 4902 and adjust the height of extension arm 4905 in order to raise or lower the height of the resting surface 5404 preferably to the height of the person's knee, then the person will preferably engage the attachment extension lock 4902 in order to lock the femur rotation attachment 5400 into place. The person will then optionally place one foot on the floor next to the femur rotation attachment 5400, and then place their other bent leg in between the pressure surfaces 5401 with their knee resting over the femur rotation attachment axis of rotation 5403, and their shin resting on the resting surface 5404. Preferably a person will then rotate their femur internally and externally and press their lower leg against the pressure surfaces 5401 in order to exercise against the resistance of the multi-function rotational resistance exercise apparatus 1200.

Figure 54:
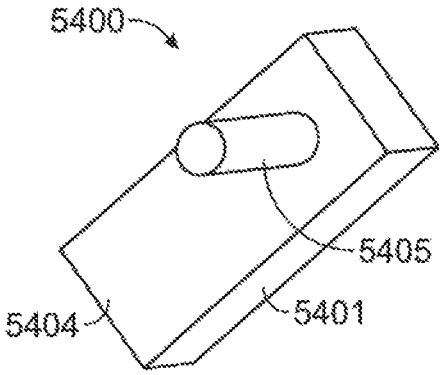
FIG. 54 is a perspective view of an embodiment of the underside of a femur rotation attachment.

Referring to FIG. 54, in one embodiment, femur rotation attachment 5400 optionally comprises attachment extension port plug 5405, which is optionally connectable to an attachment extension port (not shown).

Figure 55:
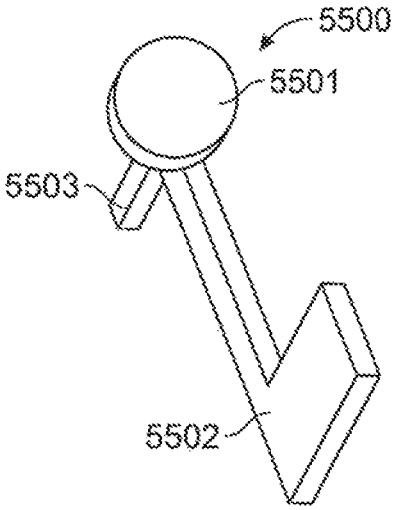
FIG. 55 is a perspective view of an embodiment of a paddle rotation attachment.

Referring to FIG. 55, in one embodiment, paddle rotation attachment 5500 optionally comprises resting pad 5501, pressing paddle 5502, and attachment extension port plug 5503. Attachment extension port plug 5503 is preferably connectable to an attachment extension port (not shown). Attachment extension port plug 5503 is preferably connected to resting pad 5501, and resting pad 5501, is connected to pressing paddle 5502. Preferably, when a person presses against pressing paddle 5502, attachment extension port plug 5503 rotates. Optionally a person could arrange the rotational resistance assembly of an exercise device to a position level with their knee as they stand, the person could then install the paddle rotation attachment 5500 onto the rotational resistance assembly then the person could rest their knee on top of the resting pad 5501 and the side of their ankle against the pressing paddle 5502. The person could then move their ankle in a path around their knee in order to rotate the attachment extension port plug 5503, and work against the resistance of the rotational resistance assembly (not shown).

Figure 56:
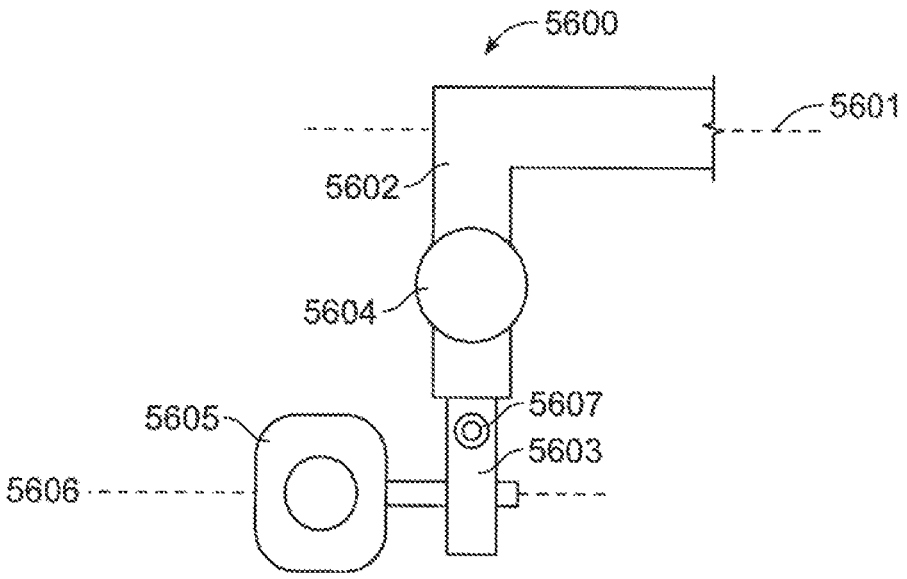
FIG. 56 is a front view of an embodiment of a pedal attachment.

Referring to FIG. 56, in one embodiment, pedal attachment 5600 optionally comprises crank 5602, which is optionally mounted at one end to an attachment extension port (not shown), and optionally connectable at the other end to pedal extension 5603. Pedal extension 5603, optionally telescopes into and out of crank 5602. The crank preferably rotates around crank axis of rotation 5601. Pedal 5605 optionally attaches rotatably to pedal extension 5603, and rotates around pedal axis of rotation 5606. Preferably, a user can rotate pedal 5605 around crank axis of rotation 5601. Pedal extension lock 5604 optionally inserts into crank 5602 and pedal extension hole 5607 thereby locking pedal extension 5603 and crank 5602 together. A person can exercise against the resistance of the exercise apparatus in a motion similar to that of pedaling a bike. Optionally two pedal attachments 5600 could be installed on either side of a rotational resistance assembly 1300 in order to allow a user to place one foot on each of the pedals, and exercise both legs at the same time.

Figure 57:
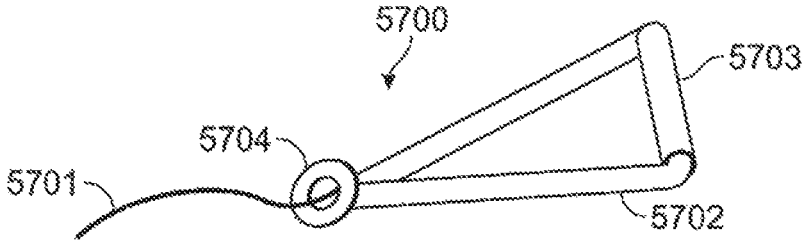
FIG. 57 is a perspective view of an embodiment of a connectable handle.

Referring to FIG. 57, in one embodiment, connectable handle 5700 optionally comprises cable 5701, connected to ring 5704. Optionally, ring 5704 is connected to strap 5702, and optionally, strap 5702 has grip 5703 attached to it. The other end of cable 5701 optionally connects to an attachment (not shown).

Figure 58:
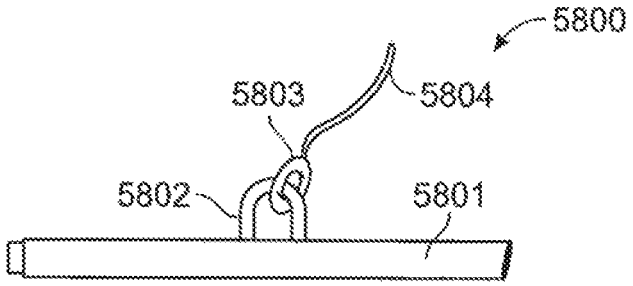
FIG. 58 is a front view of an embodiment of a connectable handle.

Referring to FIG. 58, in one embodiment, connectable handle 5800 optionally comprises handle 5801 that optionally has connecting point 5802 on its periphery. Optionally, cable 5804 attaches to ring 5803, and optionally ring 5803 attaches to connecting point 5802. The other end of cable 5804 optionally connects to an attachment (not shown).

Figure 59:
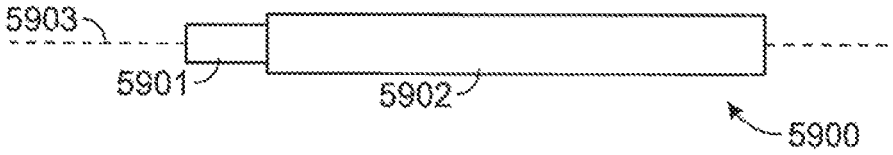
FIG. 59 is a front view of an embodiment of a direct attachment extension port attachment.

Referring to FIG. 59, in one embodiment, connectable handle 5900 optionally comprises grip surface 5902 which is connected to attachment extension port plug 5901. Preferably a person can rotate grip surface 5900 around axis of rotation 5903 thereby causing attachment extension port plug 5901 to rotate around axis of rotation 5903. Attachment extension port plug 5901 is optionally attachable to an attachment extension port (not shown). Connectable handle 5900 could optionally be connected to an attachment, and then said attachment connected to a rotational resistance assembly.

Figure 60:
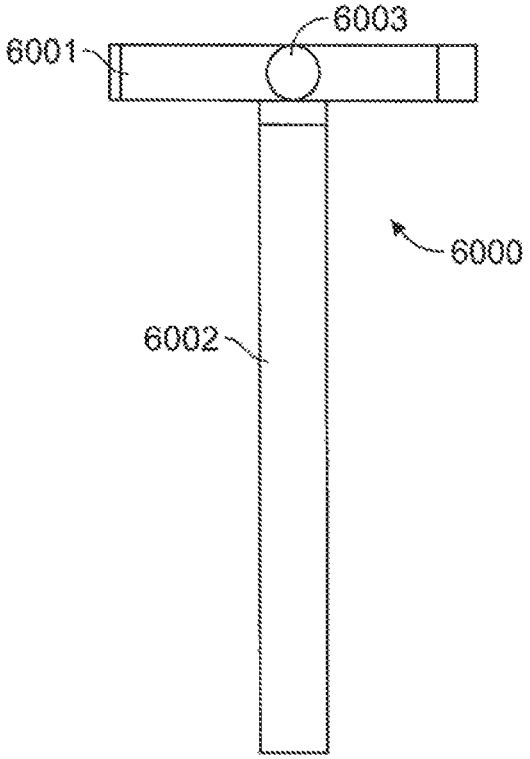
FIG. 60 is a front view of an embodiment of a perpendicular attachment.

Referring to FIG. 60, in one embodiment, perpendicular attachment 6000 optionally comprises attachment extension shaft receiver 6001, which is optionally attachable to an attachment extension (not shown). Furthermore, perpendicular attachment 6000 optionally comprises grip area 6002, and attachment extension lock 6003. Optionally, grip area 6002 is positioned perpendicular to attachment extension shaft receiver 6001. Optionally a person could position the rotational resistance assembly in an overhead position, and attach an attachment extension to it. Then the person can attach the perpendicular attachment 6000 to the attachment extension and stand directly underneath the axis of rotation of the rotational resistance assembly and grasp the grip area 6002 with one or both hands, they then will experience resistance to their exercise by moving the grip area 6002 in a path around the axis of rotation of the rotational resistance assembly by rotating their spine internally and/or externally, or laterally and/or medially.

Figure 61:
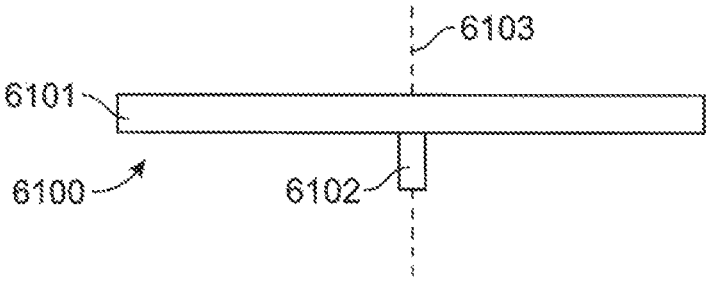
FIG. 61 is a side view of an embodiment of a standing platform attachment.

Referring to FIG. 61, in one embodiment, standing platform attachment 6100 optionally comprises platform 6101, and optionally attachment extension port plug 6102 mounted to platform 6101. Axis of rotation 6103 is optionally the position that standing platform attachment 6100 rotates around. Preferably, a person rotating platform 6101 around axis of rotation 6103 will also rotate port plug 6102 around axis of rotation 6103. Optionally standing platform attachment 6100 will be installed by a user onto a multi-function rotational resistance exercise apparatus (not shown) by inserting the attachment extension port plug 6102 into the attachment extension port (not shown), the user will then position the rotational resistance assembly at a low level near the ground with the attachment extension port (not shown) point up to the sky, then they will grasp some safety handles (not shown) which are secured to the frame (not shown), and step up onto the standing platform attachment 6100 with both feet, then the user will position their feet approximately shoulder distance apart on top of the standing platform attachment 6100, they will then use their torso and legs to rotate the standing platform attachment 6100 around the axis of rotation 6103 while grasping the safety handles (not shown) with their hands, which will cause them to exercise against the resistance of the multi-function rotational resistance exercise apparatus (not shown). The exercise will preferably result in rotational exercise for the spine, and legs. A user could optionally place a short table (not shown) next to the standing platform attachment 6100, and stand upon it with one foot, while the other foot is standing upon the standing platform attachment 6100, then the user could rotate the standing platform attachment 6100 with the one foot that standing upon it by rotating their leg internally or externally.

Figure 62:
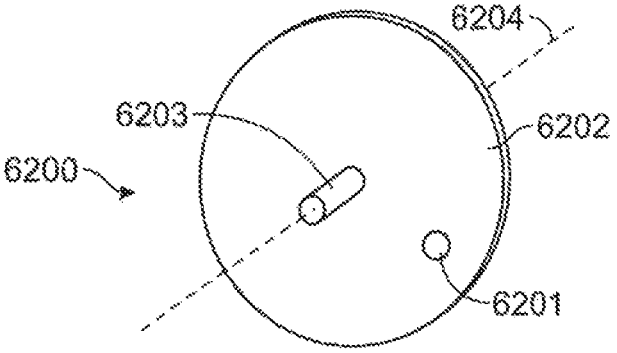
FIG. 62 is a perspective view an embodiment of the underside of a standing platform attachment.

Referring to FIG. 62, an embodiment of standing platform attachment 6200 optionally comprises pass through hole 6201 going through platform 6202. Attachment extension port plug 6203 and platform 6202 are optionally secured together and optionally both rotate around axis of rotation 6204. Optionally a person could install standing platform attachment 6200 onto a multi-function rotational resistance exercise apparatus, then install an attachment (not shown) into pass through hole 6201, the person could then grasp the attachment and move it in a circumduction motion in order to exercise against the resistance of the multi-function rotational resistance exercise apparatus.

Figure 63:
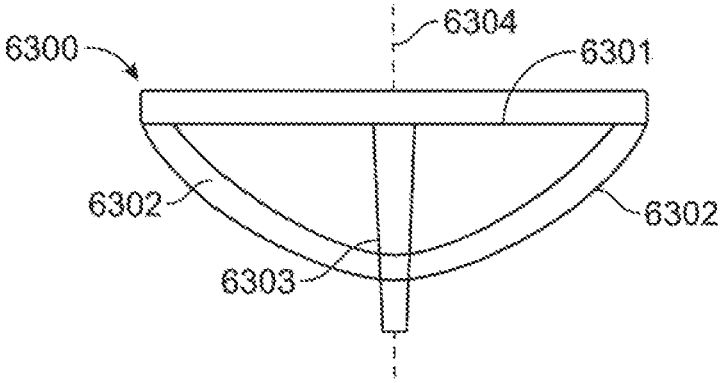
FIG. 63 is a side view of an embodiment of a steering wheel attachment.

Referring to FIG. 63, in one embodiment, steering wheel attachment 6300 optionally comprises grip surface 6301 which is optionally mounted to spokes 6302, and spokes 6302 are optionally mounted to attachment extension port plug 6303. Optionally steering wheel attachment 6300 rotates around axis of rotation 6304. Preferably when a person rotates grip surface 6301, attachment extension port plug 6303 will also rotate. Optionally the steering wheel attachment 6300 is attached to a rotational resistance assembly at the resistance output (not shown), then rotated in a motion similar to that of moving a vehicle's steering wheel in order to exercise against the resistance of the rotational resistance assembly.

Figure 64:
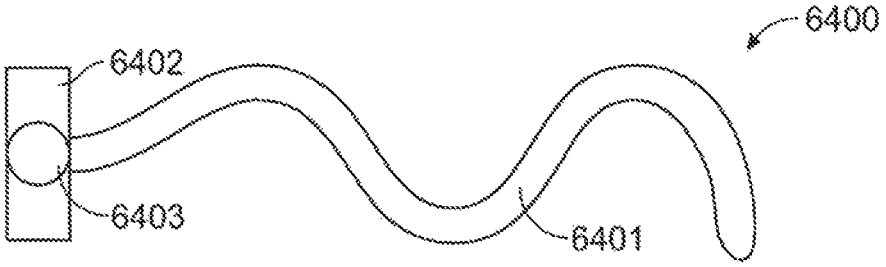
FIG. 64 is a front view of an embodiment of a long curved attachment.

Referring to FIG. 64, in one embodiment, long curved attachment 6400 optionally comprises grip surface 6401 optionally connected to attachment extension shaft receiver 6402. Attachment extension shaft receiver 6402 is optionally connectable to an attachment extension (not shown). Attachment extension lock 6403 is preferably secured to the surface of attachment extension shaft receiver 6402. A person can exercise in a traditional bicep curd motion by attaching the long, curved attachment 6400 to a rotational resistance exercise apparatus and to an attachment extension.

Figure 65:
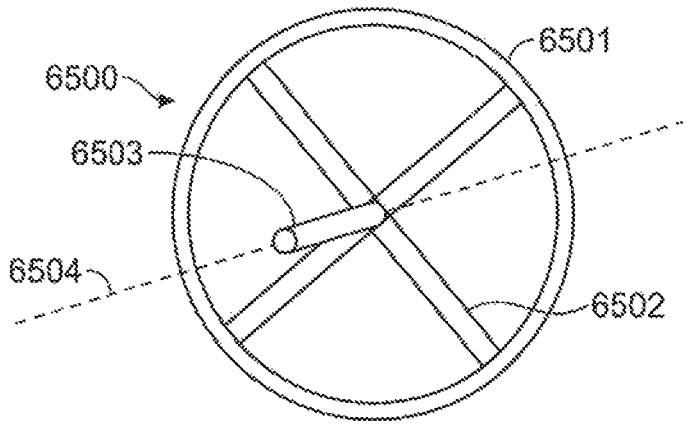
FIG. 65 is a perspective view of an embodiment of a steering wheel attachment.

Referring to FIG. 65, in one embodiment, steering wheel attachment 6500 optionally comprises grip surface 6501, which is connected to spokes 6502, and spokes 6502 are optionally connected to attachment extension port plug 6503. Preferably, rotating steering wheel attachment 6500 around axis of rotation 6504 will cause attachment extension port plug 6503 to rotate. Preferably moving the steering wheel attachment 6500 in a motion similar to that of steering a vehicle, while it is attached to a rotational resistance exercise apparatus, will exercise and/or rehabilitate the person in a way that will be similar to driving a vehicle.

Figure 66:
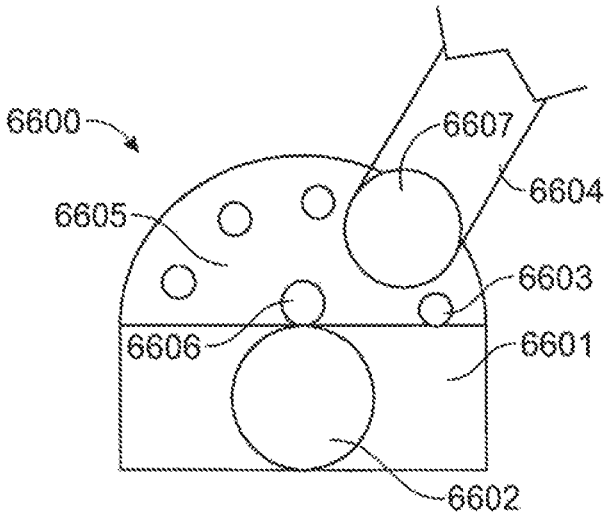
FIG. 66 is a side view of an embodiment of an attachment with adjustable angles.

Referring to FIG. 66, in one embodiment, attachment with adjustable angles 6600, optionally comprises attachment extension shaft receiver 6601 which is connectable to an attachment extension (not shown). Attachment extension shaft receiver 6601 optionally has mounted upon its surface attachment extension lock 6602 which secures the attachment extension shaft receiver onto an attachment extension (not shown). Attachment part 6604 is rotatably mounted to selector plate 6605 by means of wrist pin 6606. Optionally, selector plate 6605 is attached to attachment extension shaft receiver 6601. Attachment part angle lock 6607 optionally passes through selector plate 6605 and attachment part 6604. By optionally removing attachment part angle lock 6607 then rotating attachment part 6604 around wrist pin 6606, a user can select the angle attachment part 6604 is in relation to attachment extension shaft receiver 6601. Optionally, attachment part angle lock 6607 will pass through angle selection hole 6603 which is optionally passing through the surface of selector plate 6605.

Figure 67:
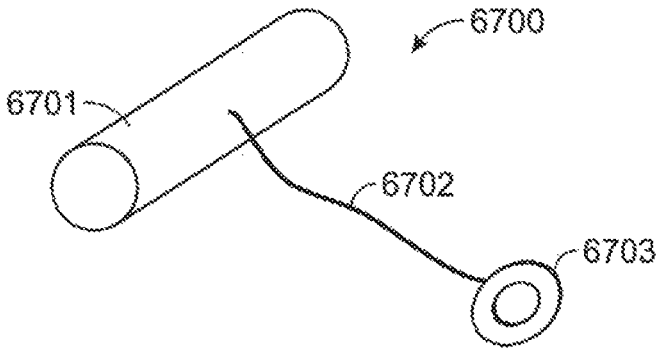
FIG. 67 is a perspective view of an embodiment of a connectable handle.

Referring to FIG. 67, in one embodiment, connectable handle 6700 optionally comprises grip 6701, which is optionally connected to cable 6702. Optionally, cable 6702 is connected to ring 6703.

Figure 68:
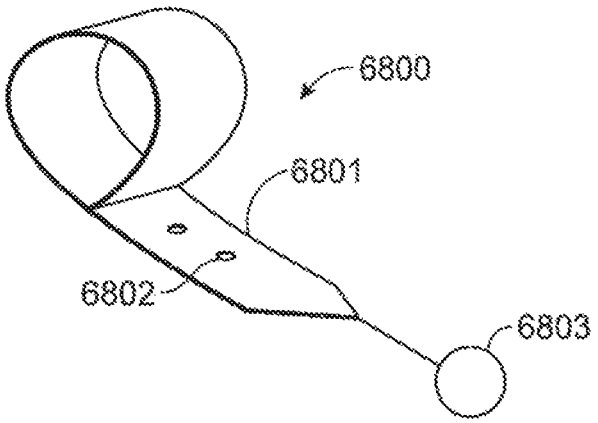
FIG. 68 is a perspective view of an embodiment of a connectable handle.

Referring to FIG. 68, in one embodiment, connectable handle 6800 optionally comprises flexible material 6801 which is optionally looped around itself and secured by placing a pin (not shown) through adjustment holes 6802. Flexible material 6801 is optionally connected to ring 6803.

Figure 69:
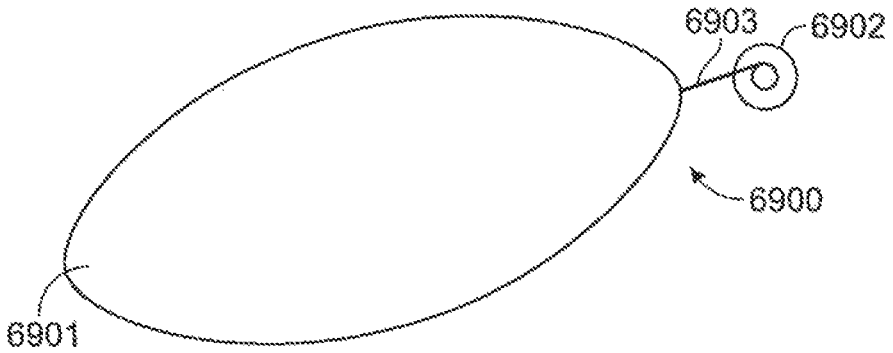
FIG. 69 is a perspective view of an embodiment of a connectable handle.

Referring to FIG. 69, in one embodiment, connectable handle 6900 optionally comprises curved surface 6901 shaped similar to a football. Optionally the curved surface is connected to link 6903 and link 6903 is connected to ring 6902.

Figure 70:
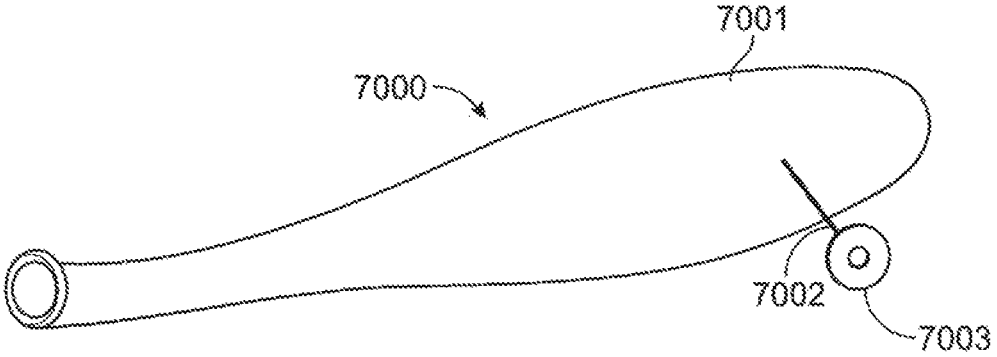
FIG. 70 is a perspective view of an embodiment of a connectable handle.

Referring to FIG. 70, in one embodiment, connectable handle 7000 optionally comprises grip surface 7001 shaped similarly to a baseball bat. Grip surface 7001 is optionally connected to strap 7002 and strap 7002 is optionally connected to carabiner 7003.

Figure 71:
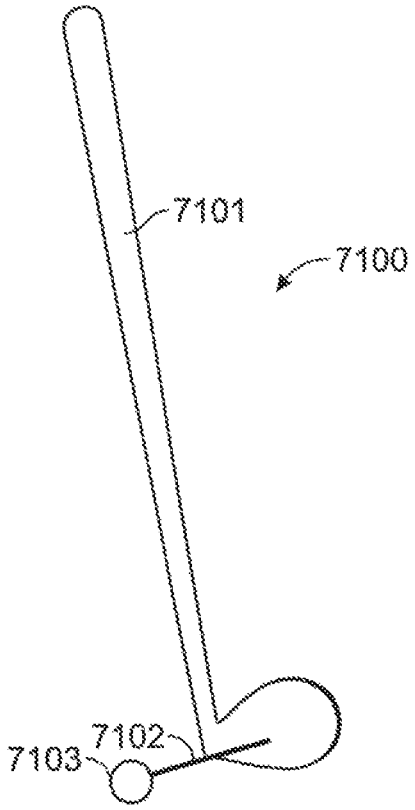
FIG. 71 is a perspective view of an embodiment of a connectable handle.

Referring to FIG. 71, in one embodiment, connectable handle 7100 optionally comprises grip surface 7101 shaped similarly to a golf club. Grip surface 7101 is optionally connectable to cable 7102 and cable 7102 is optionally connectable to eye 7103.

Figure 72:
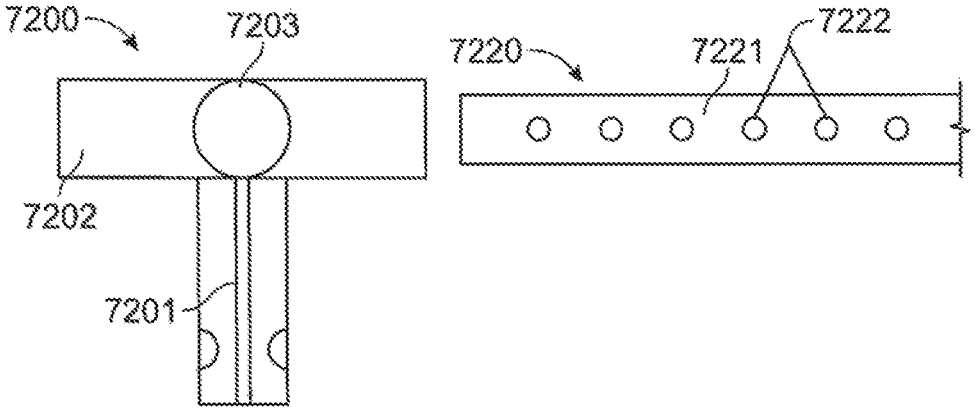
FIG. 72 is a side view of an embodiment of an attachment extension and attachment.

Referring to FIG. 72, in one embodiment, attachment extension 7200 optionally comprises attachment extension port plug 7201 which is connectable to an attachment extension port (not shown). Attachment extension port plug 7201 is optionally connected to attachment extension body 7202. Attachment extension body 7202 optionally has attachment lock 7203 attached to it. Optionally, attachment lock 7203 secures together the attachment extension 7200 and attachment 7220, when attachment 7220 is attached to attachment extension 7200. Optionally, attachment 7220 comprises surface 7221 which inserts into attachment extension 7200. Optionally, upon surface 7221, attachment 7220 has holes 7222 which are engaged by attachment lock 7203.

Figure 73:
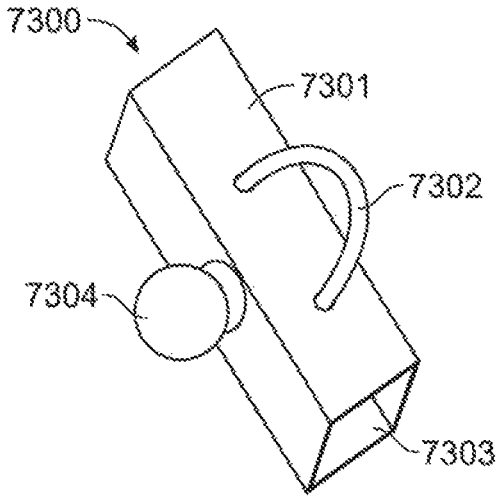
FIG. 73 is a perspective view of an embodiment of a generic attaching point attachment.

Referring to FIG. 73, in one embodiment, adjustable attachment slide 7300 optionally comprises body 7301 with optional loop 7302 attached to it. Optionally, body 7301 comprises opening 7303 located on at least one end. Opening 7303 preferably allows for the installation of an attachment extension (not shown). Optionally, extension lock 7304 is mounted on the surface of body 7301. Optionally, the extension lock will secure adjustable attachment slide 7300 onto an attachment extension (not shown). Preferably, a person can install an attachment of choice (not shown) to loop 7302. Optionally a person could attach connectable eye 7103 to loop 7302, then attach the adjustable attachment slide 7300 onto an attachment extension. The user could then attach the attachment extension onto a rotational resistance assembly, and exercise by moving connectable handle 7100 through a path of motion around the axis of rotation of the rotational resistance assembly resulting in an exercise similar to a golf swing.

Figure 74:
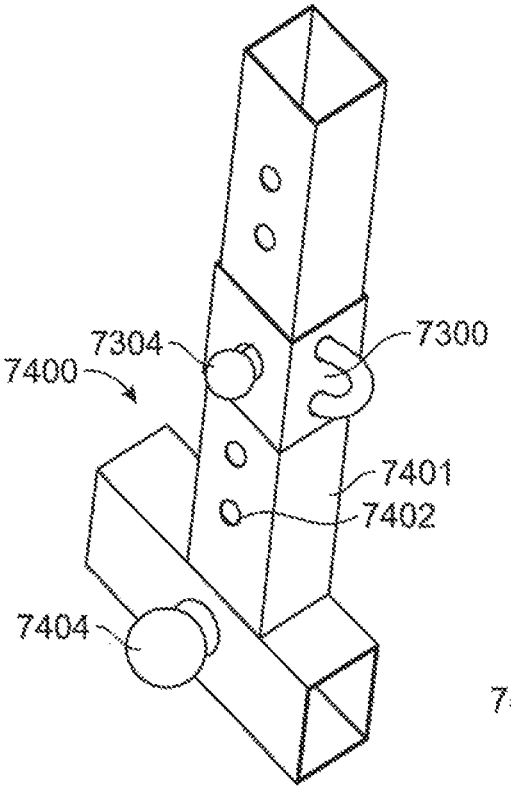
FIG. 74 is a perspective view of an embodiment of an adjustable generic attaching point attachment.

Referring to FIG. 74, in one embodiment, adjustable generic attaching point attachment 7400 optionally comprises adjustable attachment slide 7300, adjustably attached to frame rail 7401. Frame rail 7401 optionally has holes 7402 for extension lock 7304 to engage. Disengaging extension lock 7304 preferably allows a person to slide adjustable attachment slide 7300 to a new hole 7402 and re-engage extension lock 7304. Optionally a person could insert an attachment extension into one of the openings adjacent to extension lock 7404 and engage extension lock 7404 onto one of the holes on the attachment extension. Then the user can install this assembly onto the attachment extension port of an exercise apparatus. The person will then be able to attach a type of attachment onto the loop on adjustable attachment slide 7300 and be able to move their attachment in a path around the axis of rotation of the attachment extension port and exercise against the resistance.

Figure 75:
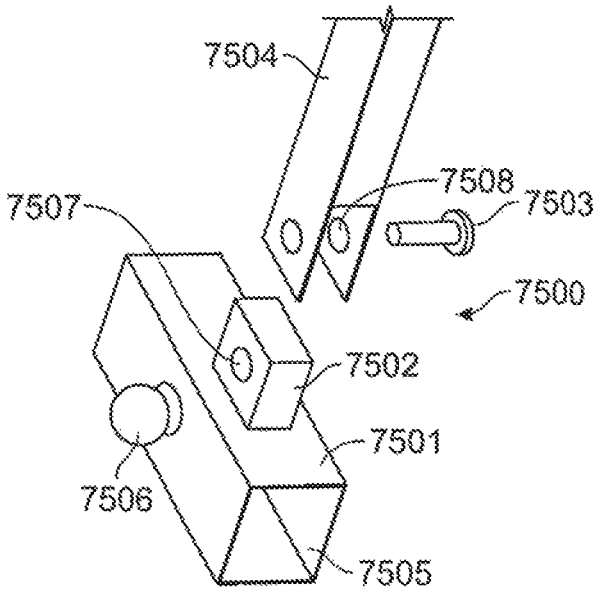
FIG. 75 is a perspective view of an embodiment of an articulating attachment joint.

Referring to FIG. 75, in one embodiment, articulating attachment joint 7500 optionally comprises attachment extension shaft receiver 7501 which optionally has on its surface pin base 7502 with hole 7507. Attachment arm 7504 is optionally able to articulate freely around pin 7503 when pin 7503 is inserted into hole 7508 and hole 7507. Attachment arm 7504 is installed onto attachment extension shaft receiver 7501 rotatably around pin 7503. Preferably, lock pin 7506 secures articulating attachment joint 7500 onto an attachment extension (not shown). The attachment extension inserts into opening 7505.

Figure 76:
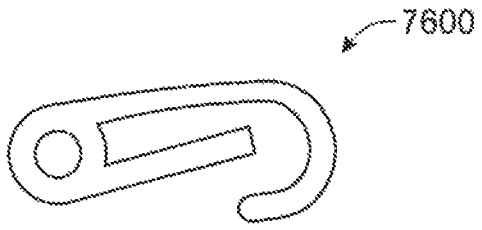
FIG. 76 is a side view of an embodiment of a carabiner.

Referring to FIG. 76, in one embodiment, carabiner 7600 preferably attaches one piece of equipment (not shown) to another.

Figure 77:
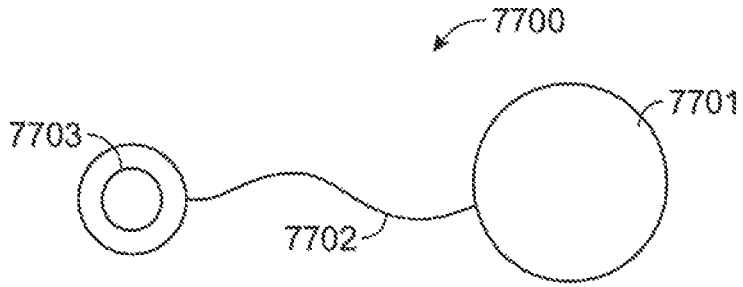
FIG. 77 is a side view of an embodiment of a connectable handle.

Referring to FIG. 77, in one embodiment, connectable handle attachment 7700 optionally comprises grip surface 7701 generally shaped like a spherical ball. Grip surface 7701 optionally attaches to rope 7702 and rope 7702 is optionally attached to washer 7703. A person can then attach the washer to a number of different attachments and then attach those attachments to an exercise apparatus in order to exercise against resistance by griping the grip surface 7701 and moving it through space, preferably in the circular motion of throwing a ball.

Figure 78:
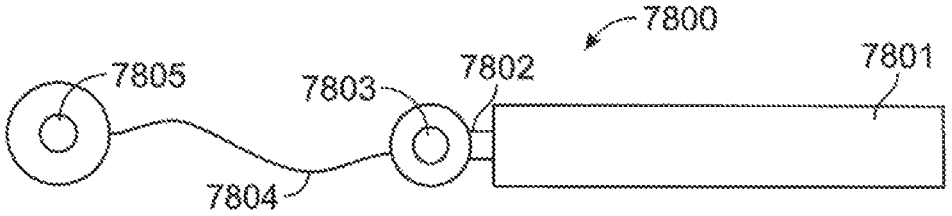
FIG. 78 is a side view of an embodiment of a connectable handle.

Referring to FIG. 78, in one embodiment, connectable handle 7800 optionally comprises grip area 7801 optionally rotatably mounted on shaft 7802 and preferably shaft 7802 is connected to ring 7803. Ring 7803 is preferably connected to chain 7804 and chain 7804 is optionally connected at the other end to ring 7805. A person could optionally attach ring 7805 to an attachment of their choice which is secured onto an exercise apparatus, after which the person can grasp grip area 7801 with one or two of their hands, and move the grip area 7801 through a path which provides them exercise against the resistance of the apparatus. Preferably the path will be the same as swinging a bat as in baseball, or swinging a racquetball racquet.

Figure 79:
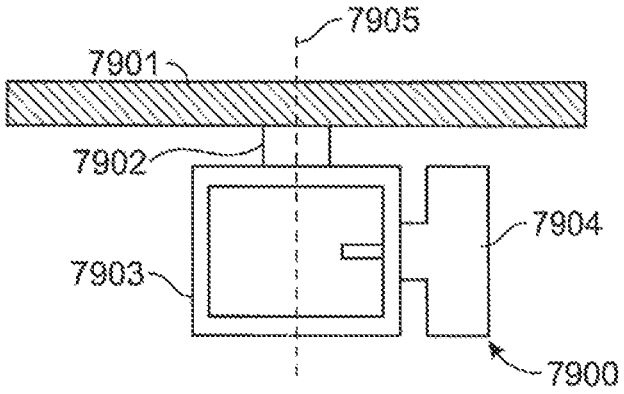
FIG. 79 is a sectional view of an embodiment of a free spinning plate attachment.

Referring to FIG. 79, in one embodiment, free spinning plate attachment 7900 comprises attachment extension shaft receiver 7903 which optionally has attachment lock 7904 attached to its surface. Attachment lock 7904 optionally secures free spinning plate attachment 7900 onto an attachment extension (not shown). Axle 7902 is optionally attached to attachment extension shaft receiver 7903. Preferably, free spinning plate 7901 is optionally rotatably attached to the axle 7902. Preferably, when a person rotates free spinning plate 7901 on the axis of rotation 7905, free spinning plate 7901 will rotate freely. Preferably, when a person presses on free spinning plate 7901 in a motion perpendicular in direction to the axis of rotation 7905, free spinning plate attachment 7900 will transfer that force into the optionally connected attachment extension (not shown). Optionally a person will attach free spinning plate attachment 7900 onto an attachment extension, and secure the attachment extension 7900 onto a multi-function rotational resistance exercise apparatus, the person will then place their flat hand onto free spinning plate 7901, and move their hand along with the plate in a motion which circles the axis of rotation of the rotational resistance assembly, thus exercising against resistance.

Figure 80:
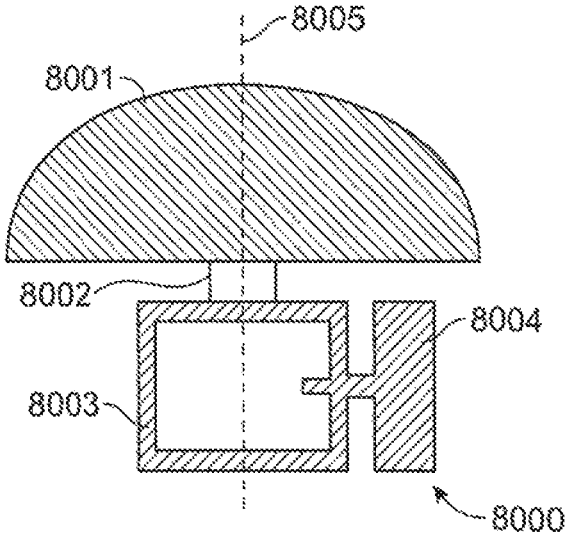
FIG. 80 is a sectional view of an embodiment of a free spinning dome attachment.

Referring to FIG. 80, in one embodiment, free spinning dome attachment 8000 preferably comprises attachment extension shaft receiver 8003 which optionally has attachment lock 8004 attached to its surface. Attachment lock 8004 optionally secures free spinning dome attachment 8000 onto an attachment extension (not shown). Axle 8002 is optionally attached to attachment extension shaft receiver 8003. Free spinning dome 8001 is optionally rotatably attached to the axle 8002. Preferably, when a person rotates free spinning dome 8001 on the axis of rotation 8005, free spinning dome 8001 will rotate freely. Preferably, when a person presses on free spinning dome 8001 in a motion perpendicular in direction to axis of rotation 8005, free spinning dome attachment 8000 will transfer that force into the optionally connected attachment extension (not shown).

Figure 81:
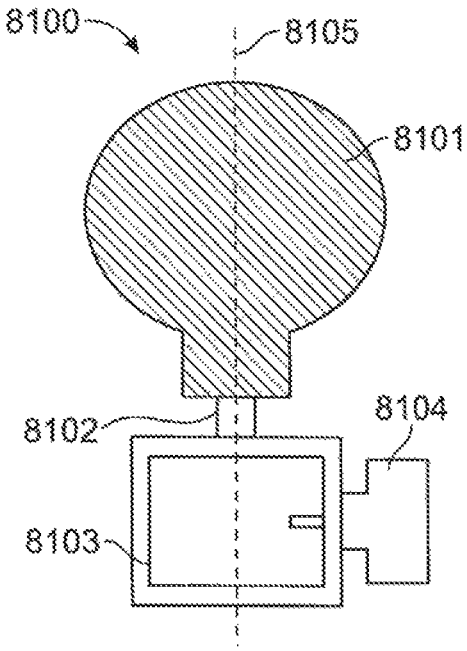
FIG. 81 is a sectional view of an embodiment of a free spinning knob attachment.

Referring to FIG. 81, in one embodiment, free spinning knob attachment 8100 preferably comprises attachment extension shaft receiver 8103 which optionally has attachment lock 8104 attached to its surface. Attachment lock 8104 optionally secures free spinning knob attachment 8100 onto an attachment extension (not shown). Axle 8102 is optionally attached to attachment extension shaft receiver 8103. Free spinning knob 8101 is optionally rotatably attached to axle 8102. Preferably, when a person rotates free spinning knob 8101 on axis of rotation 8105, free spinning knob 8101 will rotate freely. Preferably, when a person presses on free spinning knob 8101 in a motion perpendicular in direction to axis of rotation 8105, free spinning knob attachment 8100 will transfer that force into the optionally connected attachment extension (not shown).

Figure 82:
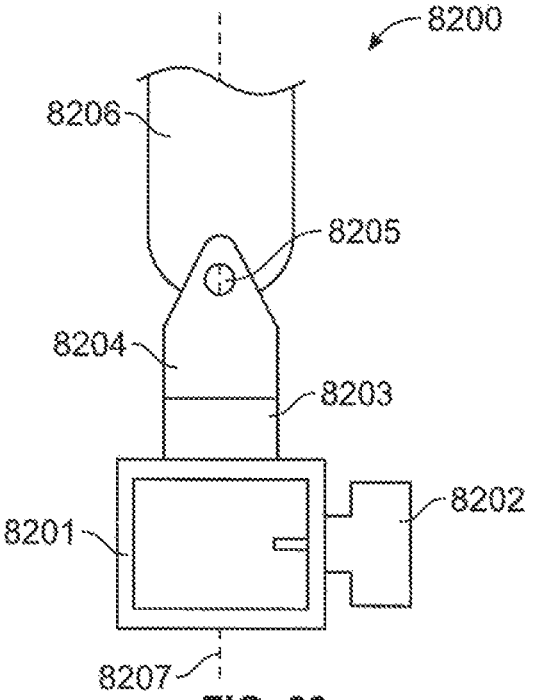
FIG. 82 is a side view of an embodiment of a free spinning articulating joint attachment.

Referring to FIG. 82, in one embodiment, free spinning articulating joint attachment 8200 preferably comprises attachment extension shaft receiver 8201 which optionally has connected to it attachment extension lock 8202. Optionally, an attachment extension (not shown) attaches to free spinning articulating joint attachment 8200. Optionally, attachment extension shaft receiver 8201 also has connected to it joint base 8203. Joint base 8203 is preferably rotatably connected to joint flange 8204. Optionally, joint flange 8204 is able to freely rotate around axis of rotation 8207. Joint Flange 8204 is preferably rotatably connected to wrist pin 8205. Optionally, wrist pin 8205 rotatably connects joint flange 8204 to attachment arm 8206. Preferably, attachment arm 8206 will optionally be free to rotate around axis of rotation 8207 and optionally be able to rotate around wrist pin 8205 in a different axis of rotation (not shown) from axis of rotation 8207. Optionally a person will be able to perform an exercise similar to that of stirring a large pot of stew with a long stick by utilizing the free spinning articulating joint attachment 8200 along with an exercise apparatus and other attachments. Optionally a person will place a rotational resistance assembly down near the floor with it facing up towards the sky, then they will attach an attachment extension to the resistance output. The person will then slide the attachment extension shaft receiver 8201 over the attachment extension and lock it into place with the attachment extension lock 8202, then they will grasp the attachment arm 8206 with their hands and move it in a circular path around the axis of rotation of the rotational resistance assembly in order to exercise against resistance. The joint base 8203 and the wrist pin 8205 will allow the attachment arm 8206 to remain in the persons grip and articulate freely as the entire assembly rotates around the axis of rotation of the rotational resistance exercise apparatus (not shown).

Figure 83:
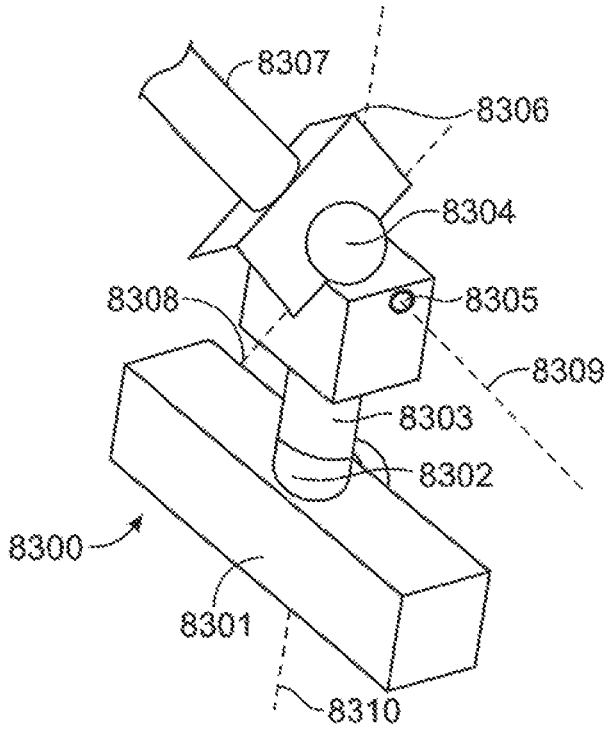
FIG. 83 is a perspective view of an embodiment of a universally jointed attachment.

Referring to FIG. 83, in one embodiment, universally jointed attachment 8300 preferably comprises attachment extension shaft receiver 8301 which is optionally rotatably attached to a universal joint housing 8303 with bearing 8302 mounted between universal join housing 8303 and attachment extension shaft receiver 8301. Universal joint housing 8303 is preferably able to rotate on axis of rotation 8310. Universal joint housing 8303 is preferably rotatably mounted to two portions of universal joint 8304 by both ends of wrist pin 8305, and universal joint housing 8303 is preferably able to rotate about axis of rotation 8309. Universal joint 8304 is preferably rotatably connected to attachment arm base 8306 by, for example, connecting to two portions of universal joint 8304 onto attachment arm base 8306. Preferably attachment arm base 8306 is able to rotate freely about axis of rotation 8308. Attachment arm 8307 is optionally connected to attachment arm base 8306. Attachment arm 8307 is preferably able to freely spin around axis of rotation 8310, and optionally free to spin around axis of rotation 8309, and optionally free to spin around axis of rotation 8308.

Figure 84:
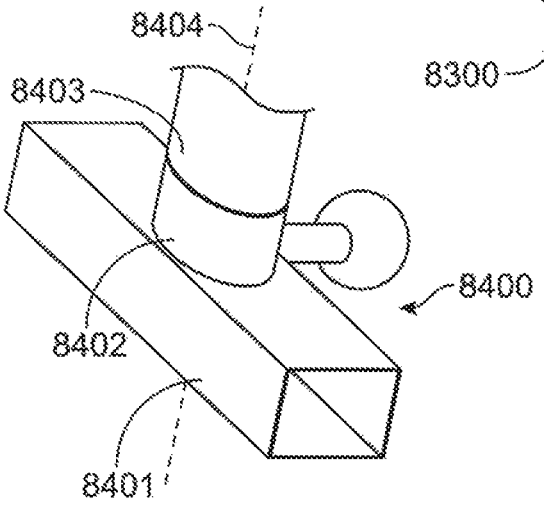
FIG. 84 is a perspective view of an embodiment of a free spinning attachment.

Referring to FIG. 84, in one embodiment, free spinning attachment 8400 preferably comprises attachment extension shaft receiver 8401 which is optionally connectable to an attachment extension (not shown). Attachment extension shaft receiver 8401 is optionally rotatably connected to bearing 8402 and bearing 8402 is optionally rotatably connected to surface 8403. Surface 8403 is preferably able to rotate around axis of rotation 8404.

Figure 85:
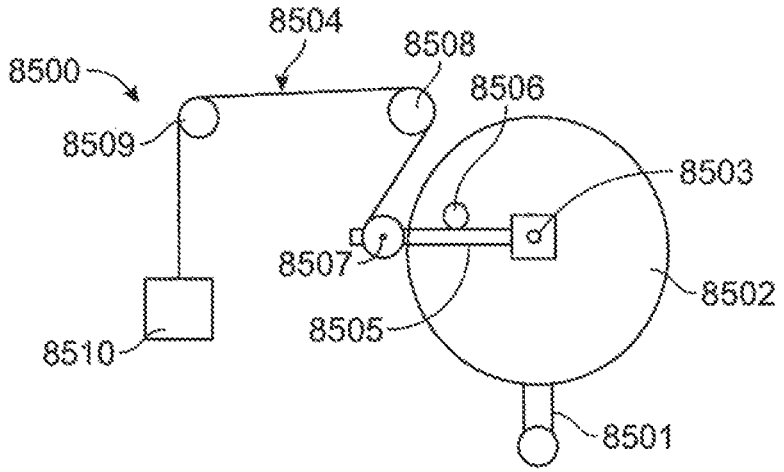
FIG. 85 is a front view of an embodiment of a rotational resistance assembly at rest.
Figure 86:
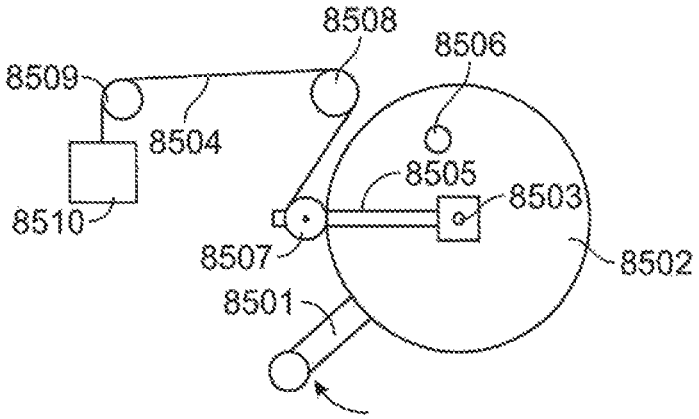
FIG. 86 is a front view an embodiment of a rotational resistance assembly turning clockwise.
Figure 87:
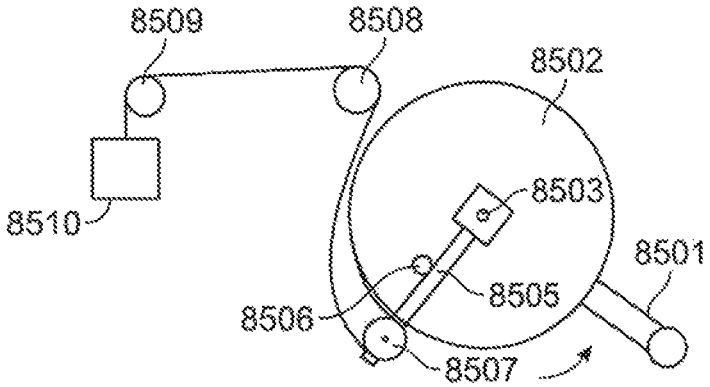
FIG. 87 is a front view of an embodiment of a rotational resistance assembly turning counterclockwise.

Referring to FIGS. 85-87, in one embodiment, rotational resistance assembly 8500 at rest position preferably comprises lever arm 8501 connected to wheel 8502. Wheel 8502 is preferably rotatable around center of rotation 8503. Cable 8504 is preferably connected to the periphery of wheel 8502, such that when wheel 8502 rotates, cable 8504 wraps around the periphery of wheel 8502. First pulley 8507 is preferably rotatably mounted to arm 8505, and optionally arm 8505 is rotatably mounted to the center of wheel 8502. In one embodiment, stopper 8506 is preferably mounted onto the surface of wheel 8502, and is positioned next to arm 8505. Cable 8504 extends from wheel 8502 and passes around first pulley 8507, then passes around second pulley 8508, then cable 8504 passes around third pulley 8509, and attaches to weight 8510. Optionally, an attachment extension (not shown) is connectable to rotational resistance assembly 8500. Optionally arm 8505 is stopped from rotating one direction by a second stopper (not shown).

In one embodiment, weight 8510 is moved by cable 8504 when wheel 8502 is rotated clockwise. Preferably, when wheel 8502 is rotated one direction, second stopper (not shown) stops arm 8505 from rotating the same direction. Optionally, first pulley 5807 remains stationary while wheel 8502 rotates in one direction because of its attachment to arm 8505. Preferably cable 8504 will wrap around wheel 8502 and preferably cause the motion of wheel 8502 to be resisted.

Referring to FIG. 87, in another embodiment, weight 8510 is moved by cable 8504 when wheel 8502 is rotated in another direction. Wheel 8502 is shown therein after it has been rotated in an opposite direction. In one embodiment rotational resistance assemblies embodied in FIG. 85-87 are capable of providing bidirectional rotation resistance. In another embodiment a rotational resistance assembly is capably of attaching an attachment at its center of rotation 8503.

Figure 88:
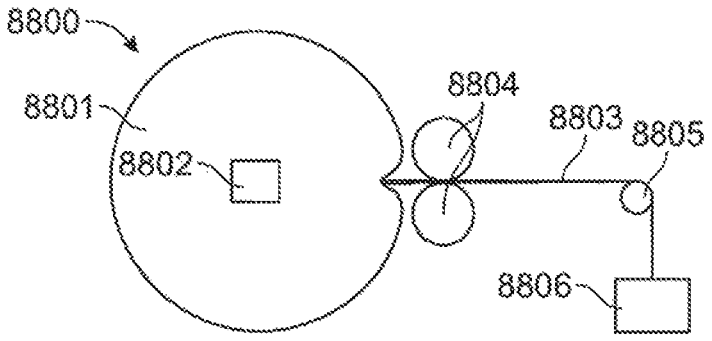
FIG. 88 is a front view of an embodiment of a rotational resistance assembly at rest.

Referring to FIG. 88, in one embodiment, rotational resistance assembly 8800 at resting position, preferably comprises wheel 8801 rotatable around center of rotation 8802. Optionally, wheel 8801 has cable 8803 attached to its periphery. Optionally, first and second pulleys 8804 are rotatably attached nearby on opposing sides of cable 8803. Optionally, cable 8803 passes over third pulley 8805. Optionally, cable 8803 is attached to weight 8806 on its other end. Optionally, wheel 8801 is rotatably mounted on an axle (not shown) with the axle axis of rotation (not shown) being coincidental with wheel center of rotation 8802. Optionally rotational resistance assembly 8800 is attachable to an attachment extension port plug (not shown).

Figure 89:
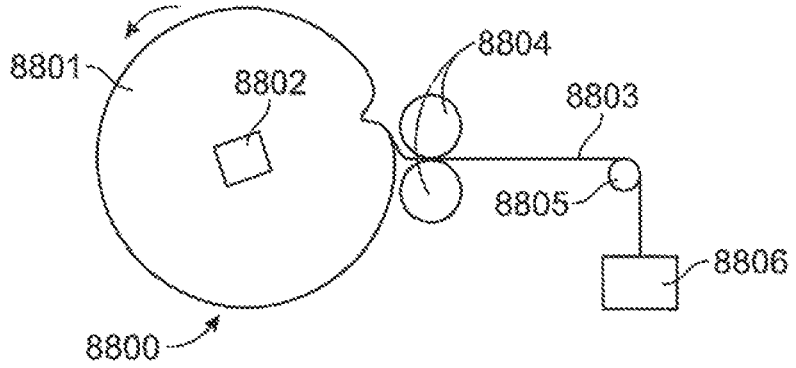
FIG. 89 is a front view of an embodiment of a rotational resistance assembly turning counterclockwise.

Referring to FIG. 89, in one embodiment, rotational resistance assembly 8800 is preferably rotated counterclockwise, and comprises weight 8806 that is lifted by the rotation of wheel 8801.

Figure 90:
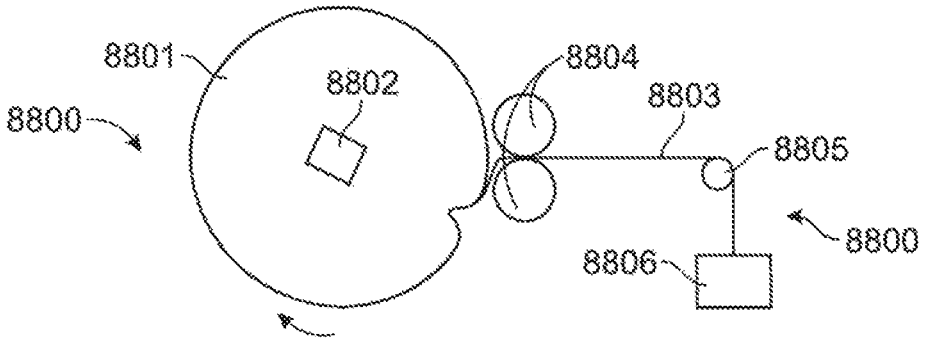
FIG. 90 is a front view of an embodiment of a rotational resistance assembly turning clockwise.

Referring to FIG. 90, in one embodiment, rotational resistance assembly 8800 is preferably rotated clockwise, and comprises weight 8806 that is lifted by the rotation of wheel 8801.

Figure 91:
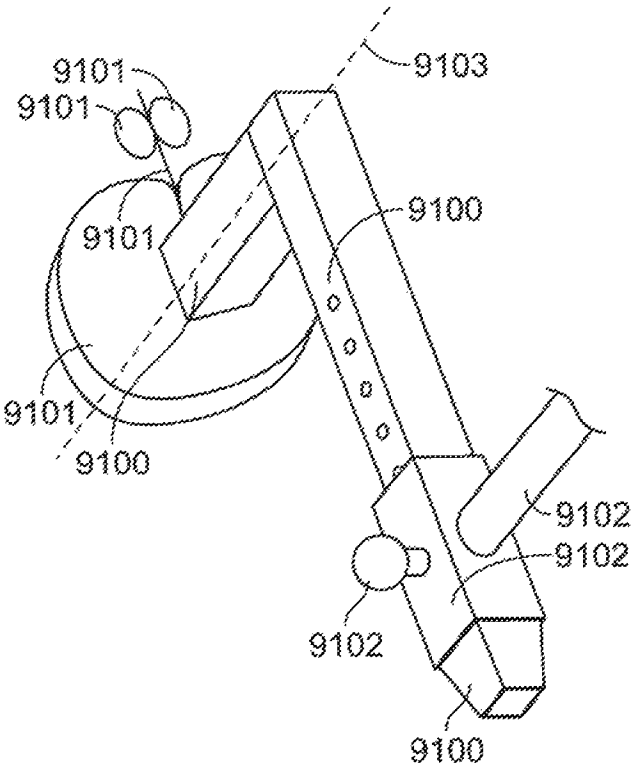
FIG. 91 is a perspective view of an embodiment of a rotational resistance assembly with an attachment extension attached to it, and with an attachment attached to the attachment extension.

Referring to FIG. 91, in one embodiment, attachment extension 9100 is preferably attached to rotational resistance assembly 9101, and attachment 9102 is optionally attached to attachment extension 9100. Preferably, when attachment 9102 is rotated around axis of rotation 9103, a user will have rotational resistance. The attachment 9102 is adjustable in position on the attachment extension 9100 by relocating it to a new position and securing it in place. A person optionally will grasp the attachment 9102 with their hand and move it in a path around the axis of rotation 9103.

Figure 92:
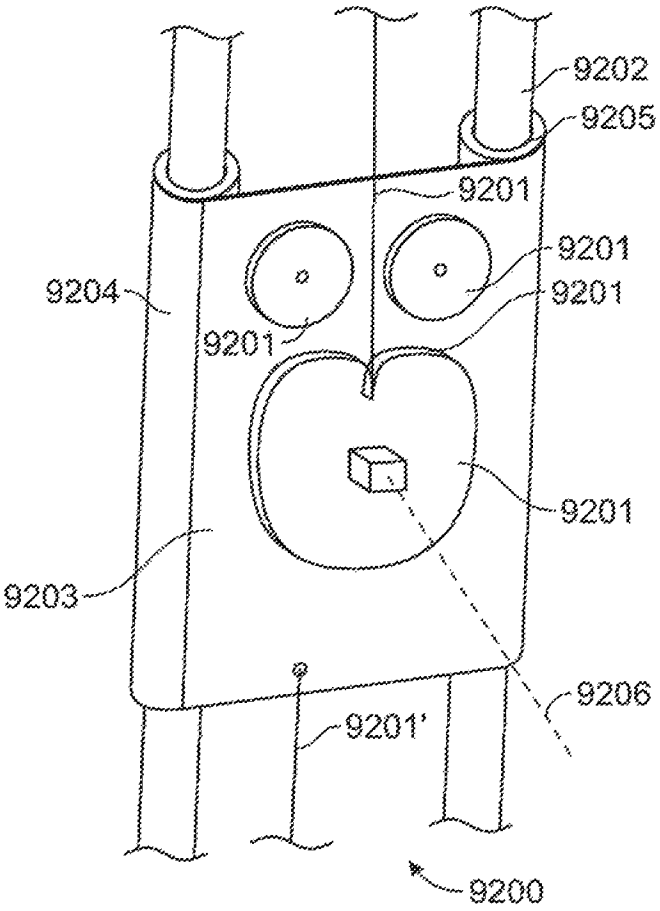
FIG. 92 is a perspective view of an embodiment of a rotational resistance assembly rotatably mounted upon a direct carriage assembly, and direct carriage assembly adjustable in position on frame.

Referring to FIG. 92, in one embodiment, direct carriage assembly 9200 optionally comprises rotational resistance assembly 9201 connected to direct carriage 9203. Optionally, direct carriage 9203 is connected to direct carriage bearing sleeves 9204. Optionally, direct carriage bearing sleeves 9204 comprise bearings 9205 which reduce friction between direct carriage bearing sleeves 9204 and frame 9202. Preferably, the axle (not shown) rotates on axis of rotation 9206. Optionally, direct carriage 9203 is capable of being positioned on frame 9202 at a number of locations. Optionally frame 9202 is connectable to an exercise apparatus which has framing, weights, and other features commonly known to give the direct carriage assembly 9200 functionality for exercise. Optionally a person could attach one of many different attachments to the rotational resistance assembly 9201 and perform a wide variety of exercises. Depending on the angle set for the frame 9202, a user could perform a wide variety of exercises, and optionally having the frame 9202 adjustable in angle would allow a user the ability to perform an even wider variety of exercises.

Figure 93:
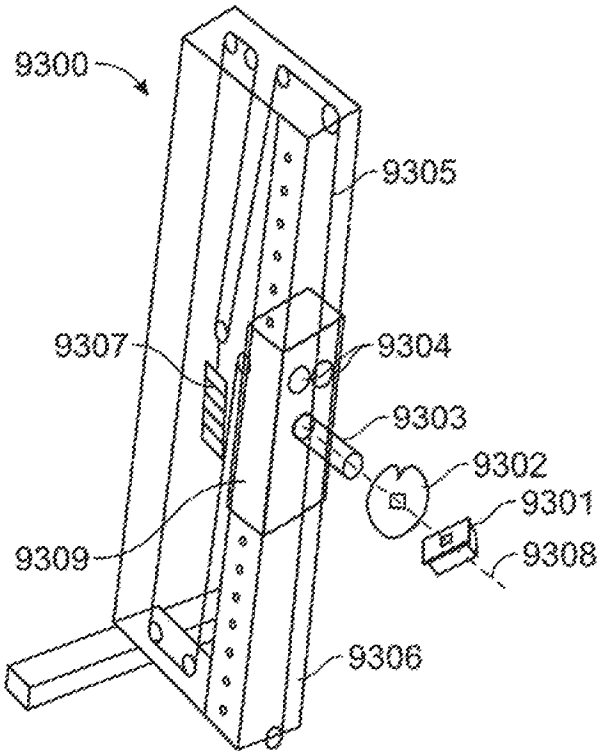
FIG. 93 is a perspective view of an embodiment of a grip twist attachment mounted to a rotational resistance assembly which is rotatably mounted upon a direct carriage assembly, and direct carriage assembly adjustable in position on frame, with axis of rotation directed horizontally, and resistance provided by weight plates.

Referring to FIG. 93, in one embodiment, system 9300 preferably comprises grip twist attachment 9301 connected to rotational resistance assembly 9302. Optionally, rotational resistance assembly 9302 is rotatably connected to axle 9303 along axis 9308. Axle 9303 is preferably connected to direct carriage 9309. Optionally, direct carriage 9309 is adjustable in height on frame 9306. Preferably, weights 9307 attach to cable 9305 and optionally cable 9305 attaches to rotational resistance assembly 9302. Preferably, a user can rotate grip twist attachment 9301 and weights 9307 will resist the users rotation. Optionally, a first and a second pulley 9304 are rotatably attached to direct carriage 9309 on opposing sides of cable 9305. System 9300 optionally is a representation of an assembly comprising a selection of the embodiments described herein. A person optionally stands in front of the system 9300, facing the direct carriage 9309, they then raise their hand and grasp the grip twist attachment 9301 with their hand and supinate and/or pronate their wrist in order to exercise against the resistance.

Figure 94:
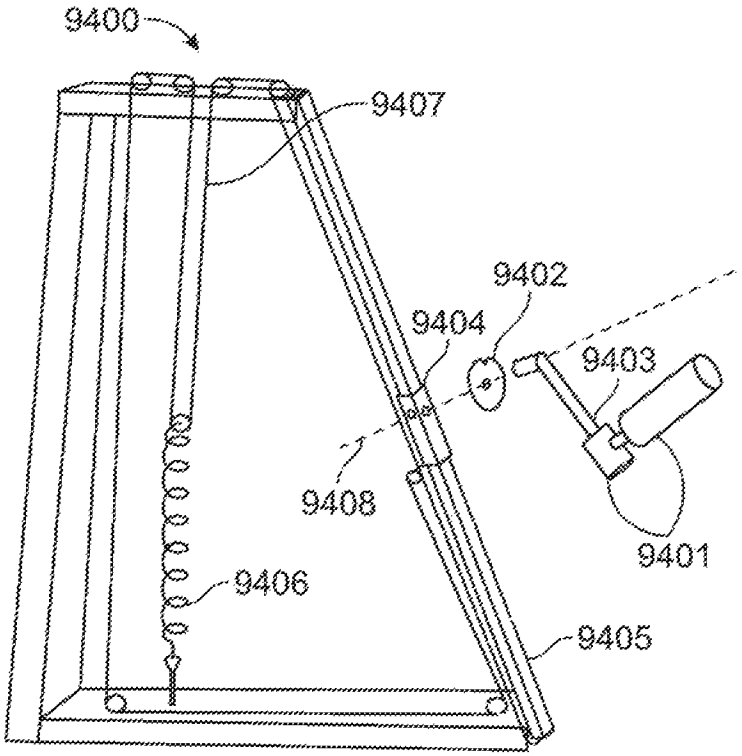
FIG. 94 is a perspective view of an embodiment of a free spin pad attachment attached to an attachment extension and attachment extension attached to a rotational resistance assembly and rotational resistance assembly rotatably mounted upon a direct carriage assembly, and direct carriage assemble adjustable in position on frame, with axis of rotation directed in an angle between horizontal and vertical, and resistance provided by spring.

Referring to FIG. 94, in one embodiment, system 9400 comprises free spinning pad attachment 9401 attached to attachment extension 9403. Optionally, attachment extension 9403 is attached to rotational resistance assembly 9402. Optionally, rotational resistance assembly 9402 is attached to an axle (not shown) and the axle (not shown) is attached to direct carriage assembly 9404. Preferably the direct carriage assembly is adjustable in height along frame 9405. Frame 9405 is optionally set at an angle other than vertical in order to provide an axis of rotation 9408 that is other than horizontal. Optionally, spring 9406 attaches to cable 9407 and preferably resists the rotation of rotational resistance assembly 9402. Optionally, frame 9405 holds direct carriage assembly 9404 such that the axis of rotation 9408 of the rotational resistance assembly is positioned at an angle up from horizontal. Optionally a person will stand in front of the rotational resistance assembly 9402 then turn their body 90 degrees so that the axis of rotation 9408 is directed towards their hip joint. The person will then place the pad of pad attachment 9401 onto their thigh and engage the rotational resistance engagement lock so that when the pad attachment 9401 rotates around the axis of rotation 9408, the resistance of the spring 9406 will resist their efforts through the overall operation of the system 9400, the person will then raise and lower their leg up and out to their side in order to exercise their body. The person then can optionally place their leg over the pad of pad attachment 9401 in a flexed hip position with the pad resting on their hamstring muscle, then the person can extend their hip and leg downward to an extended position in order to exercise against the resistance of the system 9400.

Figure 95:
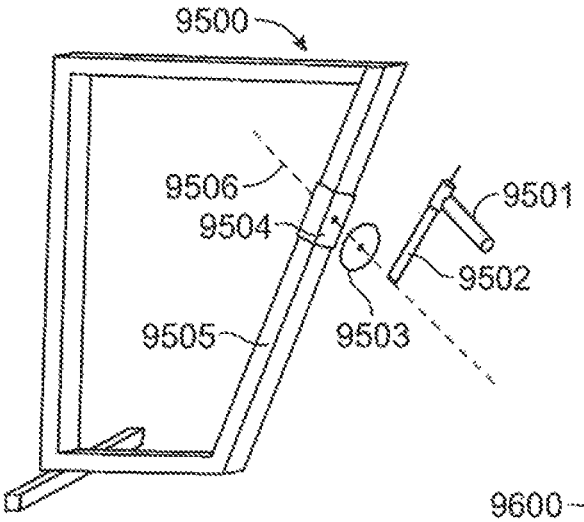
FIG. 95 is a perspective view of an embodiment of a free spin grip attachment attached to an attachment extension and attachment extension attached to a rotational resistance assembly and rotational resistance assembly rotatably mounted upon a direct carriage assembly, and direct carriage assemble adjustable in position on frame, with axis of rotation directed in an angle between vertical and horizontal.

Referring to FIG. 95, in one embodiment, system 9500 comprises free spinning grip attachment 9501 attached to attachment extension 9502. Optionally, attachment extension 9502 is attached to rotational resistance assembly 9503. Optionally, rotational resistance assembly 9503 is attached to an axle (not shown). The axle (not shown) is attached to direct carriage assembly 9504. Optionally, direct carriage assembly 9504 is adjustable in position on frame 9505. Optionally, frame 9505 is positioned at an angle down from vertical. Optionally, axis of rotation 9506 is perpendicular to frame 9505. Preferably, a user rotates free spinning grip attachment 9501 around axis of rotation 9506 in order to lift a resistance source (not shown). A user standing with the system to their side, and the axis of rotation 9506 directed towards their shoulder could optionally place the grip area of grip attachment 9501 behind their tricep muscle and move their arm in a motion similar to that of walking or running, in order to exercise their body. The resistance given by the system 9500 when used in this way will challenge a person's ability to stand stable, while moving their arm through a natural plane of motion. Optionally a person can then place the grip area on the other side of their arm, and exercise the opposite motion.

Figure 96:
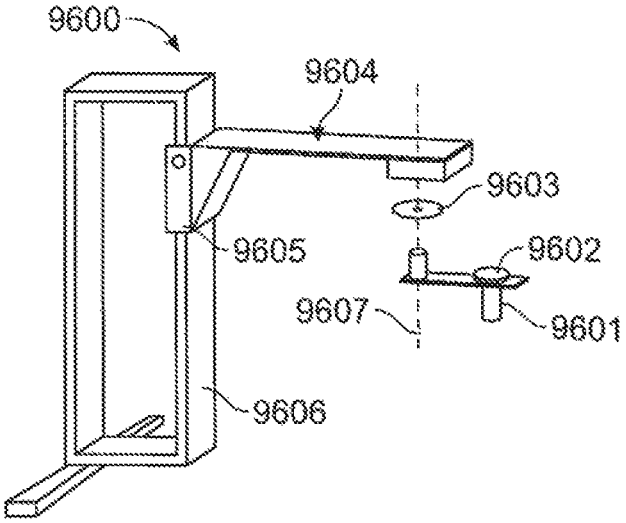
FIG. 96 is a perspective view of an embodiment of a perpendicular attachment attached to an attachment extension and attachment extension attached to a rotational resistance assembly and rotational resistance assembly rotatably mounted upon the frame extension, and frame extension adjustable in height upon the frame, with axis of rotation being vertical.

Referring to FIG. 96, in one embodiment, system 9600 preferably comprises weights (not shown), and a cable (not shown). Optionally, perpendicular attachment 9601 is attached to attachment extension 9602. Optionally, attachment extension 9602 is connected to rotational resistance assembly 9603. Optionally, rotational resistance assembly 9603 is rotationally connected to an axle (not shown). Optionally the axle (not shown) is connected to frame extension 9604. Optionally, frame extension 9604 is attached to direct carriage assembly 9605. Preferably, direct carriage assembly 9605 is adjustable in height on frame 9606. Preferably, when a user rotates perpendicular attachment 9601 around axis of rotation 9607, the cable (not shown) will lift the weights (not shown), preferably causing a rotational resistance to the user's effort. Optionally a person will stand underneath the axis of rotation 9607 and grasp the perpendicular attachment 9601 with one or both of their hands, then move their hands around the axis of rotation 9607 by also rotating their spine in a lateral and medial motion in order to work against the resistance of the system 9600.

Figure 97:
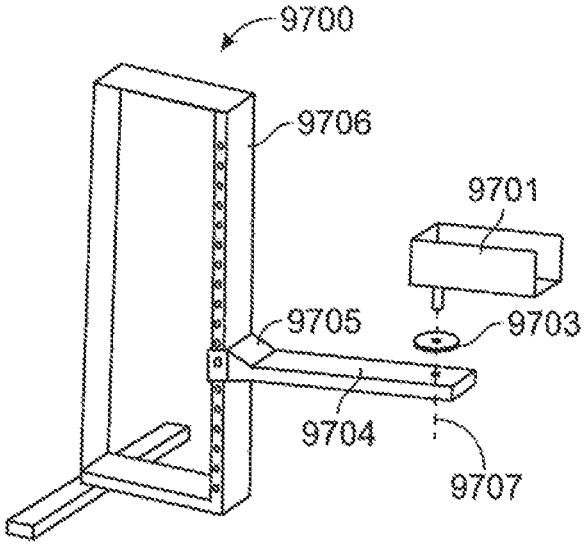
FIG. 97 is a perspective view of an embodiment of a femur rotation attachment attached to a rotational resistance assembly and rotation resistance assembly rotatably mounted upon the frame extension, and frame extension adjustable in height upon the frame, with axis of rotation being vertical.

Referring to FIG. 97, in one embodiment, system 9700 comprises weights (not shown), and a cable (not shown). Optionally, femur rotation attachment 9701 is attached to rotational resistance assembly 9703. Optionally, rotational resistance assembly 9703 is rotationally connected to an axle (not shown). Optionally, the axle (not shown) is connected to frame extension 9704. Optionally, frame extension 9704 is attached to direct carriage assembly 9705. Preferably, direct carriage assembly 9705 is adjustable in height on frame 9706. Preferably, when a user rotates femur rotation attachment 9701 around axis of rotation 9707 with their bent leg, the cable (not shown) will lift the weights (not shown), preferably causing a rotational resistance to the user's effort. Preferably, a user can adjust the height of frame extension 9704.

Figure 98:
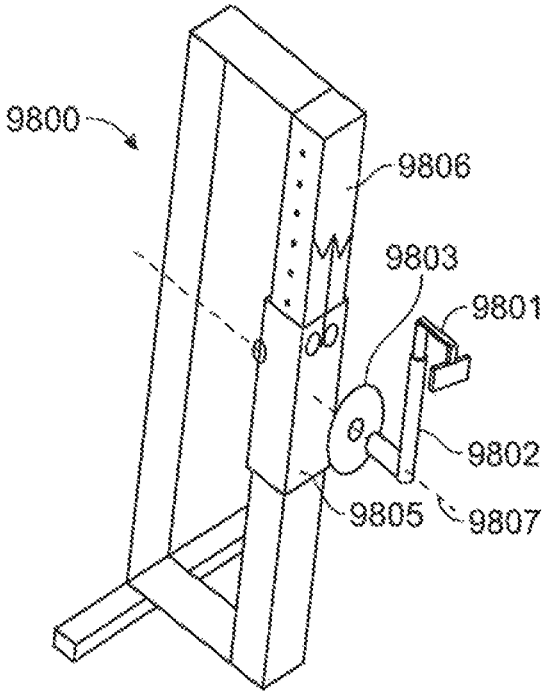
FIG. 98 is a perspective view of an embodiment of a free spinning grip attachment attached to an attachment extension, and the attachment extension attached to a rotational resistance assembly and rotation resistance assembly is rotatably mounted upon a direct carriage assembly, and direct carriage assembly is adjustable in height, with axis of rotation directed in an angle which is horizontal.

Referring to FIG. 98, in one embodiment, system 9800 comprises weights (not shown), and a cable (not shown). Optionally, free spinning grip attachment 9801 is attached to attachment extension 9802. Optionally, attachment extension 9802 is connected to rotational resistance assembly

9803. Optionally, rotational resistance assembly 9803 is rotationally connected to an axle (not shown). Optionally, the axle (not shown) is connected to direct carriage assembly 9805. Preferably, direct carriage assembly 9805 is adjustable in height on frame 9806. Preferably, when a user rotates perpendicular attachment 9801 around axis of rotation 9807, the cable (not shown) will lift the weights (not shown), preferably causing a rotational resistance to the user's effort. Optionally a person will stand with the system 9800 at their side and with the axis of rotation 9807 directed towards their elbow joint, then the person will grasp the handle of the perpendicular attachment 9801 with their hand, and rotate the handle around the axis of rotation 9807 by flexing and extending their elbow joint in a motion similar to that of curling a dumbbell.

Figure 99:
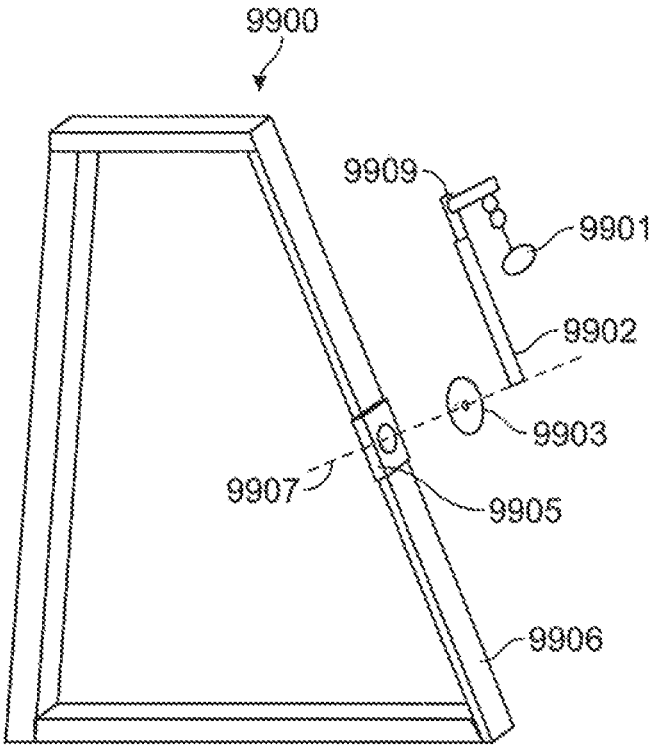
FIG. 99 is a perspective view of an embodiment of a connectable handle attached to an adjustable generic attaching point and adjustable generic attaching point is attached to an attachment extension, with the attachment extension attached to a rotational resistance assembly, the rotational resistance assembly is rotatably attached upon the direct carriage assembly, the direct carriage assembly is adjustable in position upon the frame, with axis of rotation directed at an angle which is between horizontal and vertical.

Referring to FIG. 99, in one embodiment, system 9900 comprises weights (not shown), and a cable (not shown). Optionally, connectable handle 9901 is attached to adjustable generic attaching point 9909. Optionally, adjustable generic attaching point 9909 is connected to attachment extension 9902. Optionally, attachment extension 9902 is connected to rotational resistance assembly 9903. Optionally, rotational resistance assembly 9903 is rotationally connected to an axle (not shown). Optionally the axle (not shown) is connected to direct carriage assembly 9905. Preferably, direct carriage assembly 9905 is adjustable in height on frame 9906. Preferably, when a user rotates connectable handle 9901 around axis of rotation 9907, the cable (not shown) will lift the weights (not shown), preferably causing a rotational resistance to the user's effort. Optionally a person will grasp connectable handle 9901 with their hand, and stand in a position so that the system 9900 is to their side, then they will flex and extend their shoulder in a way similar to that of throwing a ball in order to exercise against the resistance provided by the system 9900.

Figure 100:
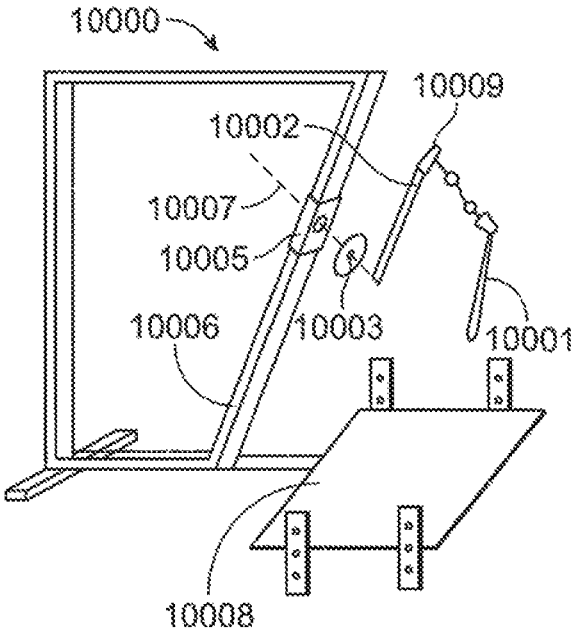
FIG. 100 is a perspective view of an embodiment of a connectable handle attached to a generic attaching point and generic attaching point is attached to an attachment extension, with the attachment extension attached to a rotational resistance assembly, the rotational resistance assembly is rotatably attached upon the direct carriage assembly, the direct carriage assembly is not adjustable in position upon the frame, with axis of rotation directed at an angle which is between horizontal and vertical and adjustable standing platform is mounted to the frame.

Referring to FIG. 100, in one embodiment, system 10000 comprises weights (not shown), and a cable (not shown). Optionally, connectable handle 10001 is attached to generic attaching point 10009. Optionally, generic attaching point 10009 is connected to attachment extension 10002. Optionally, attachment extension 10002 is connected to rotational resistance assembly 10003. Optionally, rotational resistance assembly 10003 is rotationally connected to an axle (not shown). Optionally, the axle (not shown) is connected to direct carriage assembly 10005. Optionally, direct carriage assembly 10005 is not adjustable in height on frame 10006, but is rather secured permanently to frame 10006. Preferably, when a user rotates connectable handle 10001 around axis of rotation 10007, the cable (not shown) will lift the weights (not shown), preferably causing a rotational resistance to the user's effort. Optionally, adjustable standing platform 10008 is connected to frame 10006. Preferably, a user can adjust adjustable standing platform 10008 to a desired height. A user preferably adjusts the height of adjustable standing platform 10008 to a level that will place the axis of rotation 10007 directed towards their abdomen as they stand on top of the adjustable standing platform 10008, then the user will stand on the adjustable standing platform 10008, and grasp with their hands the connectable handle 10001, the user will then bend their body at the waist in a way that is similar to a golfing stance, and move the connectable handle 10001 in a motion similar to that of a golf swing in order to ultimately rotate the rotational resistance assembly 10003 and exercise against the resistance provided by the system 10000. The axis of rotation 10007 will preferably be directed coincidental to the user's spine as they exercise.

Figure 101:
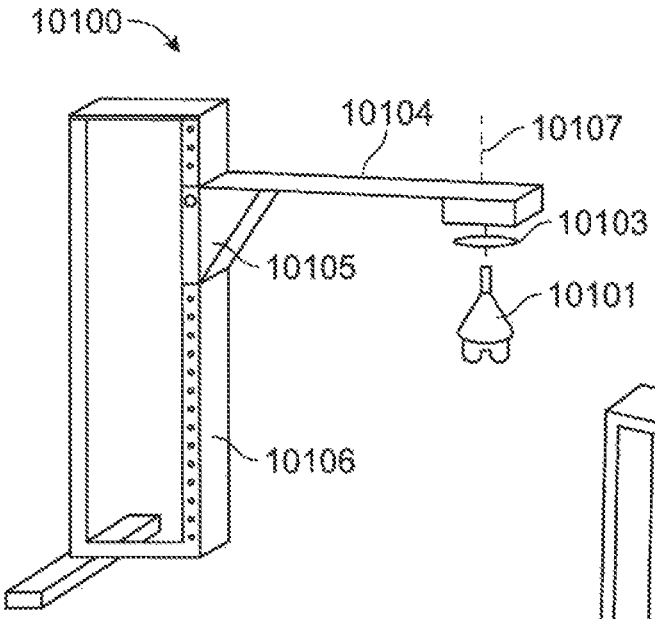
FIG. 101 is a perspective view of an embodiment of a head clamp attachment connected directly to a rotational resistance assembly, with the rotation resistance assemble rotatably connected to a frame extension, the frame extension is adjustable in position on the frame, the axis of rotation is vertical.

Referring to FIG. 101, in one embodiment, system 10100 comprises weights (not shown), and a cable (not shown). Optionally, head clamp attachment 10101 is attached to rotational resistance assembly 10103. Optionally, rotational resistance assembly 10103 is rotationally connected to an axle (not shown). Optionally, the axle (not shown) is connected to frame extension 10104. Optionally, frame extension 10104 is connected to direct carriage assembly 10105. Optionally, direct carriage assembly 10105 is adjustable in height on frame 10106. Preferably, when a user rotates head clamp 10101 around axis of rotation 10107, the cable (not shown) will lift the weights (not shown), preferably causing a rotational resistance to the user's effort. Optionally a user will adjust the height of the direct carriage assembly 10105 to a position that positions the head clamp 10101 at a place where the user can comfortable stand underneath it, then the user will stand under the axis of rotation 10107, and place their head inside of the head clamp attachment 10101, then secure it to their head, the user will then turn their head side to side in a similar fashion to that of gesturing "no" with their head in order to exercise against the resistance provided by the system 10100. Preferably, when a person is in a position ready to exercise, the axis of rotation 10107 will be coincidental with the axis of rotation of their neck.

Figure 102:
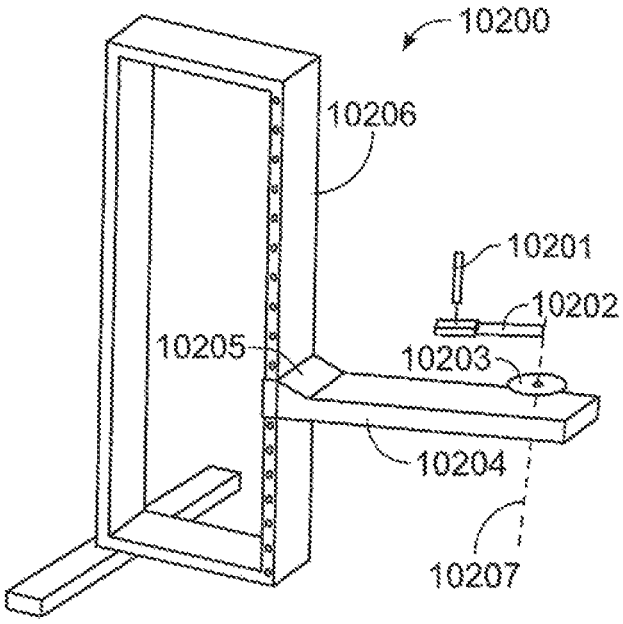
FIG. 102 is a perspective view of an embodiment of a free spin grip attachment attached to an attachment extension, the attachment extension is attached to the rotational resistance assembly, the rotational resistance assembly is rotatably connected to the frame extension, the frame extension is adjustable in position on the frame, the axis of rotation is vertical.

Referring to FIG. 102, in one embodiment, system 10200 comprises weights (not shown), and a cable (not shown). Optionally free spin grip attachment 10201 is attached to attachment extension 10202. Optionally, attachment extension 10202 is connected to rotational resistance assembly 10203. Optionally, rotational resistance assembly 10203 is rotationally connected to an axle (not shown). Optionally, the axle (not shown) is connected to frame extension 10204. Optionally, frame extension 10204 is attached to direct carriage assembly 10205. Preferably, direct carriage assembly 10205 is adjustable in height on frame 10206. Preferably, when a user rotates free spin grip attachment 10201 around axis of rotation 10207, the cable (not shown) will lift the weights (not shown), preferably causing a rotational resistance to the user's effort. Optionally a person will adjust the height of the direct carriage assembly 10205 to the same height of their waist, then the person will stand with the free spin grip attachment 10201 directly in front of them, and grip the handle surface with their hand, or hands, the person will then force the handle surface of the free spin grip attachment 10201 in a circular path around the axis of rotation 10207 in order to exercise their body against the resistance provided by the system 10200, preferably the motion will look similar to that of stirring a pot of stew.

Figure 103:
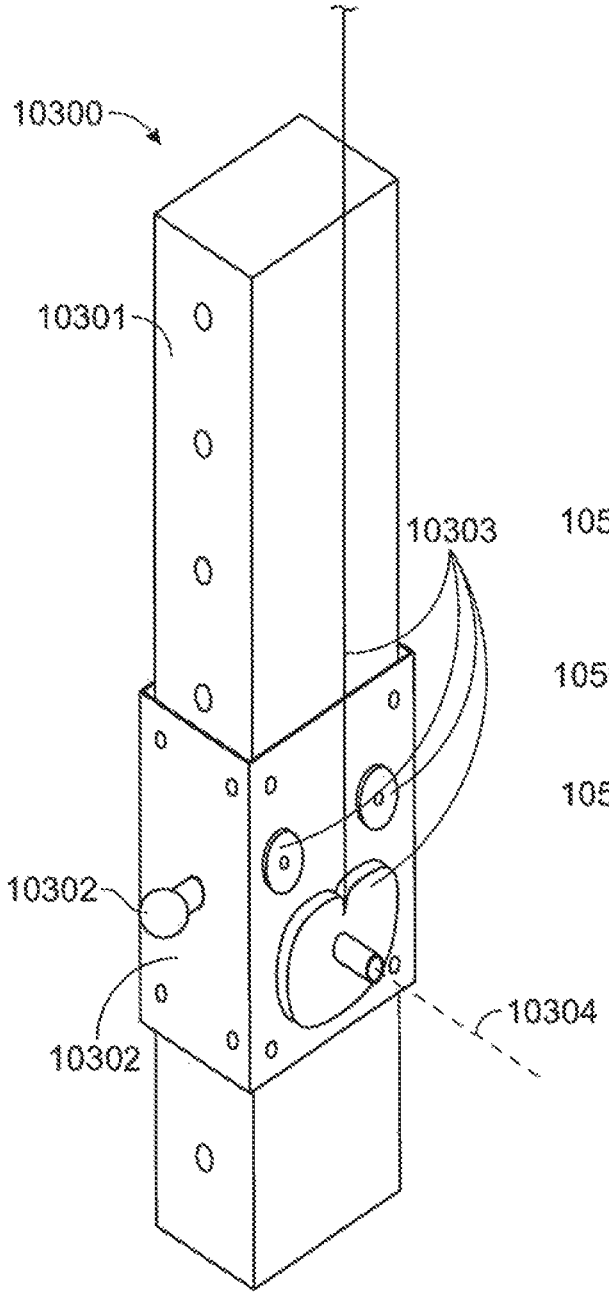
FIG. 103 is a perspective view of an embodiment of a direct carriage assembly with a rotational resistance assembly mounted to the direct carriage assembly. A frame is shown supporting the direct carriage assembly.

Referring to FIG. 103, in one embodiment, system 10300 comprises frame 10301 optionally supporting direct carriage assembly 10302. Optionally, direct carriage assembly 10302 has secured upon it rotational resistance assembly 10303. Preferably, axis of rotation 10304 is perpendicular to the face of the longest side of frame 10301 which direct carriage assembly 10302 is attached to. Optionally, direct carriage assembly 10302 is able to move along frame 10301.

Figure 104:
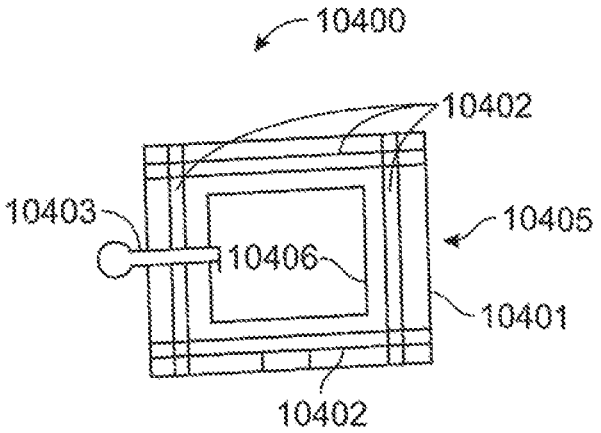
FIG. 104 is a sectional view of an embodiment of a direct carriage assembly on a frame.

Referring to FIG. 104, in one embodiment, system 10400 comprises a direct carriage assembly 10405 optionally comprising direct carriage 10401 with rollers 10402 mounted within direct carriage 10401. Direct carriage lock 10403 is optionally mounted on the surface of direct carriage 10401, and optionally passes through the surface of direct carriage 10401. Frame 10406 is optionally shown for reference as to how rollers 10402 optionally position direct carriage 10401 onto frame 10406. Direct carriage lock 10403 optionally passes through holes in frame 10406 preferably locking direct carriage 10401 in place on frame 10406. Rollers

10402 are optionally rotatably secured to direct carriage 10401. Preferably, when direct carriage assembly 10405 is moved upon frame 10406, rollers 10402 provide a reduction in friction between frame 10406 and direct carriage 10401. The direct carriage 10401 preferably will encompass a section of the perimeter of a frame 10406, and have rollers 10402 located between the direct carriage 10401 and frame 10406 which help the direct carriage 10401 glide easily upon the frame 10406.

Figure 105:
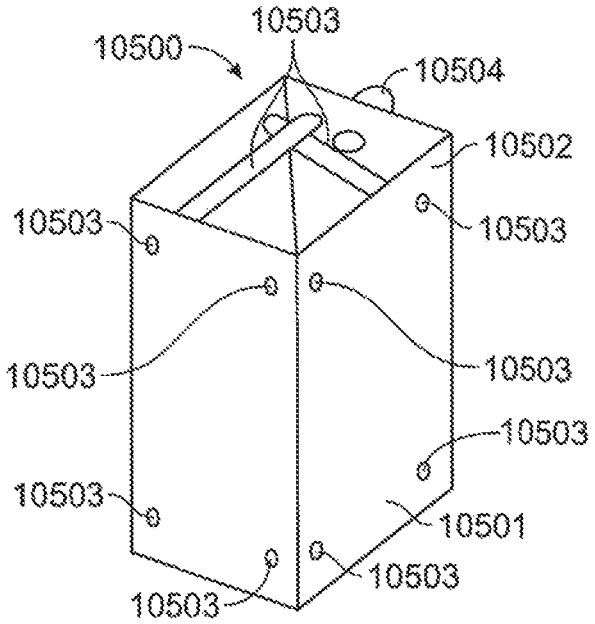
FIG. 105 is a perspective view of an embodiment of direct carriage assembly.

Referring to FIG. 105, in one embodiment, system 10500 comprises direct carriage assembly 10501, optionally comprising rollers 10503 rotatably mounted on direct carriage 10502. Optionally, direct carriage lock 10504 is mounted on the surface of direct carriage 10502 and passes through the surface of direct carriage 10502. Optionally, direct carriage assembly 10501 has an axle (not shown) attached to its surface. Optionally, direct carriage assembly 10501 has a rotational resistance assembly (not shown) secured to its surface. Optionally, direct carriage assembly 10501 has one end of a cable (not shown) attached to it. Optionally, direct carriage assembly 10501 has a cable (not shown) attached to it, and the other end of the cable (not shown) is attached to a counterweight (not shown). Optionally, direct carriage 10502 is movable on the frame (not shown) by, for example, an electric motor assistance system or the like (not shown).

Figure 106:
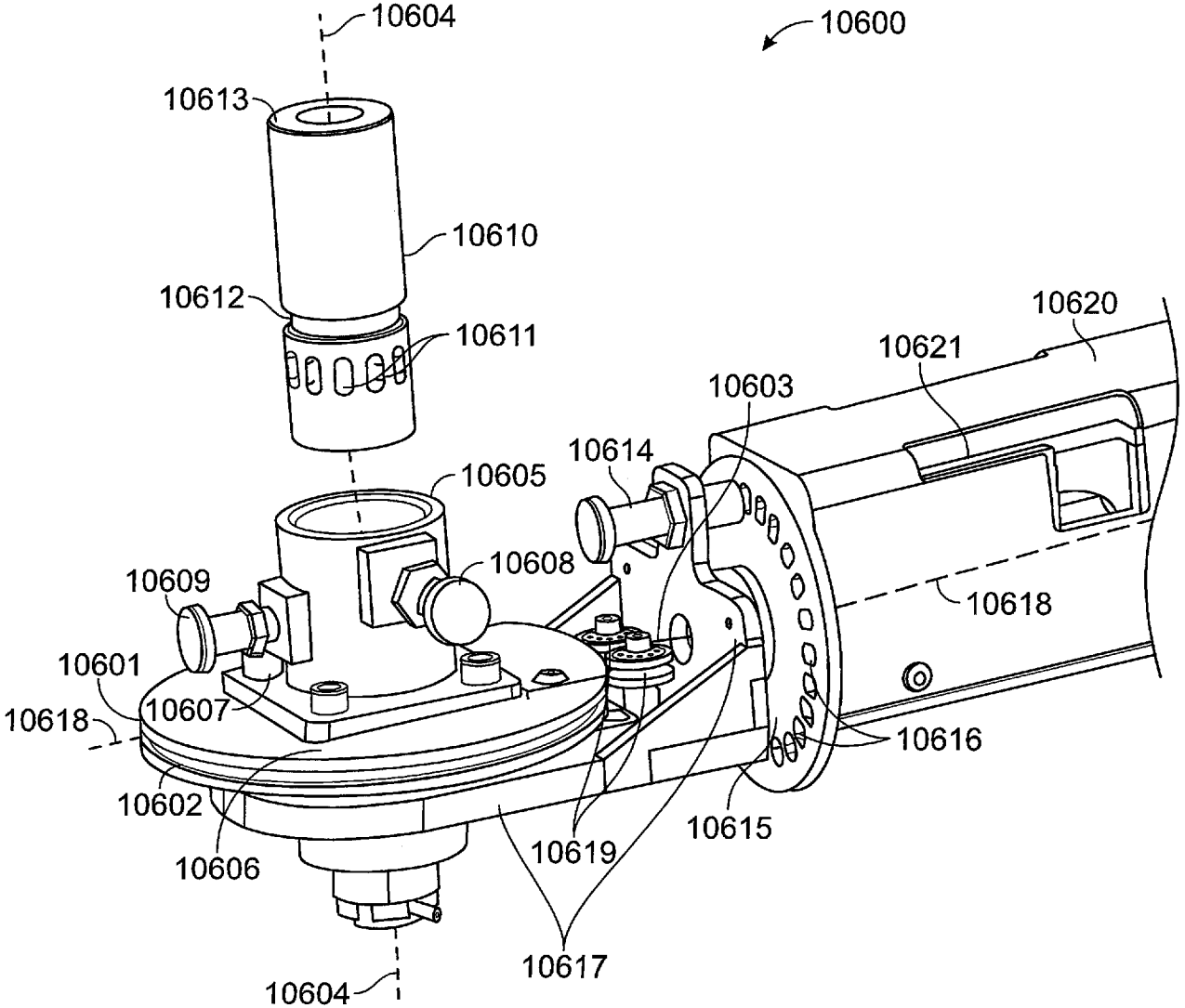
FIG. 106 is a detail of a wheel hub assembly interface of the present invention.

Referring to FIG. 106, wheel hub assembly Interface 10600 comprises the wheel 10601 which has groove 10602 on its periphery which allows wheel 10601 to wrap up cable 10603 when it rotates about wheel axis of rotation 10604. Wheel hub assembly 10605 is mounted to the wheel face 10606 by bolts 10607 such that they rotate together about the wheel axis of rotation 10604. Wheel hub assembly 10605 has on its sides first pop pin 10608 which extends through the side of wheel hub assembly 10605, and second pop pin 10609 which also extends through the side of wheel hub assembly 10605. When attachment extension port plug 10610 is inserted into the wheel hub assembly 10605, a user must disengage first pop pin 10609 by pulling it away from the wheel axis of rotation 10604, then slide the attachment extension port plug 10610 partially into the wheel hub assembly 10605. Then the user must disengage second pop pin 10609 by pulling it away from the wheel axis of rotation 10604, followed by further inserting the attachment extension port plug 10610 into the wheel hub assembly 10605, after which both pop pin one 10606 and pop pin two 10609 will automatically engage into slots 10611 and safety catch 10612 by their internal spring tension, which is always trying to re-engage to their resting position. Attachment surface 10613 is where an attachment of some sort (not shown) is temporarily or permanently attached to the attachment extension port plug 10610 such that when a user moves the attachment in a motion around the wheel axis of rotation 10604, the inserted attachment extension port plug 10610 will ultimately cause the wheel 10601 to wrap up the cable 10603, and the cable 10603 will pull on the resistance source such as a weight stack (not shown), thereby giving the user a force upon which to exercise different parts of their body. Wheel tilt lock 10614 is similar to an indexing pin found at a local hardware store and is mounted to wheel base 10617. The engagement portion of the pin (not shown) fits into one of the tilt holes 10616 in tilt receiver 10615, thereby locking the wheel base 10617 in place at a desired angle. Wheel base 10617 preferably comprises internal bearings (not shown), and races (not shown) which allow the wheel hub assembly 10605 to rotate within the wheel base 10617, and be supported by wheel base 10617. Optionally a person can arrange the wheel axis of rotation 10604 to a plurality of positions by repositioning the wheel base 10617 and this is done by grasping the wheel tilt lock 10614 and pull it away from the tilt holes 10616 in order to disengage the wheel tilt lock 10614, then a person can rotate the wheel base 10617 around the wheel base axis of rotation 10618, which is coincidental with the path of cable 10603 as it enters between small pulleys 10619. Then the person re-engages the wheel tilt lock 10614 into one of the tilt holes 10616. The resulting new position of the wheel face 10606 will move from the upward position as shown to a different position such as facing ninety degrees to the side, or facing downwards towards the ground. Side stand lock 10621 is a feature which allows a person to secure the side stand (not shown) into the main arm 10620. This will allow a user to stand on top of the side stand (not shown) and have it remain in a stationary position without sliding around on the ground. The main arm 10620 is attached to the multi-function rotational resistance exercise apparatus.

Figure 107:
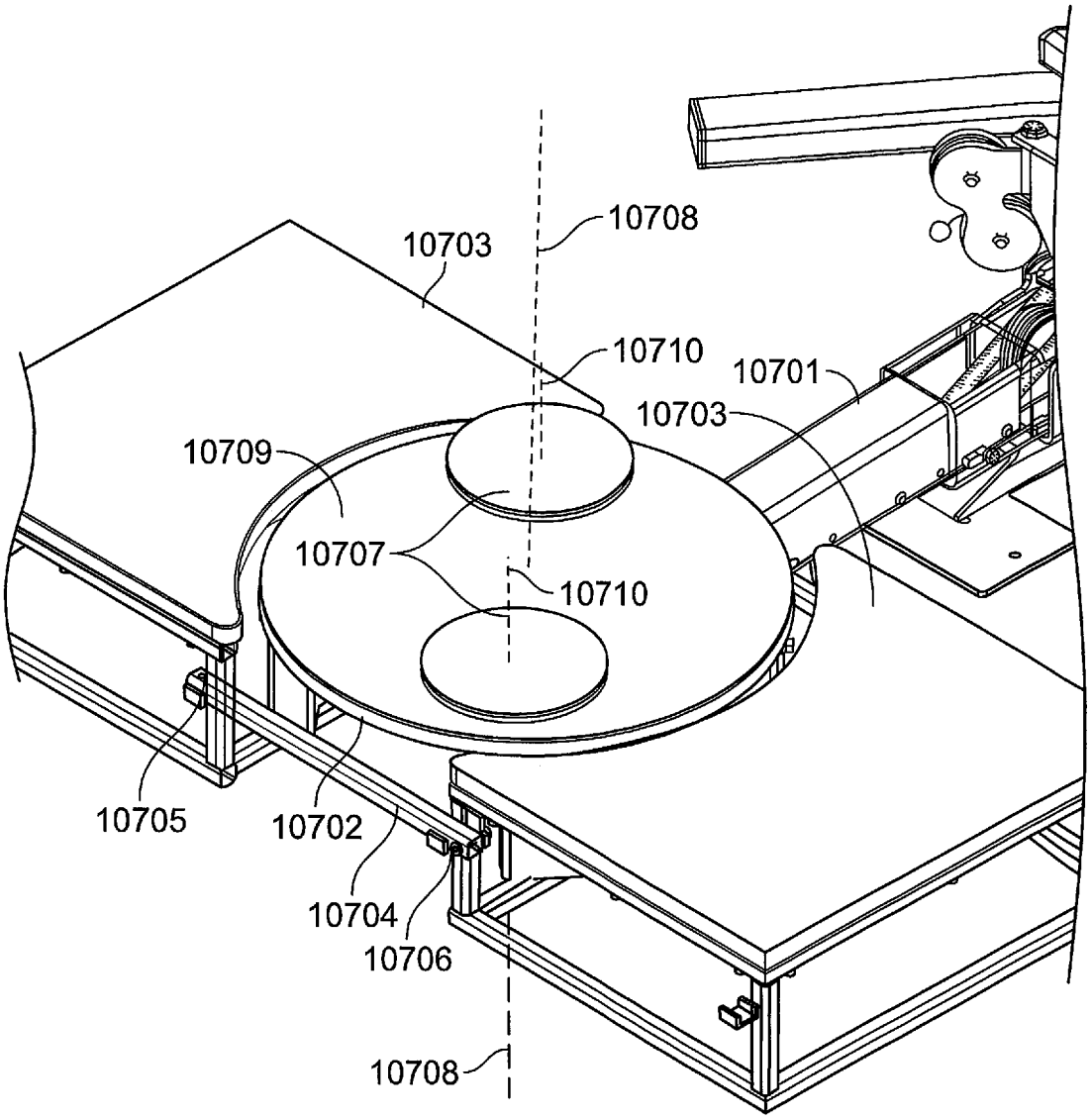
FIG. 107 shows a twin free spin foot plate attachment of the present invention.

Referring to FIG. 107, main arm 10701 is preferably placed into its lowest position resting on the ground, and comprises twin free spin foot plate attachment 10702 mounted onto the wheel hub assembly (not shown). Two side stands 10703 are preferably attached to main arm 10701 by one or more side stand locks (not shown). When in operation the side stands 10703 have the side stand gate 10704 in the locked position where the peg (not shown) on one side stand 10703 is inserted into a hole 10705 on one end of the side stand gate 10704, and the other end of the side stand gate is mounted rotatably to the other side stand 10703 at hinge point 10706. Any other means of closure may be used. This side stand gate allows a user to temporarily link the two side stands 10703 together creating a more stable platform to stand upon. A user can stand with one or two feet upon the side stands 10703 while then placing one or both feet upon the free spin foot plate attachment 10702. With one or both feet upon the free plates 10707, a user can then rotate the entire free spin foot plate attachment 10702 around the wheel axis of rotation 10708. The free plates 10707 are mounted to the main surface 10709 with a common shaft and bearing system (not shown) in such a way that the free plates can each freely spin on its own free axis of rotation 10710, each of which is independent of the wheel axis of rotation 10708. The main surface 10709 is connected to the attachment extension port plug (not shown). Preferably a person will with their hands or feet rotate the free plates 10707 in a path around the wheel axis of rotation 10708, and their hands or feet will be able to spin on the free axis of rotation 10710 while simultaneously creating a force to exercise against the resistance provided by the rotation of the attachment extension port plug which is connected to the multi-function rotational resistance exercise apparatus.

Figure 108:
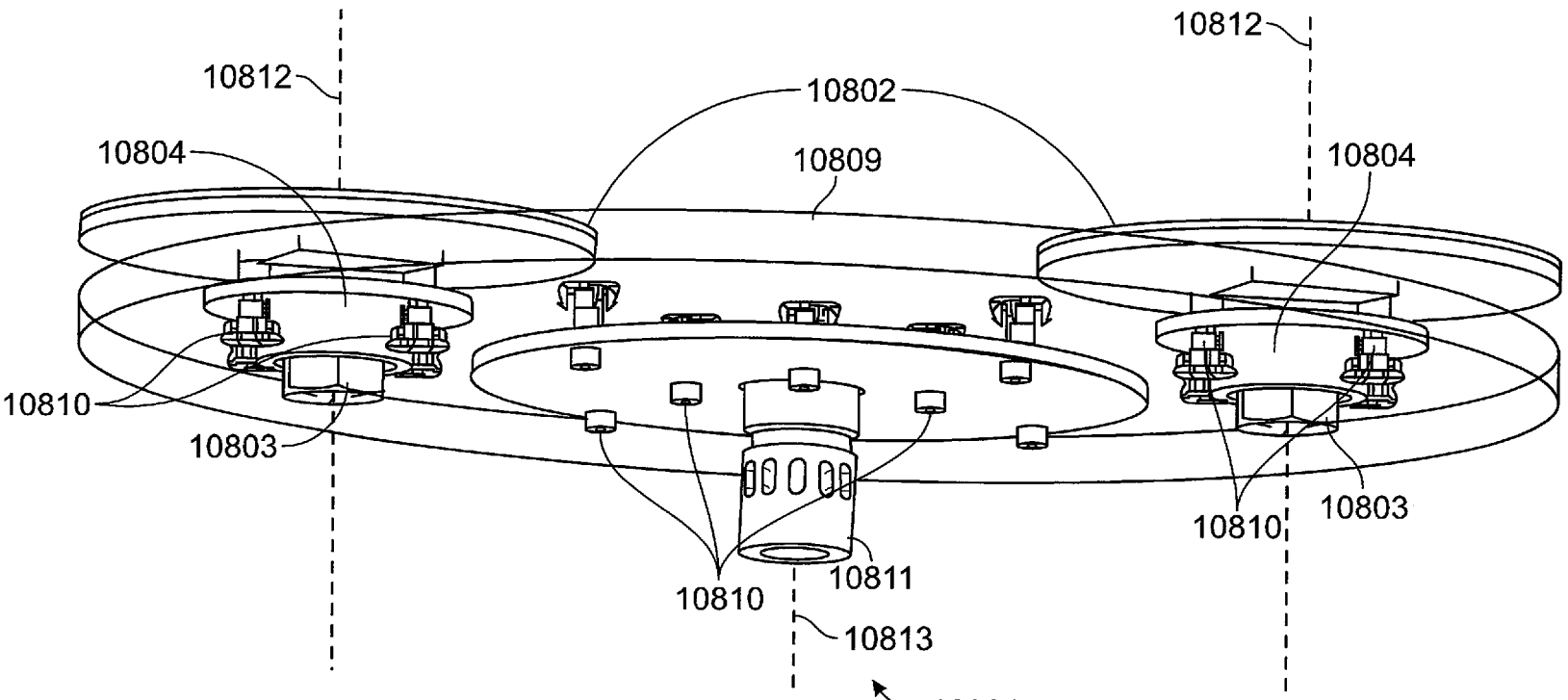
FIG. 108 shows a side view of the twin free spin foot plate attachment.

Referring to FIG. 108, a transparent view, a twin free spin foot plate attachment 10801 comprises two free plates 10602 mounted to axles 10603 which are surrounded on the periphery by bearings (not shown). The bearings are mounted within the housings 10804, and the housings 10804 are secured to the main surface 10809 by bolts 10610. The main surface 10809 is also mounted to the attachment extension port plug 10811 with bolts 10810. The free plates 10802 rotate freely upon the bearings around the free axis of rotation 10812, and the entire twin free spin foot plate attachment rotates around the wheel axis of rotation 10613. The attachment extension port plug 10811 can optionally be inserted into a wheel hub assembly (not shown) or into an attachment extension port (not shown).

Figure 109:
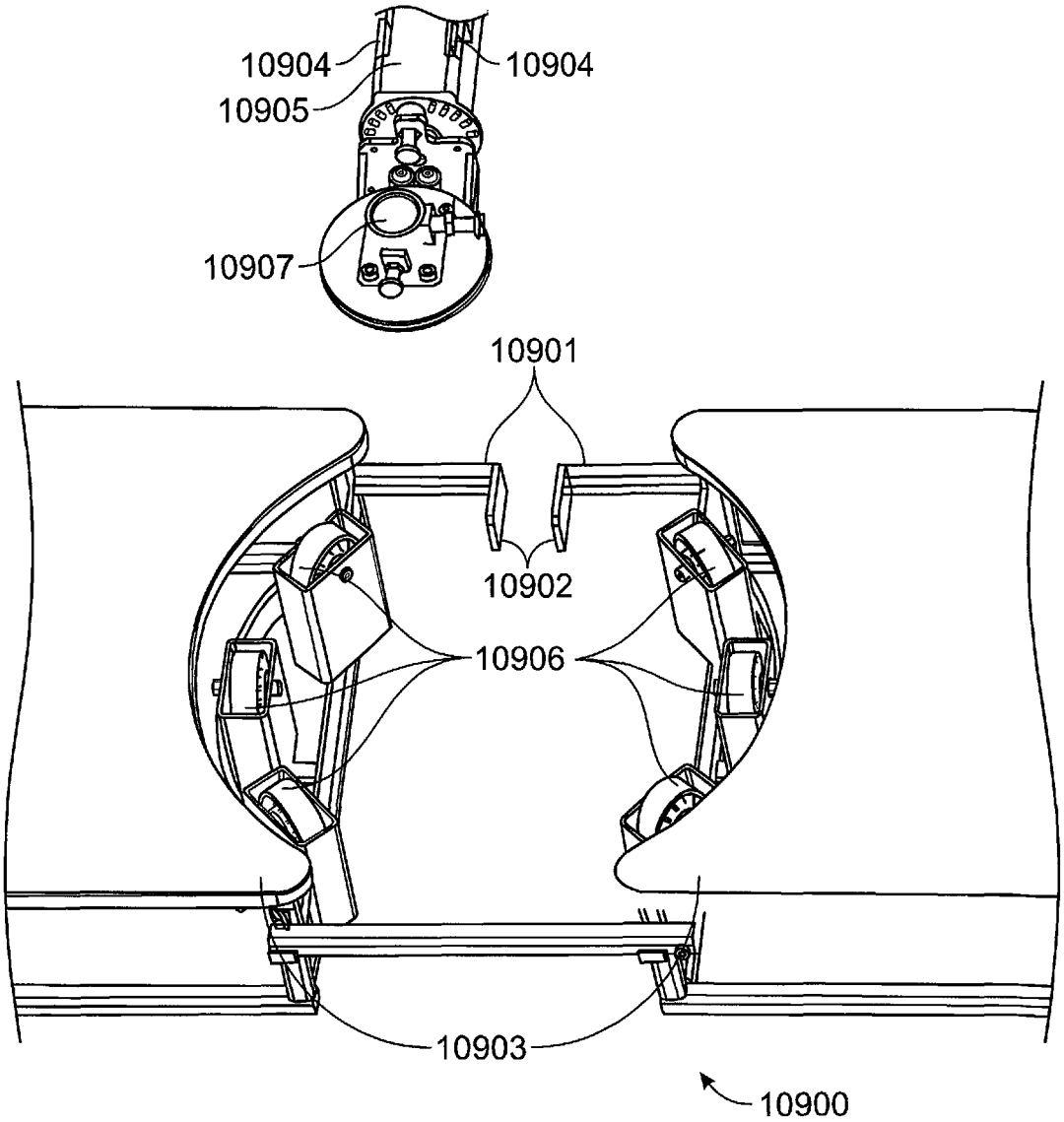
FIG. 109 shows a side stand assembly for use with, for example, the twin free spin foot plate attachment.

Referring to FIG. 109, side stand assembly 10900 comprises side stands 10903 which lock into main arm 10905 keeping the side stands 10903 from sliding around on the floor when a person is standing on them. The side stands 10903 preferably comprise side stand stabilizers 10901 that have features 10902 which easily slide into feature receivers 10904 on main arm 10905. Side stands 10903 preferably comprise rollers 10906 mounted on them in such a way that the rollers 10906 can support the under-side of an attachment such as a twin free spin foot plate, described above. The rollers 10906 allow a person to rotate the attachment without the attachment becoming unstable. The arm 10905 is shown in an elevated position above the side stands 10903, and preferably a person would lower the arm 10905 to a position resting on the floor, then the person would lift the side stands 10903 and set the features 10902 down into the feature receivers 10904, thereby securing the side stands in place on the floor but also temporarily attached to the arm 10905. The person would then proceed to optionally insert the attachment into the wheel hub assembly 10907 and simultaneously rest the twin free spin foot plate, for example, on top of the rollers 10906.

Figure 110:
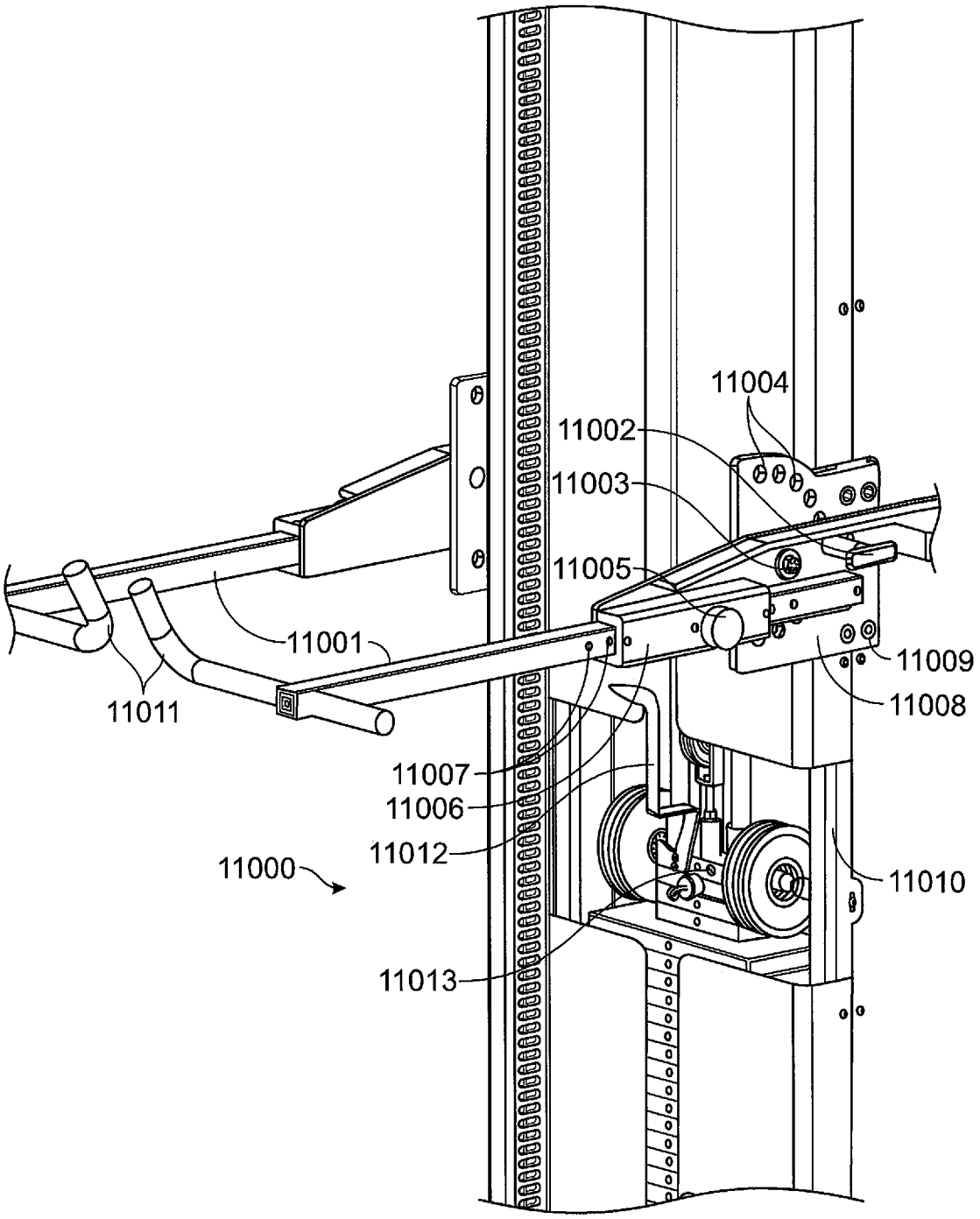
FIG. 110 shows adjustable support handles for use with the apparatus of the present invention.

Referring to FIG. 110, in one embodiment a multifunction rotational resistance exercise apparatus 11000 comprises safety handles 11001 that can safely support the weight of a person. A person could change the height of the safety handles 11001 by disengaging first pop pin 11002 and rotating the safety handle 11001 around hinge 11003 then re-engaging first pop pin 11002 into one of the height holes 11004. A person can also change the overall length of the safety handles 11001 by disengaging second pop pin 11005 and sliding the safety handle 11001 further inside of or further outside of receiver 11006 then re-engaging second pop pin 11005 back into one of the holes 11007. The height holes 11004 are part of the base plate 11006 which is bolted to the frame 11010 by bolts 11009. Hinge 11003 hinges on base plate 11008. Grips 11011 are secured to safety handles 11001 and provide a place for a person to grasp with their hand or rest a part of their body. A person for instance could set the safety handles 11001 to a desired height, or even differing heights, then do pull-up exercises, or dip exercises on the grips 11011. Optionally range of motion indicator 11012 is secured to the first weight 11013. First weight 11013 moves up and down when a person rotates the attachment extension port (not shown) or the wheel hub assembly (not shown), thus moving the range of motion indicator 11012 up and down. A simple sticker (not shown) could be placed on a part of the multifunction rotational resistance exercise apparatus 11000, which could have hash marks on it representing the corresponding degrees in which a person is rotating the attachment extension port (not shown). This would be beneficial to a user by showing them how many degrees their range of motion is when performing a particular exercise.

Figure 111:
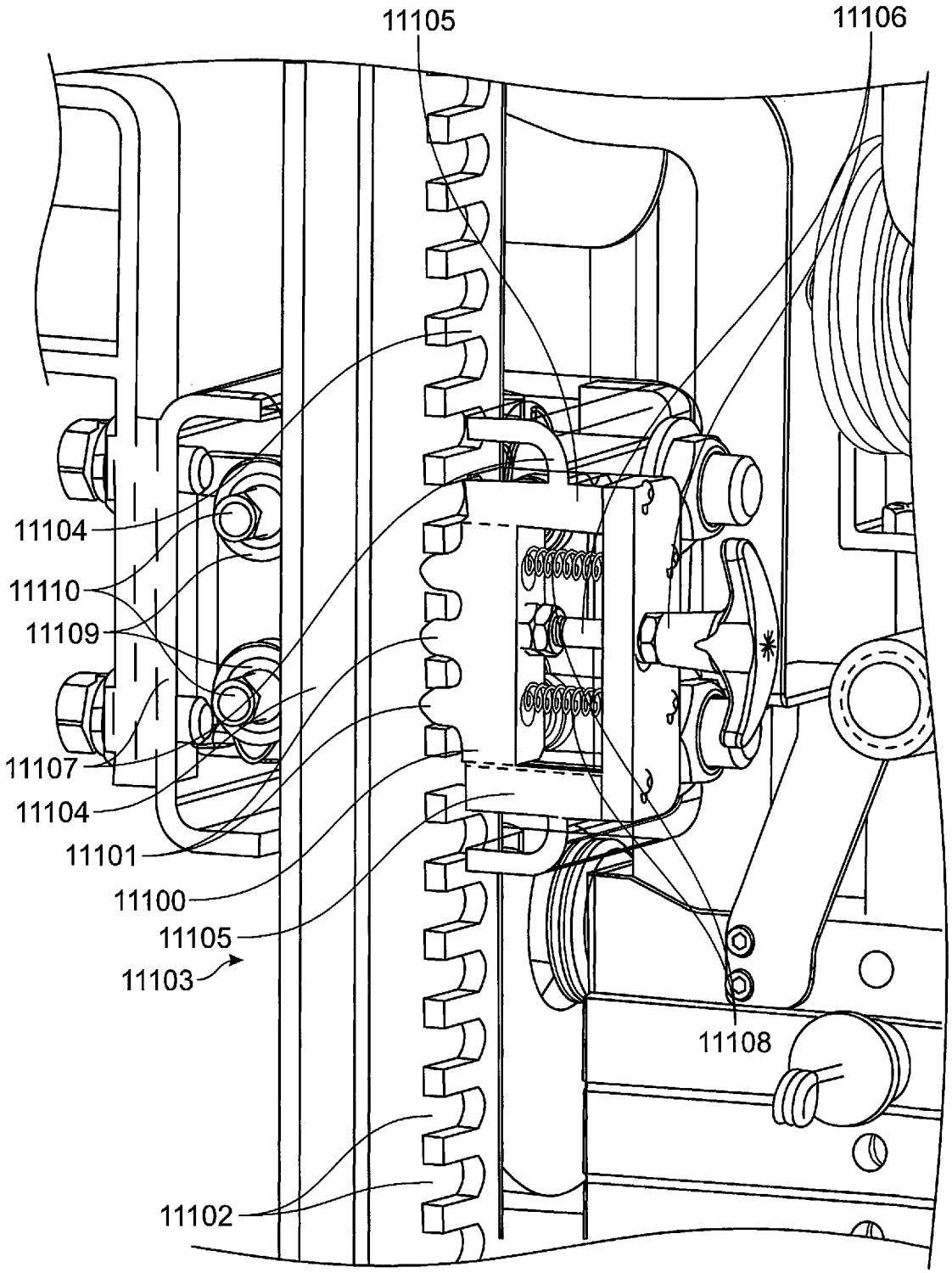
FIG. 111 shows a side perspective view of the main arm carriage assembly.

Referring to FIG. 111, in one embodiment a cross sectional view of the main arm carriage assembly 11103 comprises main arm lock cog 11100 comprising protrusions 11101 that fit inside slots 11102 which are in main post 11104. Cog box 11105 is a feature of main arm carriage 11107 and houses within it the lock cog 11100 along with springs 11108, such that lock cog 11100 rests inside of and slides smoothly within cog box 11105. Lock cog 11100 is attached to pull handle 11106, such that when pull handle 11106 is moved in a direction away from the main post 11104, the main arm lock cog 11100 will be pulled out of the slots 11102 in the main post 11104, and then the person will be able to move the main arm carriage 11107 along the main post 11104. The lock cog 11100 engages several slots 11102 in main post 11104 at one time in order to be able to support the weight of a person. Rollers 11109 roll on axles 11110 and axles 11110 are mounted to the main arm carriage 11107. The rollers touch the main post 11104 such that when a person is moving the main arm carriage 11107 along the main post 11104, the rollers 11104 reduce the friction of the motion while also keeping alignment of the motion.

Figure 112:
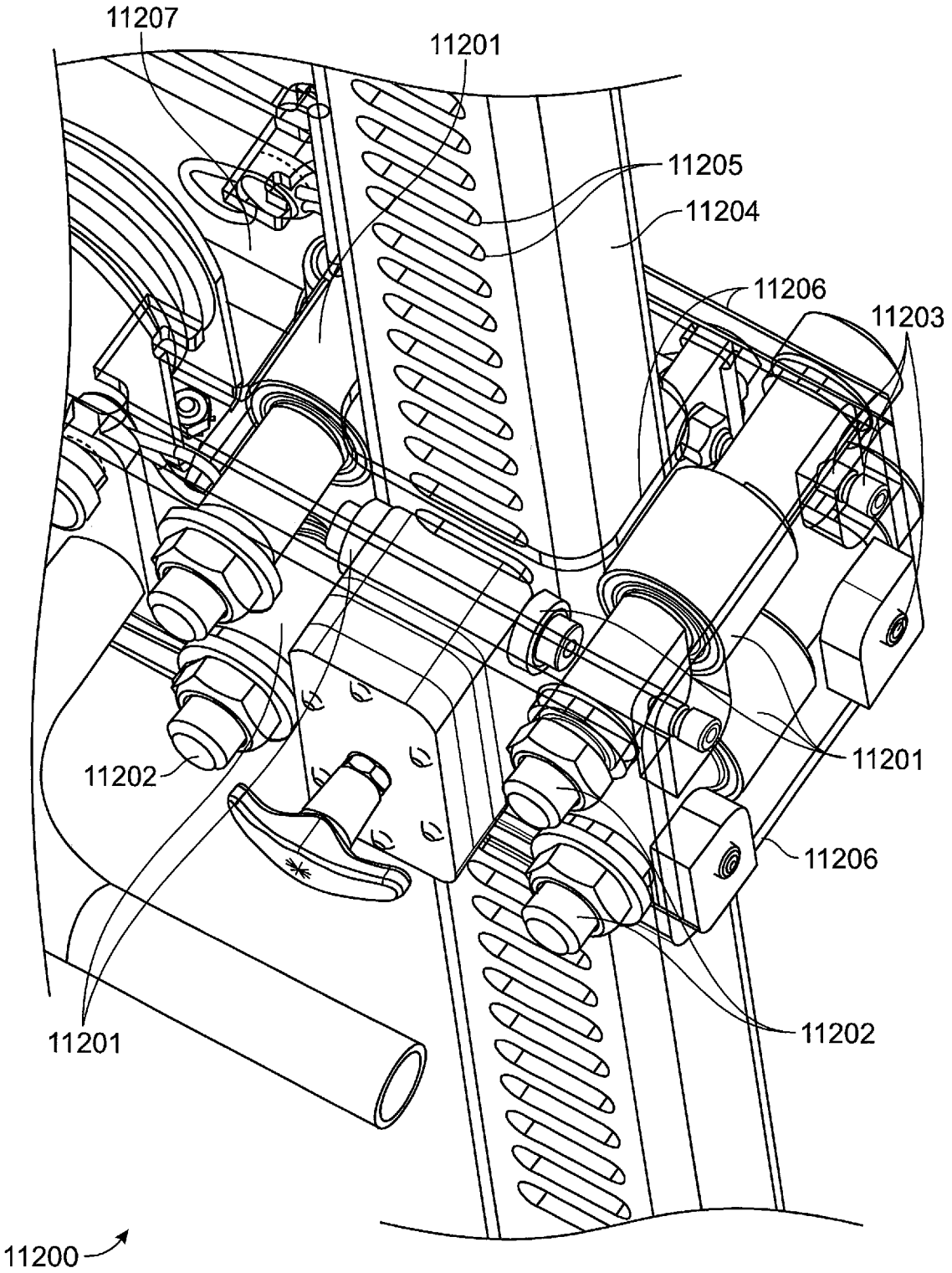
FIG. 112 shows a top perspective view of the main arm carriage assembly.

Referring to FIG. 112, a transparent view of the main arm carriage assembly 11200 shows some of the optional internal features of the main arm carriage assembly 11200. Rollers 11201 are mounted with bearings (not shown) between themselves and shoulder bolts 11202. Set screws 11203 are used to adjust the distance between the rollers 11201 and the main post 11204 by pressing against the shoulder bolts 11202 and moving them closer to the main post 11204. The shoulder bolts 11202 pass through holes in the main arm carriage 11206 which is shown in an outlined transparent view. The weight, movement and stresses placed upon the main arm 11207 and the main arm carriage 11206 are partially transferred to the rollers 11201, and the lock cog (not shown) and from the rollers 11201, and the lock cog (not shown) to the main post 11204. The main post 11204 is capable of accepting the stresses placed upon it by the ordinary use of a person exercising on the apparatus without breaking the main post 11204. Slots 11205 in main post 11204 provide features for the lock cog (not shown) to engage and keep the main arm carriage assembly 11200 in a stationary position upon the main post 11204.

Figure 113:
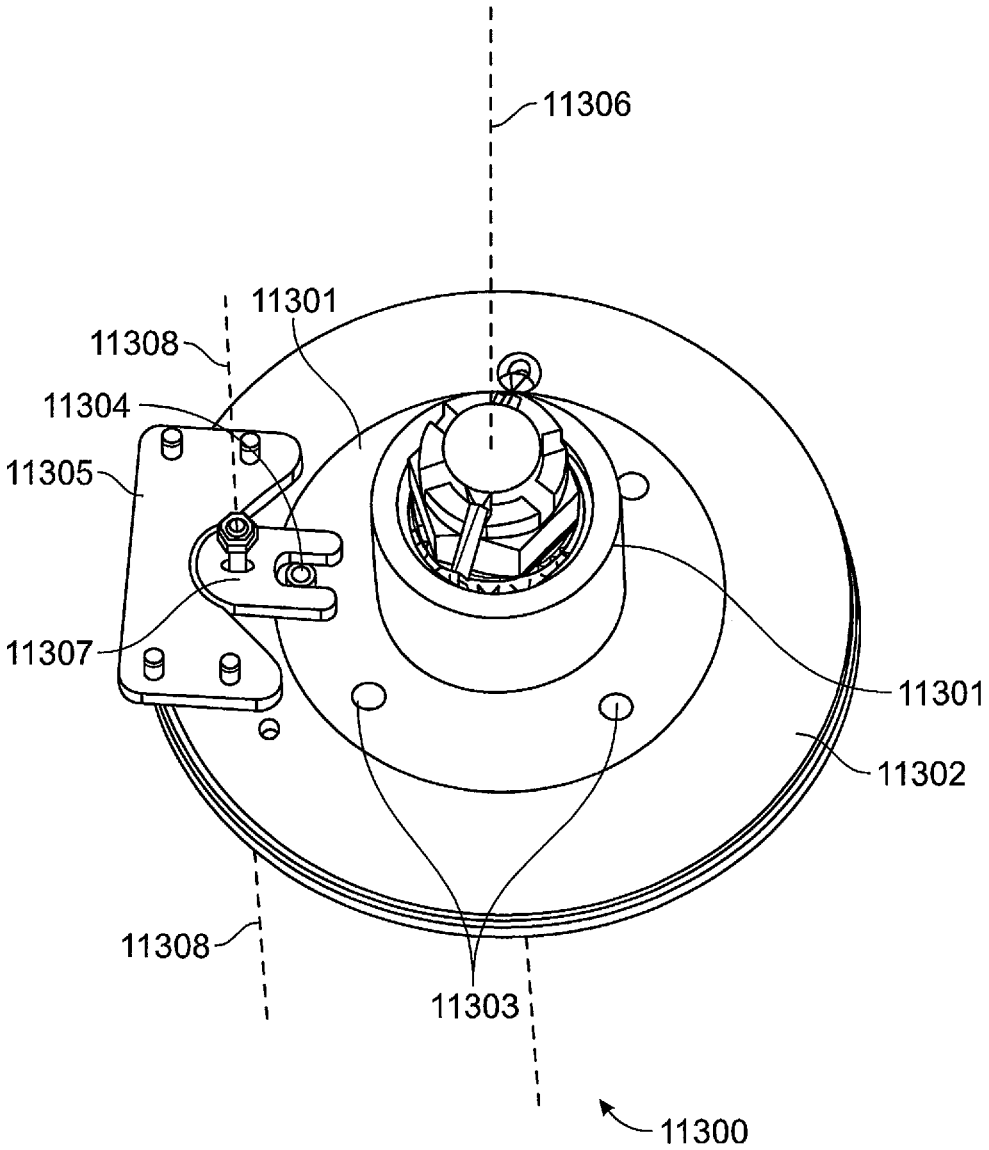
FIG. 113 shows a wheel rotation limiter of the present invention.

Referring to FIG. 113, in one embodiment a wheel rotation limiter 11300 comprises a gate 11307, shown in its starting or resting position. The purpose of the wheel rotation limiter 11300 is to keep a person from rotating an attached attachment (not shown) up to one full rotation around the axis of rotation 11306 in either the clockwise or counterclockwise direction, but no more than one full rotation in either direction. The hub 11301 is mounted by bolts 11303 to the wheel 11302. The hub 11301 has a peg 11304 attached to it and the peg 11304 is protruding. When the combined hub 11301 and wheel 11302 rotate around the axis of rotation 11306, the peg 11304 will encompass a path around the axis of rotation 11306 as well, and in doing so the peg 11304 will move the gate 11307, which is made out of steel, around its own gate axis of rotation 11306, then the gate 11307 will touch a portion of gate stopper 11305 and be held in place by a magnet (not shown). While the gate 11307 is held in position by the magnet, a user can continue rotating the hub 11301 in the same direction around the axis of rotation 11306 until the peg 11304 makes a full rotation around the axis of rotation 11306 and then collides with a protrusion of the gate 11307 that is now in the path of the peg 11304. When a person rotates the hub in the clockwise direction for instance, and the peg 11304 pushes against the gate 11307 and the gate 11307 will rotate counterclockwise a small amount then will be held by a magnet (not shown) in a position of being rotated counterclockwise around the gate axis of rotation 11308, and the peg 11304 will then be able to move along its path undisturbed by the gate 11307, until the peg 11304 makes a full circle around the axis of rotation 11306 and comes into contact with the gate 11307 for the second time. Now the gate 11307 cannot rotate counter clockwise around the gate axis of rotation 11308 any further because it is resting against the gate stopper 11305, so the peg 11304 collides with the side of the gate 11307, and the peg 11304 cannot continue rotating around the axis of rotation 11306, thereby effectively the motion of the hub 11301 has been stopped from going further than one full rotation clockwise. When the peg 11304 returns back to its starting position by rotating back counterclockwise, around the axis of rotation 11306 and in doing so the peg 11304 will come back into contact with the gate 11307 which is still being held by a magnet (not shown) in the position of being rotated somewhat counterclockwise around the gate axis of rotation 11308. The peg 11304 will slide into the opening of the gate 11307, and pull the gate 11304 from the hold of the magnet and return the gate 11307 to its original starting position. From its starting position, the wheel 11302 and hub 11301 together will be able to make one full turn around the axis of rotation 11306 in the clockwise direction, and no more, then return to the starting position, then optionally make one full turn around the axis of rotation 11306 in the counterclockwise direction, and no more, and then return to its starting position.

Figure 114:
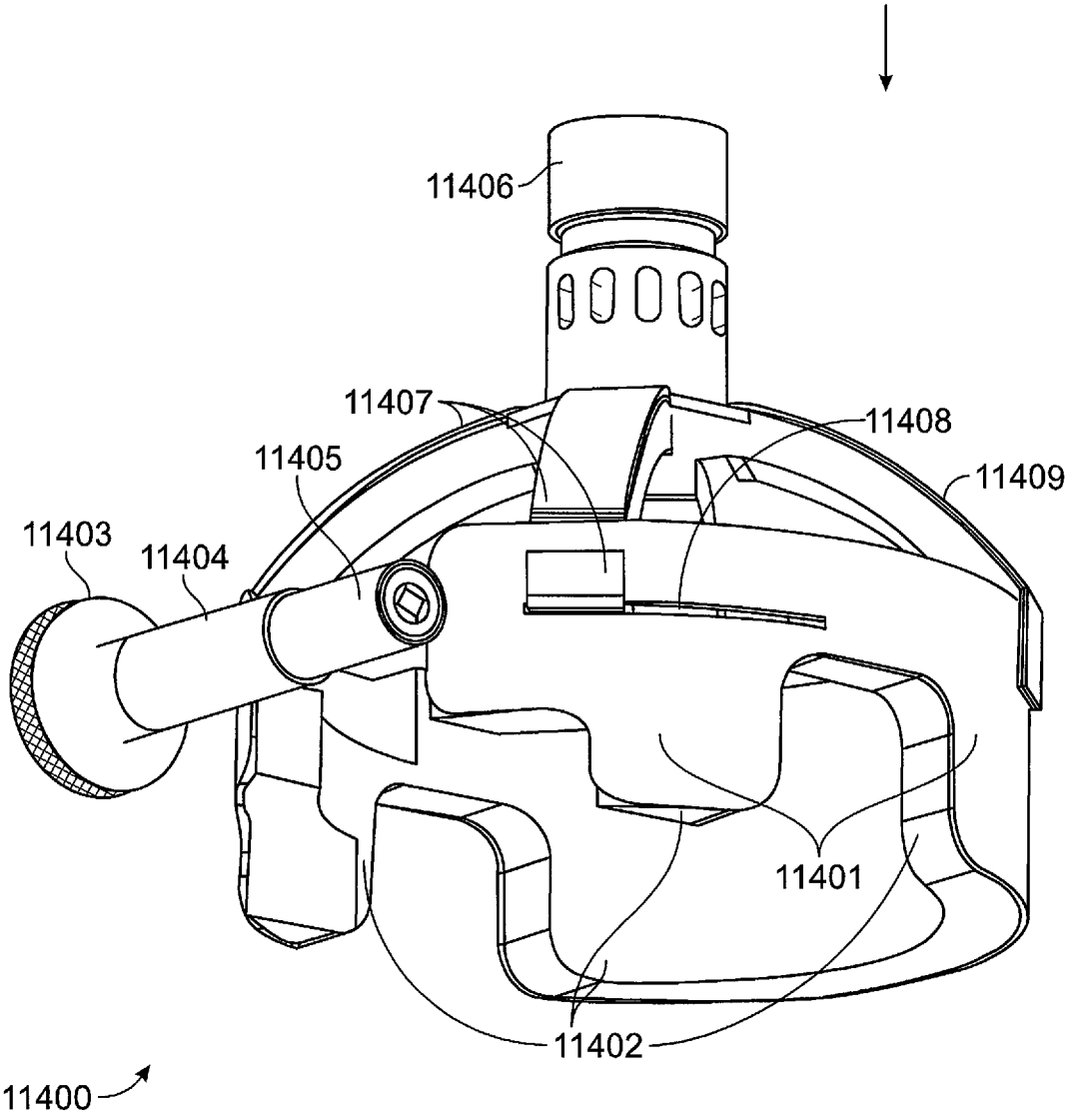
FIG. 114 shows a head clamp attachment of the present invention.

Referring to FIG. 114, a head clamp attachment 11400 comprises an outer band 11401, with optional padding 11402 glued to its inside surface similar to padding found on common helmets. A person can secure the head clamp attachment 11400 to their head by pulling it downward (as indicated by the direction arrow) upon the crown of their head with their forehead facing the outer sleeve 11404. Then the person will turn knob 11403 in a direction that draws the outer sleeve 11404 and the inner sleeve 11405 further inside of one another. By turning knob 11403, a person can effectively tighten or loosen the head clamp attachment 11400 onto their head in order to secure it to their head or remove it from their head. The surface or outer sleeve 11404 is optionally welded to the person's right side of outer band 11401, and the inner sleeve 11405 is optionally welded to the person's left side of outer band 11401. Padding 11402 makes the head clamp attachment 11400 comfortable for a person to wear, and provides a surface upon which they can press parts of their head in order to rotate attachment extension port plug 11406 when it is inserted into a multi-function rotational resistance exercise apparatus (not shown). Optionally sliding spoke 11407 is attached at one end to the attachment extension port plug 11406, and the other end slides through slot 11408 and is bent partially in order to keep it in slot 11408. Spoke 11409 is optionally permanently attached at one end to the attachment extension port plug 11406, and at the other end to the outer band 11401. When a person is wearing the head clamp 11400 on their head, and it is installed into the wheel hub assembly of a multi-function rotational resistance exercise apparatus, they will rotate their neck side to side, as if saying "no" with their head, in order to exercise against the resistance provided by the apparatus.

Figure 115:
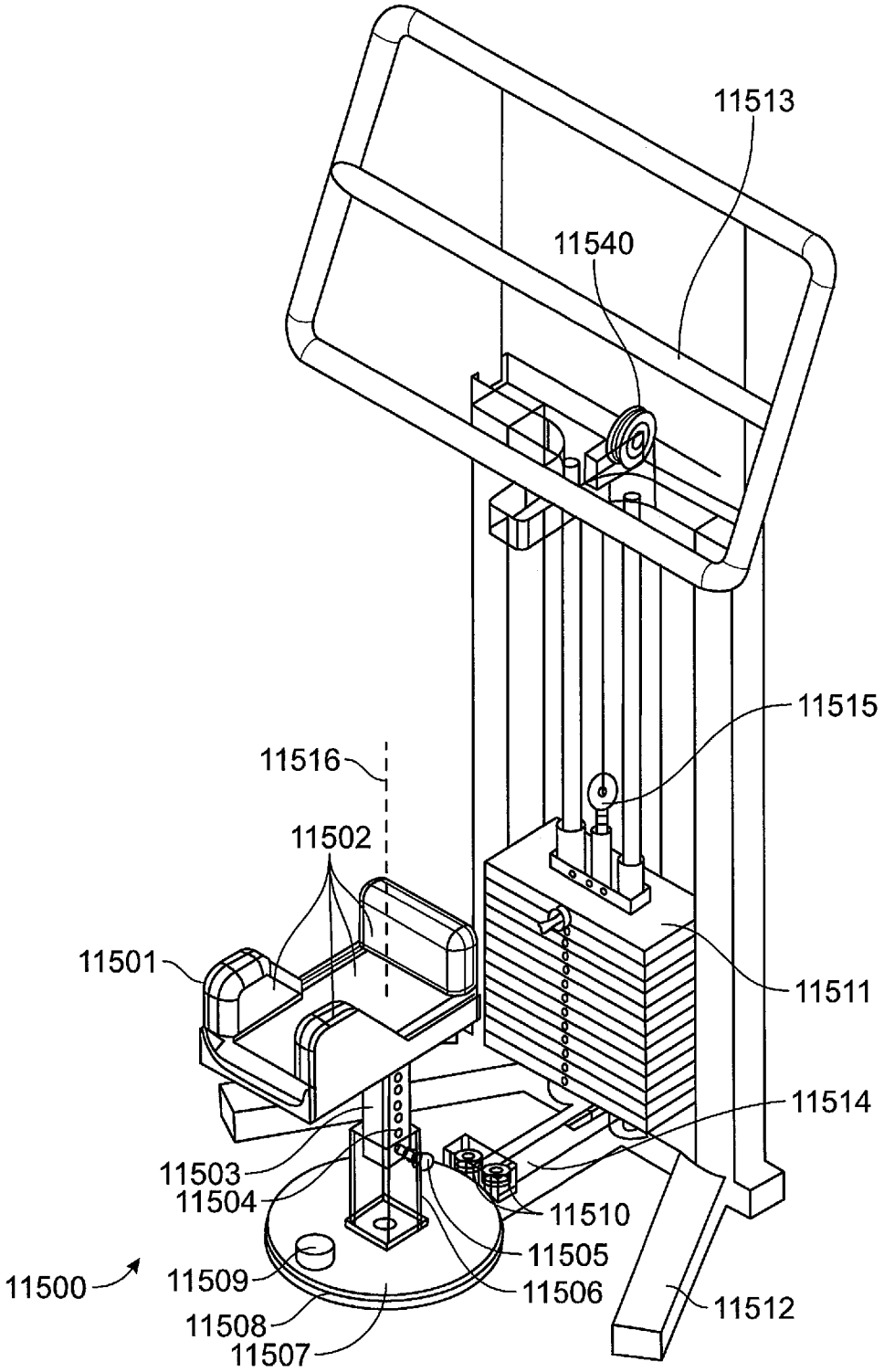
FIG. 115 shows a knee cradle exercise attachment of the present invention.

Referring to FIG. 115, knee cradle exercise apparatus 11500 comprises a knee cradle 11501 with padding 11502 secured to its inner surfaces. Knee cradle 11501 is attached to inner slide 11503, which has holes 11504 down at least one side of it. Inner slide 11503 can slide into and out of outer slide 11506, which is shown transparent, and inner slide 11503 can be held in a particular vertical position by engagement through one of holes 11504 by pin 11505 which is mounted on the surface of and passes through the side of outer slide 11506. Outer slide 11506 is secured onto the top surface 11507 of wheel 11508, and top surface pin 11509 is also secured to and passes through top surface 11507. Top surface pin 11509 protrudes through top surface 11507, and fits into one of the holes (not shown) which are located around the surface of wheel 11508. Wheel 11508 has on its periphery a groove (not shown), and the groove (not shown) attaches to one end of the cable 11514. The cable 11514 passes between two pulleys 11510, then passes through a series of other pulleys 11540, and the other end of cable 11514 terminates on weight rod 11515. Optionally when a person stands facing safety handle 11513, they can place one foot on the ground next to knee cradle 11501 and bend their other leg and place their knee inside of knee cradle 11501 and rest their knee and shin on the padding 11502. The person can then rotate their leg that is in the knee cradle 11501 internally and/or externally in order to lift the weight stack 11511. The lifting of the weight stack 11511 will occur when the cable 11514 is drawn around the wheel 11508, by the rotating of the wheel 11506. The wheel 11508 will rotate when a person rotates the knee cradle around the axis of rotation 11516. If a person desires a different rotational position for knee cradle 11501, they can simply disengage top surface pin 11509 from one of the holes in wheel 11508, then rotate the top surface 11507 to a position over a different hole in wheel 11508, then re-engage top surface pin 11509 into a new hole (not shown). This will position the knee cradle 11501 in a different position than shown in FIG. 115 around the axis of rotation 11516, which will be advantageous for a user to be able to exercise a different range of motion for the internal and external rotation of their hip and/or leg. Frame 11512 is a secure structure upon which other parts are attached.

Figure 116:
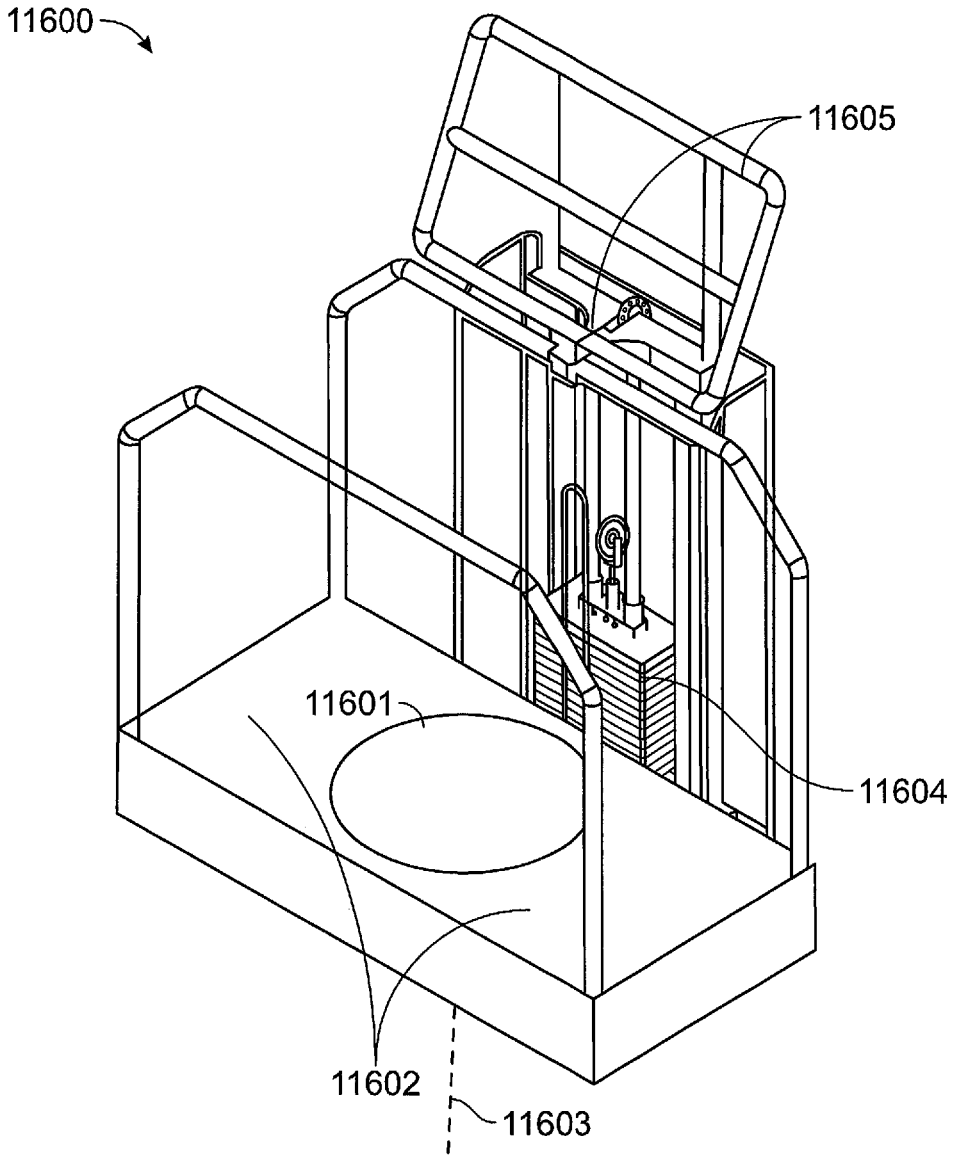
FIG. 116 shows a standing platform exercise apparatus of the present invention.

Referring to FIG. 116, standing platform exercise apparatus 11600 comprises rotating platform 11601 and stationary platform 11602. When rotating platform 11601 rotates around axis of rotation 11603, it will lift weights 11604 by retracting a cable which is connected by a series of pulleys to weights 11604. A person can step up onto the stationary platform 11602 and place one or both of their feet onto the rotating platform 11601, then the person can grasp the safety handle 11605 with their hands. Next the person can rotate the rotating platform 11601 with the exercise of their body in order to lift the weights 11604. Leg internal and/or external rotation, and/or spine lateral and/or medial rotation will be exercises when a person rotates the rotating platform 11601 with one or both of their feet.

Figure 117:
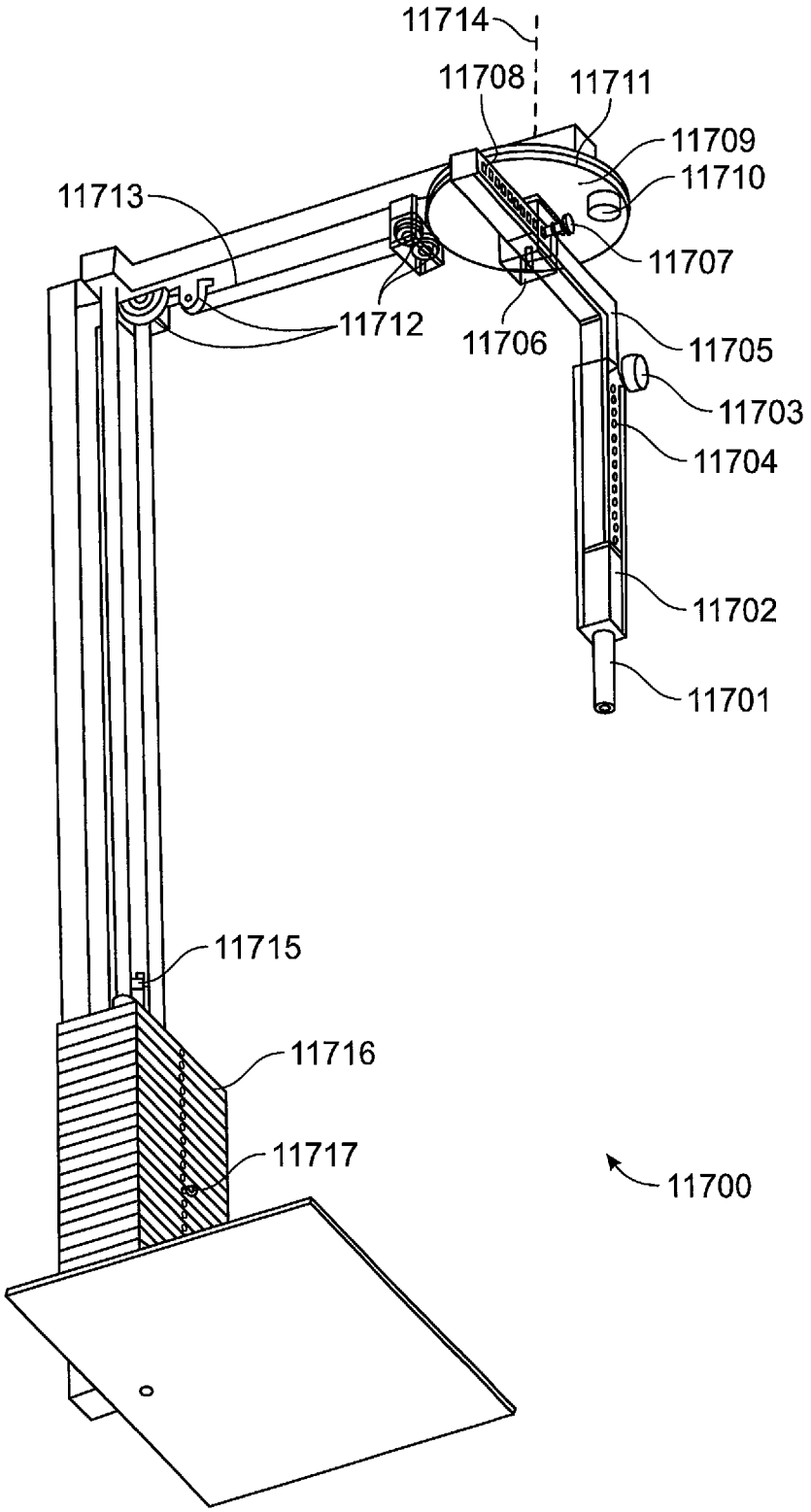
FIG. 117 shows a spine rotation exercise apparatus.

Referring to FIG. 117 in one embodiment overhead spine rotation exercise apparatus 11700 is shown in a perspective view from below and comprises grip 11701 which is connected to outer sleeve 11702. Outer sleeve 11702 has passing through its surface pop pin 11703. Pop pin 11703 secures outer sleeve to the inner sleeve 11705 by engaging one of the holes 11704 that are in inner sleeve 11705. Inner sleeve 11705 has a bend in it such that the other end of it can slide into wheel sleeve 11706. Wheel sleeve 11706 has pin 11707 passing through it and into a hole 11708 on inner sleeve 11705 in order to secure the wheel sleeve 11706 and the inner sleeve 11708 together. Wheel sleeve 11706 is secured to wheel plate 11709 at the axis of rotation 11714. Wheel plate 11709 has peg 11710 passing through it and into a hole (not shown) in wheel 11711, such that when the peg 11710 is engaged, the wheel 11711, and the wheel plate 11709 will move together. The wheel 11711 has a groove (not shown) on its periphery which captures one end of the cable 11713. The other end of cable 11713 it secured to the weight stack rod 11715. The cable 11713 passes through a series of pulleys 11712 such that when the cable 11713 is wrapped around the wheel 11711, the cable 11713 will raise and lower the weight stack rod 11715. The weight stack rod 11715 will lift one or more weights 11716 when weight pin 11717 is engaged into the weight 11716 and the weight stack rod 11715. Preferably a person will stand with their spine directly under and coincidental with the axis of rotation 11714, they then will grasp the grip 11701 with one or both of their hands. If the person needs to make adjustments to the height of the grip 11701, or the distance the grip 11701 is from their body, they will do so by disengaging the pop pin

11703 and/or disengaging the pin 11707 and sliding the outer sleeve to a new position then re-engaging the pop pin 11703 and/or sliding the inner sleeve 11705 to a new position within the wheel sleeve 11706 and reengaging pin 11707. If the person desires a new position for the grip 11701 around axis of rotation 11714, they will disengage peg 11710 and rotate the wheel plate 11709 to a new position around axis of rotation 11714, and then reengage peg 11710 into a different hole in wheel 11711. Once the grip 11701 is in a desirable position by making the various adjustments to its position in space, a person is ready to rotate the grip 11701 in a path around the axis of rotation 11714 in order to lift the weights 11716. Spine medial and/or lateral rotation is exercised along with other muscles that a person incorporates in order to accomplish the exercise.

Figure 118:
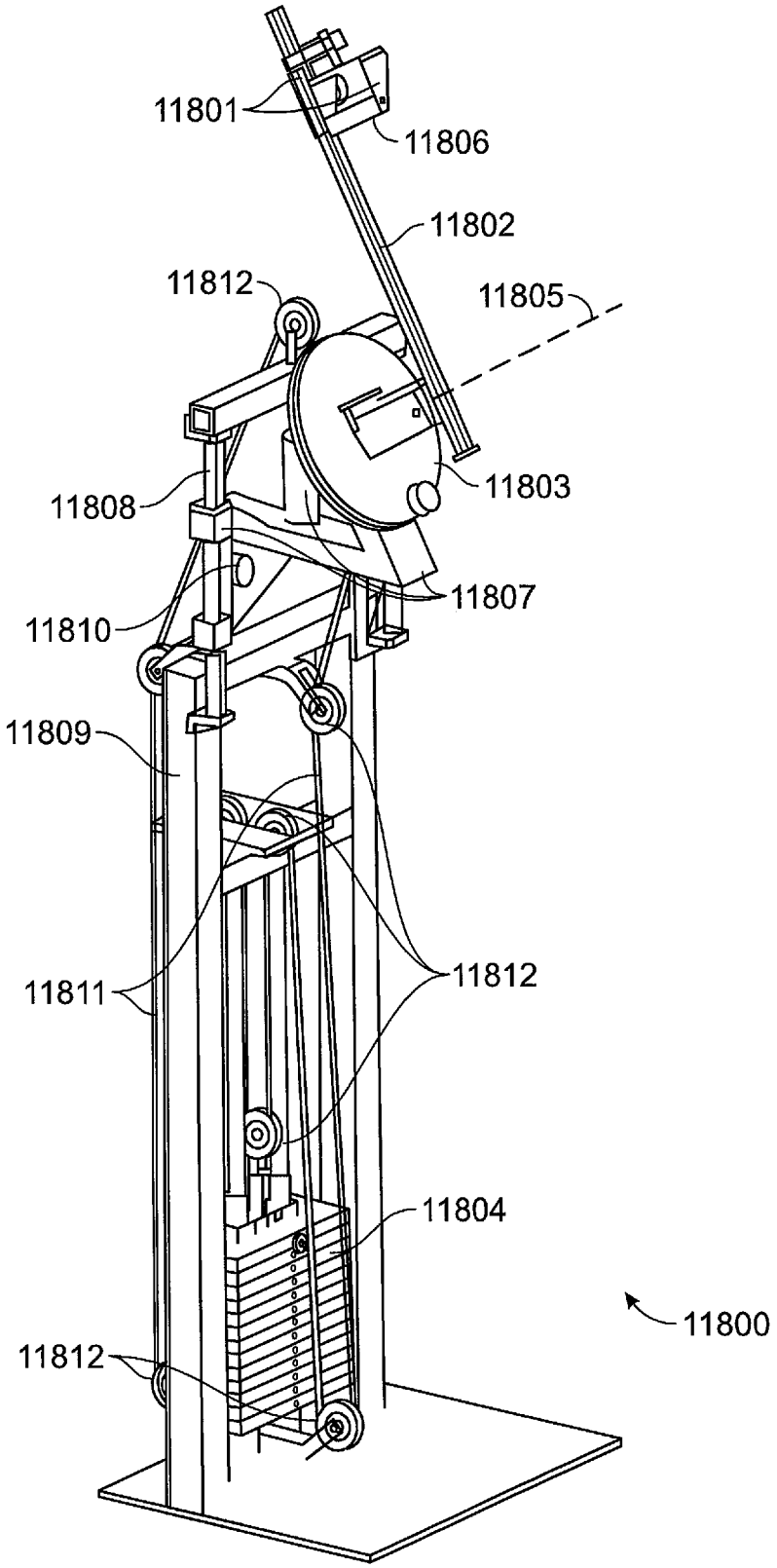
FIG. 118 shows a shoulder Proprioceptive Neuromuscular Facilitation (PNF) exercise apparatus.

Referring to FIG. 118, shoulder Proprioceptive Neuromuscular Facilitation (PNF) exercise apparatus 11800 comprises a free spinning grip attachment 11801 which is adjustably mounted on an attachment extension 11802. The attachment extension 11802 is secured to a rotational resistance assembly 11803 which in effect will lift the weights 11804 when the rotational resistance assembly 11803 is rotated around the axis of rotation 11806, and this will be done when a person stands with the axis of rotation 11805 at their side, and directed into their shoulder joint. The person will then grasp the handle 11806 of the free spin grip attachment 11801 and move it in a path around the axis of rotation 11805. The person will exercise against resistance in the proprioceptive neuromuscular facilitation pattern when doing this exercise. A combination of shoulder flexion and/or extension along with a combination of shoulder adduction and abduction is exercised when a person performs this exercise. In order to adjust the height of the rotational resistance assembly 11803 and cause it to be directed towards the shoulder joint of people with differing heights, the carriage 11807 is able to slide up and down on the guide rods 11808. The carriage 11807 has the rotational resistance assembly 11803 mounted to its surface so that when the carriage 11807 moves up and down on the guide rods 11808, the rotational resistance assembly 11803 will also move up and down, but when the rotational resistance assembly rotates on the axis of rotation 11805, the carriage 11807 will remain stationary, because there is a bearing and hub mechanism (not shown) which mates the two together. Pop pin 11810 is secured to carriage 11807 and engages in holes (not shown) in frame 11809 in order to hold the carriage 11807 at a chosen elevation. The weights 11804 will not move when a person is adjusting the elevation of the carriage due to the routing pattern of the cable 11811 through pulleys 11812.

Figure 119:
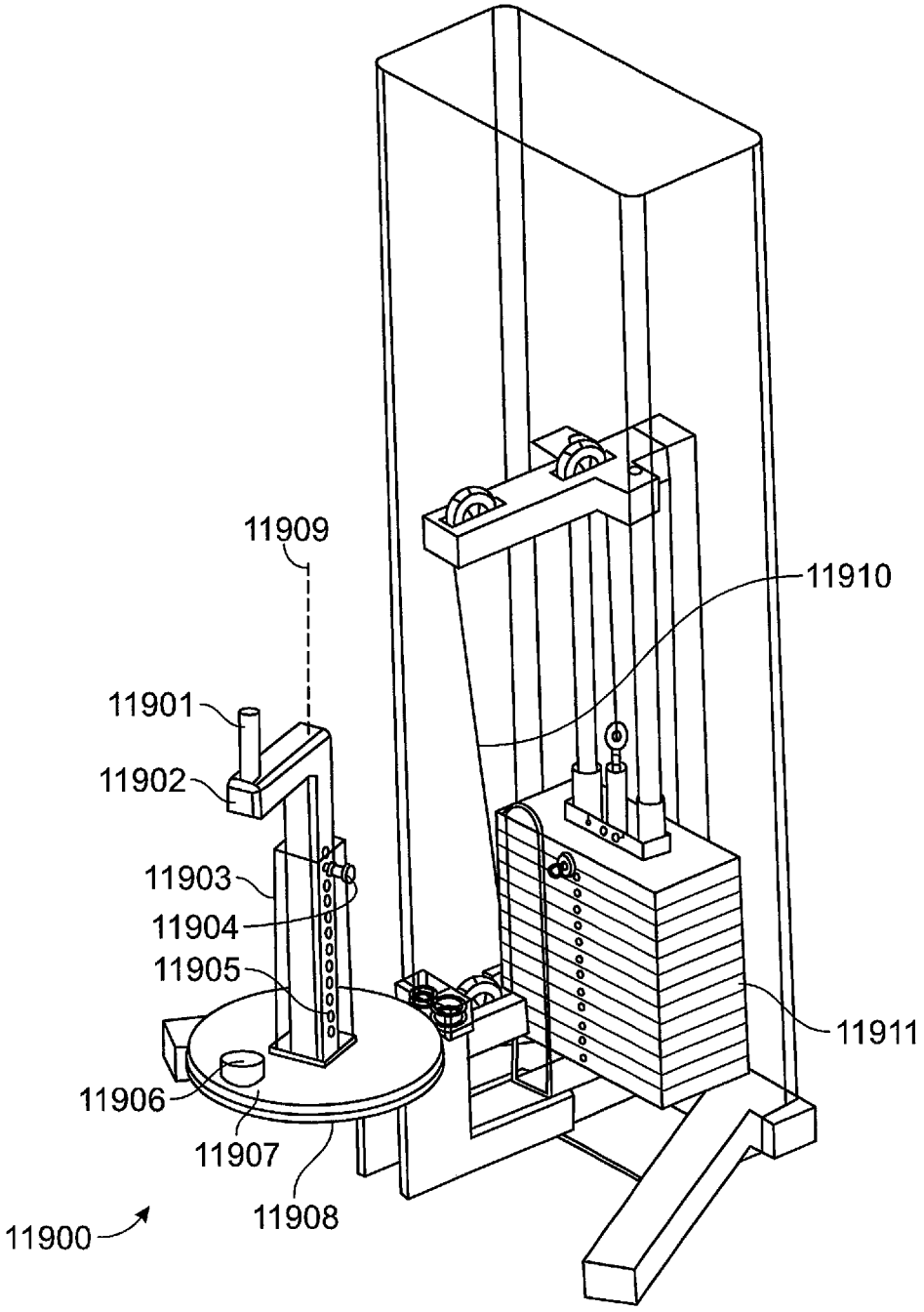
FIG. 119 shows a stir pot rotational resistance exercise apparatus.

Referring to FIG. 119, stir pot rotational resistance exercise apparatus 11900 comprises handle 11901 which is free to spin within a hole (not shown) in inner sleeve 11902. Inner sleeve 11902 is bent in such a way that it slides down into outer sleeve 11903, which is shown transparent. Inner sleeve 11902 has holes 11905 on one side of it. Outer sleeve 11903 has pin 11904 passing through its surface and into a hole 11905 on inner sleeve 11902 such that the two will no longer slide in and out of each other. The outer sleeve 11903 is mounted to top plate 11907 and top plate 11907 has pop pin 11906 passing through its surface and into holes (not shown) in wheel 11908. Wheel 11908 has a groove (not shown) on its periphery which holds one end of cable 11910, and the other end of cable 11910 is attached to the weights 11911. When a person rotates the handle 11901 in a path around the axis of rotation 11909, they will be also be rotating the wheel around the axis of rotation 11909 because the forces exerted on the handle 11901 ultimately end up being translated through the various parts of the stir pot resistance exercise apparatus 11900. A person will stand and face the handle 11901 and pull pin 11904 out of hole 11905 then raise or lower the handle 11901 to a position about their belly, then the person will reinsert pull pin 11904 into a hole 11905. The person will then grasp the handle 11901 with their hand and move it in a path around the axis of rotation 11909 in order to lift the weight 11911. Many muscles that cause a person to stand straight up are exercised when using the stir pot rotational exercise apparatus, along with muscles of the arms, shoulders, and core muscles.

INDUSTRIAL APPLICABILITY

The invention is further illustrated by the following non-limiting examples.

Example 1

An exercising apparatus was built out of metal and plastic, significantly similar to the one shown in FIG. 1. When tested to strengthen the body's joints and muscles in a supination, and/or pronation and/or rotational motion, the counteracting force from the machine directly opposed the user's supination, pronation, and rotational forces. The various attachments allowed the user to supinate or pronate particular body parts freely, without an opposing force applied to that particular supination or pronation, while pronating and/or supinating and/or rotating other body parts.

The preceding example can be repeated with similar success by substituting the generically or specifically described components and/or operating parameters of this invention for those used in the preceding examples. Note that in the specification and claims, "about" or "approximately" means within twenty percent (20%) of the numerical amount cited. Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A component of a variable resistance exercise apparatus, the component comprising:

a cradle;

a stem attached to an underside of said cradle aligned with an area of said cradle configured to receive a knee of a user of the variable resistance exercise apparatus, said stem configured to align with an axis of rotation of a bidirectionally rotatable element of the variable resistance exercise apparatus; and an opening configured to align with one of a plurality of holes near a circumference of the bidirectionally rotatable element;

wherein the component is configured such that when the user's knee is on said area and a femur of the user corresponding to the user's knee is substantially vertical, a direction of the user's femur will be coincidental with the axis of rotation of the bidirectionally rotatable element.

2. The component of claim 1 removably attachable to the variable resistance exercise apparatus.

3. The component of claim 2 wherein the component is configured to be removable from the variable resistance exercise apparatus by the user.

4. The component of claim 1 permanently attachable to the variable resistance exercise apparatus.

5. The component of claim 1 comprising a pin extending through said opening for inserting into the one of the plurality of holes.

6. The component of claim 1 wherein an interior of said cradle comprises padding.

7. The component of claim 1 wherein said cradle comprises sides approximately perpendicular to said area, said sides configured to receive pressure from a lower leg of the user, thereby rotating said bidirectionally rotatable element.

8. The component of claim 1 wherein said stem is insertable through a central opening at a center of the bidirectionally rotatable element.

9. The component of claim 1 wherein said opening is near an edge of said cradle.

10. The component of claim 1 further comprising a platform connectable to said cradle, said platform configured to rest on and connect to said bidirectionally rotatable element.

11. The component of claim 10 wherein a height of said cradle above said platform is adjustable.

12. The component of claim 10 wherein said opening is near an edge of said platform.

13. The component of claim 1 wherein a position of the one of the plurality of holes chosen to align with said opening determines a range of motion of the bidirectionally rotatable element.

14. The component of claim 1 wherein the bidirectionally rotatable element is configured to exert a constant torque directly opposing rotation of the user's femur.

15. A variable resistance exercise apparatus comprising:

the component of claim 1 attached to said bidirectionally rotatable element; and a force-transferring material providing bidirectional variable rotational resistance to said bidirectionally rotatable element and said component.

16. The variable resistance exercise apparatus of claim 15 wherein said bidirectionally rotatable element comprises a circular wheel.

17. The variable resistance exercise apparatus of claim 15 wherein said force-transferring material is disposed on a periphery of said bidirectionally rotatable element.

18. The variable resistance exercise apparatus of claim 17 wherein said force-transferring material is disposed in a groove on the periphery of said bidirectionally rotatable element.

19. The variable resistance exercise apparatus of claim 15 wherein said force-transferring material is selected from the group consisting of a cable, a belt, a chain, a rope, and a rubber band.

20. The variable resistance exercise apparatus of claim 15 wherein said force-transferring material is guided with one or more pulleys disposed in proximity to said bidirectionally rotatable element.

21. The variable resistance exercise apparatus of claim 15 wherein said bidirectionally rotatable element is disposed on a horizontal arm.

22. The variable resistance exercise apparatus of claim 21 wherein said horizontal arm is fixed and not vertically adjustable.

23. The variable resistance exercise apparatus of claim 21 wherein said horizontal arm is vertically adjustable.

24. The variable resistance exercise apparatus of claim 15 wherein the bidirectional variable rotational resistance is provided by a source selected from the group consisting of braking systems, friction, magnetic devices, electric devices, springs, adjustable weights, stretching a flexible material, hydraulics, and pneumatic devices.

25. The variable resistance exercise apparatus of claim 15 wherein the component is configured to be removable from the bidirectionally rotatable element by the user.

26. The variable resistance exercise apparatus of claim 15 wherein said force-transferring material wraps either clockwise or counterclockwise around said bidirectionally rotatable element, thereby providing the bidirectional variable rotational resistance.

27. The variable resistance exercise apparatus of claim 15 wherein said bidirectionally rotatable element comprises a plate fixed in a horizontal plane.

* * * * *